US009935382B2

(12) United States Patent
Okura et al.

(10) Patent No.: US 9,935,382 B2
(45) Date of Patent: Apr. 3, 2018

(54) CONNECTOR, CONTACT USED IN CONNECTOR, HOUSING, WIRED HOUSING, AND METHOD FOR MANUFACTURING WIRED HOUSING

(71) Applicant: Panasonic Intellectual Property Management Co., Ltd., Osaka (JP)

(72) Inventors: Kenji Okura, Mie (JP); Hisahiro Ono, Mie (JP); Mitsuru Iida, Mie (JP); Daisuke Sato, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/652,738

(22) PCT Filed: Oct. 15, 2013

(86) PCT No.: PCT/JP2013/006128
§ 371 (c)(1),
(2) Date: Jun. 16, 2015

(87) PCT Pub. No.: WO2014/097521
PCT Pub. Date: Jun. 26, 2014

(65) Prior Publication Data

US 2015/0325929 A1 Nov. 12, 2015

(30) Foreign Application Priority Data

Dec. 17, 2012 (JP) ..... 2012-274883

(51) Int. Cl.
*H01R 4/2445* (2018.01)
*H01R 4/2437* (2018.01)
(Continued)

(52) U.S. Cl.
CPC ..... *H01R 4/16* (2013.01); *F21K 9/23* (2016.08); *F21V 23/002* (2013.01); *F21V 23/06* (2013.01);
(Continued)

(58) Field of Classification Search
CPC ... H01R 4/2445–4/2466; H01R 4/2433; H01R 4/2412
(Continued)

(56) References Cited

U.S. PATENT DOCUMENTS 3,745,228 A * 7/1973 Vogt ..... H01R 4/2412 174/88 R
3,950,065 A * 4/1976 Renn ..... H01R 4/2462 439/398
(Continued)

FOREIGN PATENT DOCUMENTS

JP H09-213388 A 8/1997
JP 2004-127828 A 4/2004
(Continued)

OTHER PUBLICATIONS

International Search Report issued in PCT/JP2013/006128, dated Jan. 21, 2014, with English translation.

*Primary Examiner* — Gary Paumen
(74) *Attorney, Agent, or Firm* — McDermott Will & Emery LLP

(57) ABSTRACT

A connector includes a contact connected to a member to be connected and brought into contact with a wire so as to electrically connect the member to be connected and the wire. The contact includes contact portions coming into contact with the wire when the wire moves in a perpendicular direction perpendicular to a wire extending direction in which the wire extends, and movement restriction members for restricting a movement of the wire on the contact in a
(Continued)

state where the wire is in contact with the contact portions. The contact further includes a movement regulation member for regulating a movement of the wire in the perpendicular direction in the state where the wire is in contact with the contact portions.

49 Claims, 47 Drawing Sheets

(51) Int. Cl.

| | |
|---|---|
| ***H01R 4/16*** | (2006.01) |
| ***H01R 43/16*** | (2006.01) |
| ***H01R 4/26*** | (2006.01) |
| ***F21V 23/00*** | (2015.01) |
| ***F21V 23/06*** | (2006.01) |
| ***H01R 4/24*** | (2018.01) |
| ***H01R 43/28*** | (2006.01) |
| ***F21K 9/23*** | (2016.01) |
| *H01R 12/57* | (2011.01) |
| *F21V 3/00* | (2015.01) |
| *H01R 101/00* | (2006.01) |
| *F21Y 115/10* | (2016.01) |

(52) U.S. Cl.
CPC ..... *H01R 4/245* (2013.01); *H01R 4/26* (2013.01); *H01R 43/16* (2013.01); *H01R 43/28* (2013.01); *F21V 3/00* (2013.01); *F21Y 2115/10* (2016.08); *H01R 12/57* (2013.01); *H01R 2101/00* (2013.01); *Y10T 29/4921* (2015.01)

(58) Field of Classification Search
USPC ..... 439/409, 410
See application file for complete search history.

(56) References Cited

U.S. PATENT DOCUMENTS 4,040,702 A * 8/1977 McKee ..... H01R 4/2466 439/399
4,496,206 A * 1/1985 Markwardt ..... H01R 4/2433 439/404
4,657,321 A * 4/1987 Sorlien ..... H01R 4/2466 439/401
4,728,298 A * 3/1988 Grueber ..... H01R 4/2466 439/401
5,435,747 A * 7/1995 Franckx ..... H01R 4/2433 439/409
5,458,502 A * 10/1995 Joly ..... H01R 13/17 439/397
5,947,761 A * 9/1999 Pepe ..... H01R 4/2433 439/409
6,077,103 A * 6/2000 Saka ..... H01R 4/2466 439/397
6,080,006 A * 6/2000 Broder ..... H01R 4/2433 439/409
6,113,421 A * 9/2000 Daoud ..... H01R 4/2433 439/409
6,254,421 B1 * 7/2001 Denovich ..... H01R 4/2433 439/409
6,296,512 B1 * 10/2001 Akeda ..... H01R 4/245 439/397
6,296,515 B1 * 10/2001 Daoud ..... H01R 4/2433 439/409
6,394,834 B2 * 5/2002 Fujimoto ..... H01R 4/2466 439/395
6,406,324 B1 * 6/2002 Duesterhoeft ..... H01R 4/2433 439/409
6,561,837 B1 * 5/2003 Ishida ..... H01R 4/2466 439/397
6,575,779 B1 * 6/2003 Nagai ..... H01R 4/2466 439/397
6,634,101 B2 * 10/2003 Sato ..... H01R 13/506 29/827
6,692,290 B2 * 2/2004 Yamanashi ..... H01R 4/2466 439/203
6,890,209 B2 * 5/2005 Sawada ..... H01R 43/0228 439/399
7,011,543 B2 * 3/2006 Hiramoto ..... H01R 4/2466 439/405
7,118,404 B2 * 10/2006 Ploesser ..... H01R 4/2454 439/395
7,275,952 B1 * 10/2007 Fabian ..... H01R 4/2433 439/409
7,540,760 B1 * 6/2009 Chen ..... H01R 4/2433 439/409
7,789,695 B2 * 9/2010 Radle ..... H01R 4/2433 439/402
8,062,056 B2 * 11/2011 Lee ..... H01R 4/2433 439/395
8,512,066 B2 * 8/2013 Lee ..... H01R 4/2433 439/395
2005/0032412 A1 * 2/2005 Bolouri-Saransar . H01R 4/2433 439/409
2005/0287862 A1 * 12/2005 Castaldo ..... H01R 13/5833 439/409
2008/0146073 A1 * 6/2008 Stein ..... H01R 4/2433 439/409
2008/0153327 A1 6/2008 Weber et al.

FOREIGN PATENT DOCUMENTS

JP 2010-514138 A 4/2010
JP 2011-258313 A 12/2011

* cited by examiner (a)

(b)

(a)

(b)

CONNECTOR, CONTACT USED IN CONNECTOR, HOUSING, WIRED HOUSING, AND METHOD FOR MANUFACTURING WIRED HOUSING

RELATED APPLICATIONS

This application is the U.S. National Phase under 35 U.S.C. § 371 of International Application No. PCT/JP2013/006128, filed on Oct. 15, 2013, which in turn claims the benefit of Japanese Application No. 2012-274883, filed on Dec. 17, 2012, the disclosures of which Applications are incorporated by reference herein.

TECHNICAL FIELD

The present invention relates to a connector, a contact used in the connector, a housing, a wired housing, and a method for manufacturing a wired housing.

BACKGROUND ART

There are known connectors for electrically connecting wires and boards (for example, refer to Patent Document 1).

In Patent Document 1, a connector includes a contact connected to a board, a wire fixed to the contact, and a housing to which the contact is attached.

The contact connected to the board is integrally attached to the housing, and the wire is inserted and fixed into the contact integrally attached to the housing so as to electrically connect the wire and the board.

CITATION LIST

Patent Document

Patent Document 1: Japanese Translation of PCT International Application Publication No. 2010-514138

SUMMARY OF INVENTION

Technical Problem

In the conventional technique, since the wire is fixed to the contact in a manner such that the wire is moved in the axial direction and inserted into the contact attached to the housing, the wire is bent when inserted into the contact. As a result, it may cause the trouble of attaching the wire to the contact.

An object of the present invention is to provide a connector capable of facilitating attachment of a wire to a contact, a contact used in the connector, a housing, a wired housing, and a method for manufacturing a wired housing.

Solution to Problem

A first aspect of the present invention provides a connector including a contact connected to a member to be connected and brought into contact with a wire so as to electrically connect the member to be connected and the wire, the contact including: a contact portion coming into contact with the wire when the wire moves in a perpendicular direction perpendicular to a wire extending direction in which the wire extends; a movement restriction member for restricting a movement of the wire on the contact in a state where the wire is in contact with the contact portion; and a movement regulation member for regulating a movement of the wire in the perpendicular direction in the state where the wire is in contact with the contact portion.

A second aspect of the present invention provides the connector, wherein the movement restriction member restricts the movement of the wire in the wire extending direction.

A third aspect of the present invention provides the connector, wherein the contact portion includes first side wall portions located on both sides in a width direction when viewed in the wire extending direction and at least one second side wall portion provided between the first side wall portions, the second side wall portion includes a second side wall portion elastically deformable in the width direction, and the wire is held, at least on one side in the width direction, by the second side wall portion elastically deformable in the width direction.

A fourth aspect of the present invention provides the connector, wherein the contact includes an installation member installed and connected to the member to be connected, and the movement regulation member includes the installation member.

A fifth aspect of the present invention provides the connector, wherein the installation member includes the movement regulation member on one side and an installation surface for the member to be connected on another side.

A sixth aspect of the present invention provides the connector, wherein the installation member is provided with a recess at an edge thereof.

A seventh aspect of the present invention provides the connector, wherein the movement regulation member is provided with an adhesion surface on one side.

An eighth aspect of the present invention provides the connector, wherein the adhesion surface also serves as the movement regulation member.

A ninth aspect of the present invention provides the connector, wherein more than one movement restriction member is provided, each movement restriction member corresponding to the movement restriction member, and the more than one movement restriction member is arranged symmetrically when viewed in the perpendicular direction.

A 10th aspect of the present invention provides the connector, wherein the movement restriction member includes a locking piece for locking the wire in the state where the wire is in contact with the contact portion.

An 11th aspect of the present invention provides the connector, wherein the locking piece includes a lock piece for holding the wire in the state where the wire is in contact with the contact portion.

A 12th aspect of the present invention provides the connector, wherein the lock piece holds the wire in a state where a tip of the lock piece bites a wall surface of the wire.

A 13th aspect of the present invention provides the connector, wherein the tip of the lock piece bites the wall surface of the wire along a circumference thereof.

A 14th aspect of the present invention provides the connector, wherein the locking piece includes a first locking piece and a second locking piece facing each other with the wire interposed therebetween, and the movement regulation member is located between a locking portion of the first locking piece and a locking portion of the second locking piece when viewed in the perpendicular direction.

A 15th aspect of the present invention provides the connector, wherein the contact is formed in a manner such that a metal plate is processed, and the locking piece is formed in a manner such that the metal plate is cut and bent.

A 16th aspect of the present invention provides the connector, wherein the locking piece is connected to the movement regulation member on one side and extends toward the wire in contact with the contact portion on another side.

A 17th aspect of the present invention provides the connector, wherein the locking piece extends to make an acute angle to the wire extending direction of the wire in contact with the contact portion when viewed in the perpendicular direction.

An 18th aspect of the present invention provides the connector, wherein more than one movement restriction member is provided, each movement restriction member corresponding to the movement restriction member, and the more than one movement restriction member includes at least one movement restriction member including a locking piece having a first end and a second end, the second end being located on one side in the wire extending direction, and at least one movement restriction member including a locking piece having a first end and a second end, the second end being located on another side in the wire extending direction opposite to the one side.

A 19th aspect of the present invention provides the connector, wherein the contact is formed by being subjected to metal press processing, and a sharper edge of edges at the second end of each locking piece formed by the metal press processing in a punching direction is located toward the wire.

A 20th aspect of the present invention provides the connector, wherein the wire is held by the contact portion.

A 21st aspect of the present invention provides the connector, wherein the wire is inserted into and held by the contact portion when the wire is moved in the perpendicular direction.

A 22nd aspect of the present invention provides the connector, wherein the contact is provided with an opening on a side from which the wire is inserted and provided with the movement regulation member on a side opposite to the side from which the wire is inserted.

A 23rd aspect of the present invention provides the connector, wherein the contact is entirely open on the side from which the wire is inserted.

A 24th aspect of the present invention provides the connector, wherein the contact is open in a vertical direction with respect to one surface of the movement regulation member.

A 25th aspect of the present invention provides the connector, wherein the contact portion also serves as the movement restriction member.

A 26th aspect of the present invention provides the connector, wherein the contact portion includes a contact piece.

A 27th aspect of the present invention provides the connector, wherein the contact piece is formed separately from the locking piece formed in the movement restriction member.

A 28th aspect of the present invention provides the connector, wherein the contact piece and the locking piece are aligned in the wire extending direction.

A 29th aspect of the present invention provides the connector, wherein the wire comes into contact with the contact portion in a manner such that the wire not in contact with the contact portion is moved to one side in the perpendicular direction, and the contact includes a drop-off prevention portion for covering at least part of the wire in contact with the contact portion on another side in the perpendicular direction.

A 30th aspect of the present invention provides the connector, wherein the drop-off prevention portion is formed in at least one of the movement restriction member and the contact portion.

A 31st aspect of the present invention provides the connector, wherein the drop-off prevention portion is formed in at least one of the locking piece of the movement restriction member and the contact piece of the contact portion.

A 32nd aspect of the present invention provides the connector, wherein the drop-off prevention portion includes a projection.

A 33rd aspect of the present invention provides the connector, wherein the wire is a single-core wire.

A 34th aspect of the present invention provides the connector, wherein the wire is a stranded wire.

A 35th aspect of the present invention provides the connector, wherein the wire is a coaxial wire.

A 36th aspect of the present invention provides the connector, wherein the wire includes a core as a conductive member and a covering portion covering the core, the contact portion is electrically connected to the core of the wire, and the movement restriction member is engaged with the core of the wire so as to restrict the movement of the wire.

A 37th aspect of the present invention provides the connector, wherein the wire include a core as a conductive member and a covering portion covering the core, the contact portion is electrically connected to the core of the wire, and the movement restriction member is engaged with the covering portion of the wire so as to restrict the movement of the wire.

A 38th aspect of the present invention provides the connector including a housing for housing and holding the wire without using the contact, wherein the housing is provided with an opening at least on one surface and holds the wire in a manner such that the housed and held wire is exposed on the opening when viewed in an open direction of the opening.

A 39th aspect of the present invention provides the connector, wherein the wire includes a flattened portion obtained in a manner such that a tip portion is flattened, and the housing includes a holding portion for holding the flattened portion of the wire.

A 40th aspect of the present invention provides a contact used in the connector.

A 41st aspect of the present invention provides a wired housing used in the connector to which the wire is attached.

A 42nd aspect of the present invention provides a housing used in the connector.

A 43rd aspect of the present invention provides a housing including: a housing portion for housing a wire; an opening communicating with the housing portion in such a manner as to be open in a perpendicular direction perpendicular to a wire extending direction in which the wire extends and exposing the wire housed in the housing portion when viewed in the perpendicular direction; and a holding portion for holding the wire housed in the housing portion, wherein the housing portion can receive, via the opening, a contact connected to a member to be connected, and the contact comes into contact with the wire in a state where the wire is housed in the housing portion.

A 44th aspect of the present invention provides the housing, wherein the wire includes a flattened portion formed in a manner such that a tip portion is flattened, and the holding portion holds the flattened portion of the wire.

A 45th aspect of the present invention provides the housing, wherein the holding portion includes a flattened-portion locking portion for locking the flattened portion.

A 46th aspect of the present invention provides the housing including a mount portion on which the wire housed in the housing portion is mounted.

A 47th aspect of the present invention provides the housing, wherein a surface of the mount portion on which the wire is mounted is formed to conform to a surface of the wire.

A 48th aspect of the present invention provides the housing, wherein the housing is formed only by use of upper and lower metal molds.

A 49th aspect of the present invention provides the housing, wherein the flattened-portion locking portion is a space defined by wall surfaces, and the wall surfaces surrounding the flattened-portion locking portion are provided with an open hole through which the wire is exposed.

A 50th aspect of the present invention provides the housing, wherein the open hole is provided on the respective wall surfaces facing each other and surrounding the flattened-portion locking portion.

A 51st aspect of the present invention provides the housing including a wire introduction hole by which the housing portion communicates with an outside and through which the wire is inserted so as to be housed in the housing portion.

A 52nd aspect of the present invention provides the housing including a temporarily holding portion for temporarily holding the wire housed in the housing portion.

A 53rd aspect of the present invention provides the housing, wherein the temporarily holding portion temporarily holds the wire housed in the housing portion by bending the wire in the perpendicular direction.

A 54th aspect of the present invention provides the housing, wherein the temporarily holding portion is a projection projecting in the perpendicular direction with which the wire comes into contact so as to be bent in the perpendicular direction.

A 55th aspect of the present invention provides a method for manufacturing a wired housing including a housing and a wire attached to the housing, the housing including a housing portion for housing the wire, an opening communicating with the housing portion in such a manner as to be open in a perpendicular direction perpendicular to a wire extending direction in which the wire extends and exposing the wire housed in the housing portion when viewed in the perpendicular direction, and a holding portion for holding a flattened portion of the wire housed in the housing portion, the method including the steps of: housing the wire in the housing portion of the housing and exposing a tip portion of the wire from a through-hole penetrating from one side to another side of the housing; and forming the flattened portion by inserting a pressing portion formed on one jig into the through-hole from the one side and inserting a pressing portion formed on another jig from the other side so as to flatten the tip portion of the wire.

A 56th aspect of the present invention provides the method, wherein the step of forming the flattened portion includes the steps of: shifting the wire in the wire extending direction in which the wire extends and exposing a part of the tip portion of the wire not flattened from the through-hole; and flattening the part of the tip portion of the wire not flattened by use of the jigs.

A 57th aspect of the present invention provides the method, wherein the step of forming the flattened portion repeats the steps of shifting the wire in the wire extending direction in which the wire extends and exposing the part of the tip portion of the wire not flattened from the through-hole, and flattening the part of the tip portion of the wire not flattened by use of the jigs.

Advantageous Effects of Invention

According to the present invention, the wire is moved in the perpendicular direction perpendicular to the wire extending direction so that the wire is attached to the contact. Therefore, the wire can be prevented from being bent when the wire is attached to the contact so as to facilitate the attachment of the wire to the contact.

DESCRIPTION OF EMBODIMENTS

Figure 1:
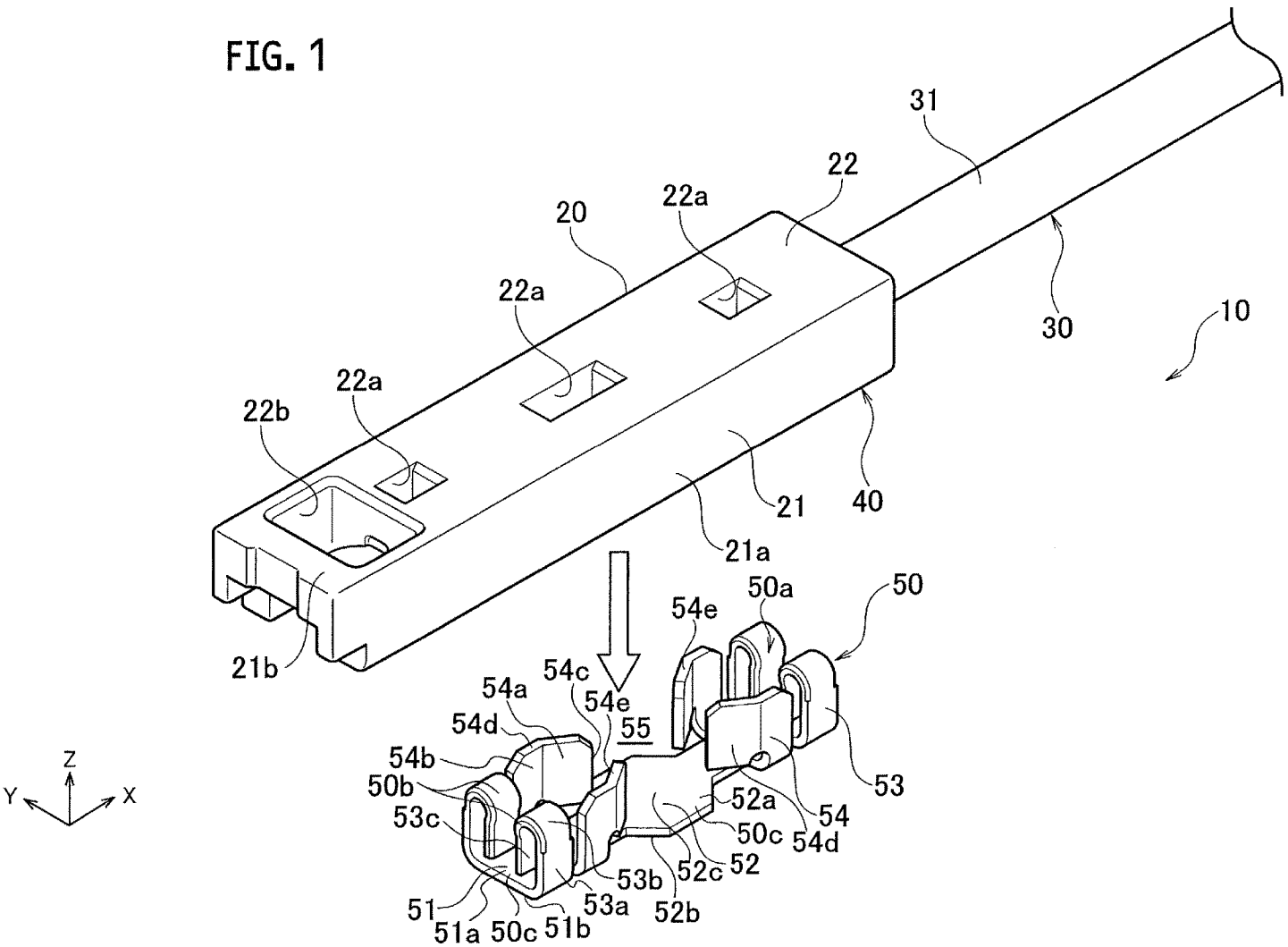
FIG. 1 is a partly-exploded perspective view, as viewed from one side, showing a connector according to a first embodiment of the present invention.

Hereinafter, embodiments of the present invention will be explained in detail with reference to the drawings. In the following explanations, the longitudinal direction of a housing (wire extending direction: wire axial direction) is defined as X direction, the thickness direction of the housing (perpendicular direction perpendicular to the wire extending direction) is defined as Z direction, and the lateral direction of the housing (width direction) is defined as Y direction.

In addition, the following several embodiments and modified examples include the same elements. Thus, the same elements are indicated by common reference numerals, and explanations thereof are not repeated.

First Embodiment

Figure 2:
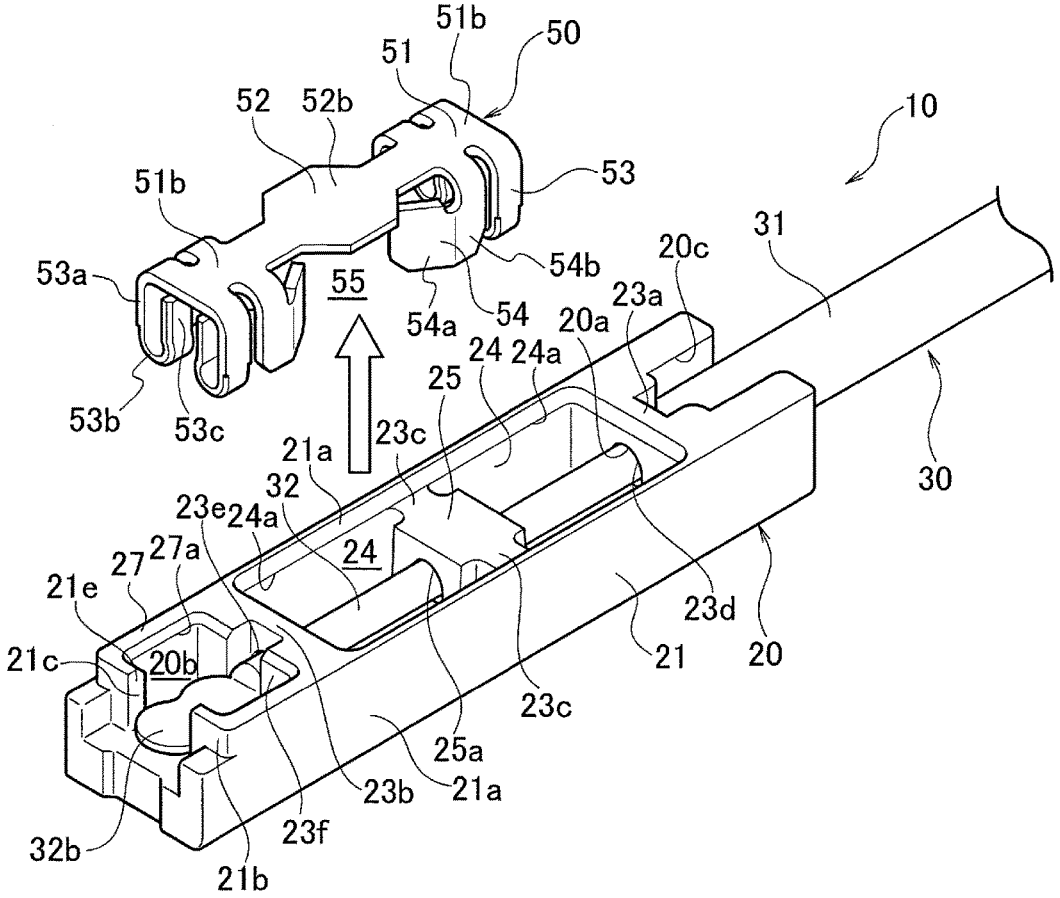
FIG. 2 is a partly-exploded perspective view, as viewed from the other side, showing the connector according to the first embodiment of the present invention.

A connector 10 according to the present embodiment includes a contact 50 connected to a board (member to be connected) 60, and a plug housing (housing) 20 in which a wire 30 is housed and fixed (attached), as shown in FIG. 1 and FIG. 2. The connector 10 electrically connects the wire 30 and the board 60 in such a manner as to fit the wire 30 housed and fixed in the plug housing (the housing) 20 made of resin to the contact 50 mounted on the board 60 so as to bring the wire 30 into contact with the contact 50.

Figure 3:
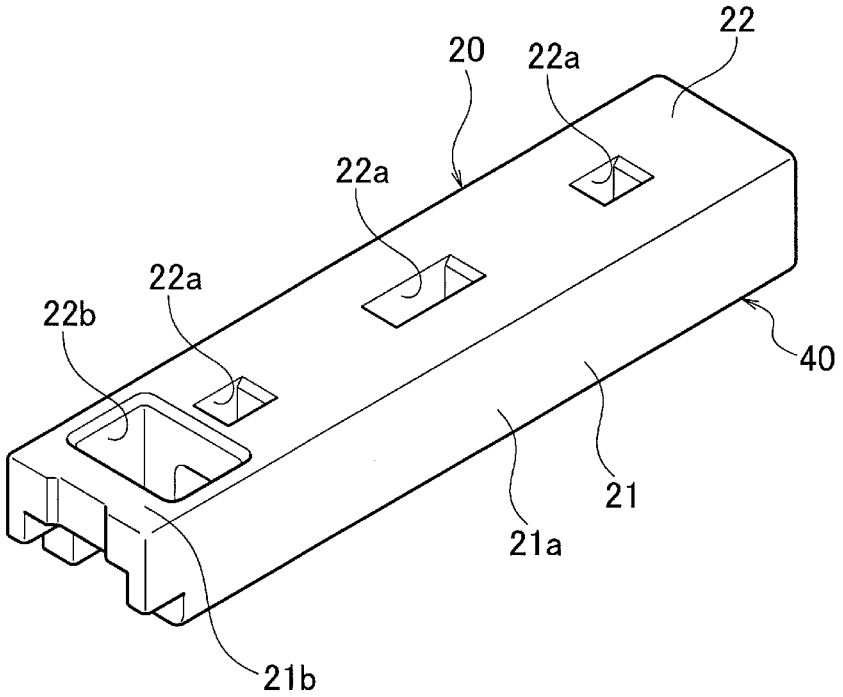
FIG. 3 is a perspective view showing a housing according to the first embodiment of the present invention, wherein FIG. 3(*a*) is a view as viewed from one side, and FIG. 3(*b*) is a view as viewed from the other side.
Figure 3:
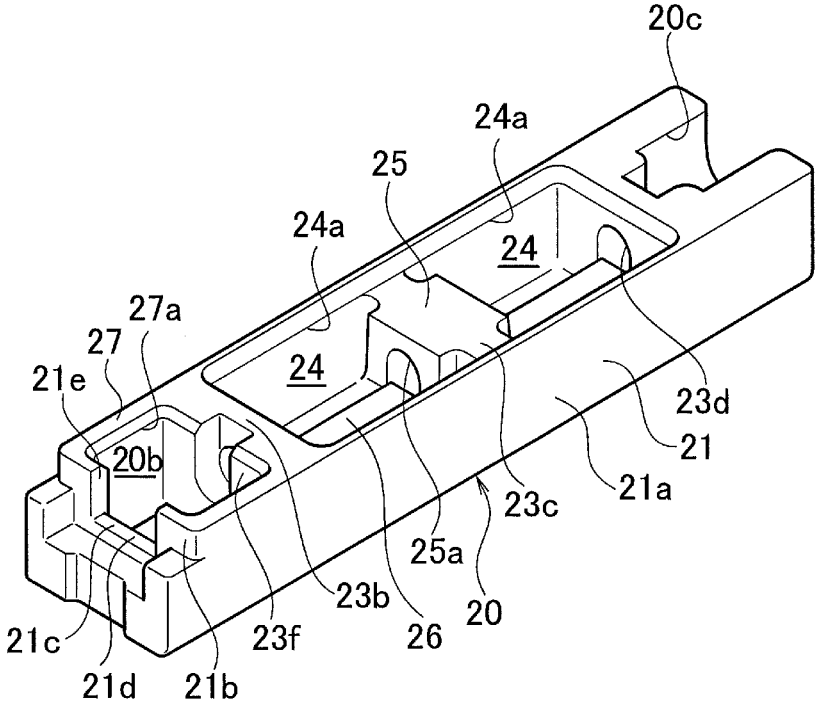
Figure 4:
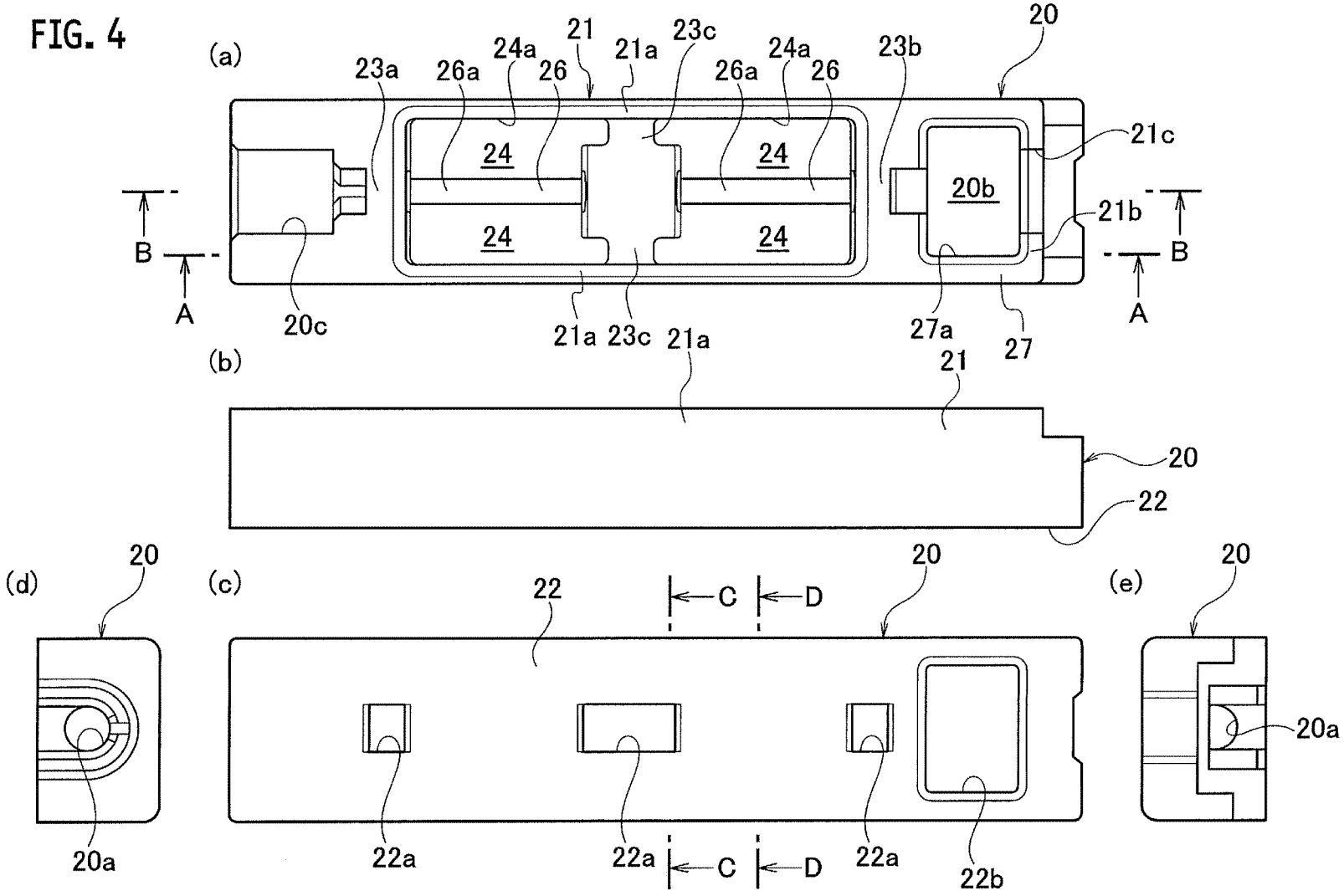
FIG. 4 is a view showing the housing according to the first embodiment of the present invention, wherein FIG. 4(*a*) is a bottom view, FIG. 4(*b*) is a side view, FIG. 4(*c*) is a plan view, FIG. 4(*d*) is a front view, and FIG. 4(*e*) is a rear view.
Figure 5:
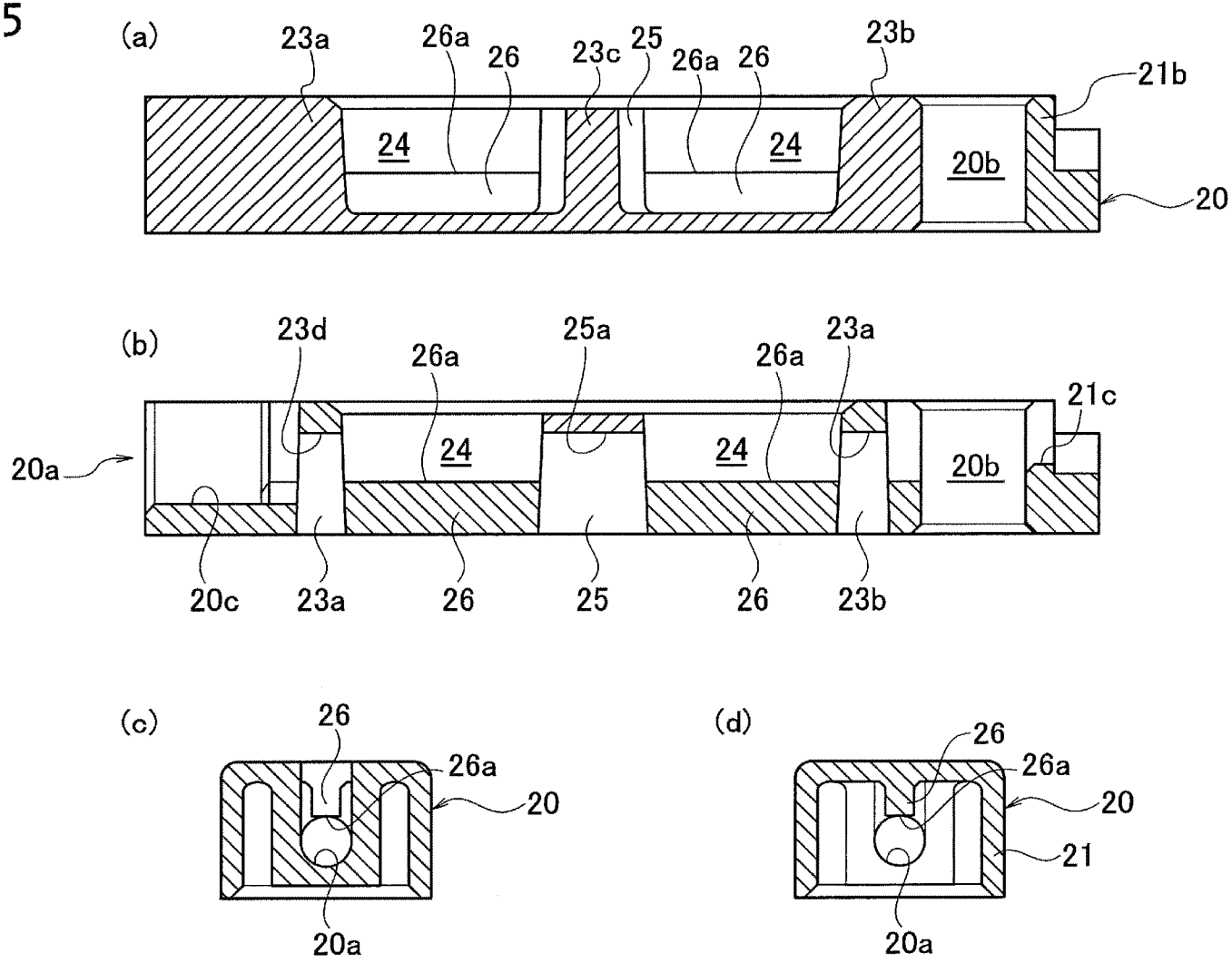
FIG. 5 is a view showing the housing according to the first embodiment of the present invention, wherein FIG. 5(*a*) is a cross-sectional view taken along line A-A in FIG. 4(*a*), FIG. 5(*b*) is cross-sectional view taken along line B-B in FIG. 4(*a*), FIG. 5(*c*) is a cross-sectional view taken along line C-C in FIG. 4(*c*), and FIG. 5(*d*) is a cross-sectional view taken along line D-D in FIG. 4(*c*).

As shown in FIG. 3 to FIG. 5, the plug housing 20 is formed substantially into a rectangular parallelepiped and includes a circumferential wall 21 and an upper wall 22. The circumferential wall 21 includes lateral-direction-side circumferential walls 21*a* located on both sides in the width direction (the lateral direction: the Y direction) and elongated in the longitudinal direction (the axial direction of the wire 30: the X direction), and a longitudinal-direction-side circumferential wall 21*b* located at one end in the longitudinal direction (the axial direction of the wire 30: the X direction) and elongated in the width direction (the lateral direction: the Y direction). The circumferential wall 21 has an opening formed substantially into a U-shape at the other end in the X direction.

The plug housing 20 further includes a housing portion 24 communicating with an opening 24*a* provided at least on one surface (on the upper side in FIG. 4(*b*): the Z direction: the perpendicular direction). The wire 30 is housed in the housing portion 24. According to the present embodiment, the opening 24*a* communicates with the housing portion 24 in such a manner as to be open in the Z direction (the perpendicular direction) perpendicular to the X direction (the wire extending direction in which the wire 30 extends). The wire 30 housed and held in the housing portion 24 is exposed to the outside via the opening 24*a* when viewed in the open direction of the opening 24*a* (the Z direction). Thus, the wire 30 housed in the housing portion 24 can be visually recognized through the opening 24*a*. In the present embodiment, the housing portion 24 is defined by the lateral-direction-side circumferential walls 21*a*, 21*a* and lateral wall portions 23*a*, 23*b* extending in the width direction (the lateral direction: the Y direction) so as to connect the lateral-direction-side circumferential walls 21*a*, 21*a* to each other.

The housing portion 24 is provided in the middle thereof with a land portion 25. The land portion 25 is fixed to the lateral-direction-side circumferential walls 21*a*, 21*a* via connecting wall portions 23*c*. Thus, the housing portion 24 is divided into two regions by the land portion 25 and the connecting wall portions 23*c*, 23*c*.

Figure 6:
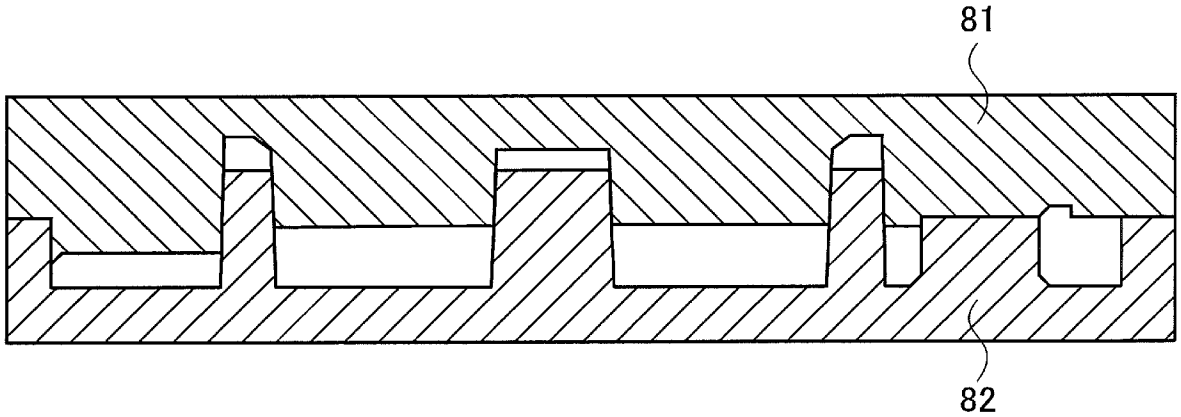
FIG. 6 is a cross-sectional view showing an example of a method for molding the housing according to the first embodiment of the present invention.

The land portion 25 is provided with a through-hole 25*a* penetrating in the X direction so that the wire 30 passes therethrough. In the present embodiment, the through-hole 25*a* is formed substantially into a U-shape open to the upper wall 22 when viewed from the front side (viewed in the X direction), and communicates with openings 22*a* formed on the upper wall 22. This configuration facilitates resin molding of the plug housing 20 including the land portion 25 provided with the through-hole 25*a* only by use of upper and lower metal molds (upper mold 81 and lower mold 82) (refer to FIG. 6). In other words, the use of a slide core is not required so as to simplify the configuration of the molds used.

Figure 7:
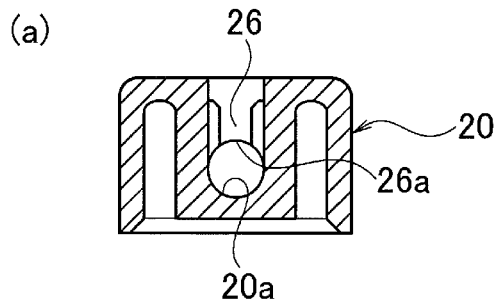
FIG. 7 is a view showing a modified example of a mount portion, wherein FIG. 7(*a*) is a cross-sectional view corresponding to FIG. 5(*c*), and FIG. 7(*b*) is a cross-sectional view corresponding to FIG. 5(*d*).
Figure 7:
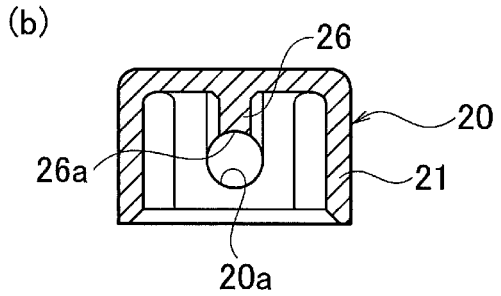

The housing portion 24 is further provided, on both sides of the land portion 25 in the housing portion 24, with mount portions 26 extending in the X direction for mounting the wire 30 and including mount surfaces 26*a* on which the wire 30 is mounted. The mount portions 26 provided in the plug housing 20 can hold the wire 30 more stably. Note that, although the present invention exemplifies the flat mount surfaces 26*a* as shown in the drawings such as FIG. 5, the mount surfaces 26*a* of the mount portions 26 are each preferably formed into a shape conforming to the surface of the wire 30 as shown in FIG. 7. In particular, when the wire 30 has an elongated cylindrical shape as exemplified in the present embodiment, the mount surfaces 26*a* are each preferably formed into a concave shape recessed in the middle in the Y direction so as to come into contact and conform with the surface of the wire 30 having the circumferential surface of the cylindrical shape. Accordingly, the wire 30 can be mounted on the mount portions 26 more stably.

The lateral wall portions 23*a*, 23*b* in the plug housing 20 are provided, on the respective outer sides thereof in the X direction, with an insertion recess 20*c* through which the wire 30 is inserted into the plug housing 20 and a locking portion (holding portion for holding the tip of the wire 30) 20*b* for locking the tip of the wire 30 inserted into the plug housing 20.

The insertion recess 20*c* has an opening on the outer side in the X direction and communicates, on the inner side in the X direction, with a through-hole (wire introduction hole) 23*d* of the lateral wall portion 23*a*. The wire 30 is inserted through the opening on the outer side in the X direction.

The locking portion 20*b* communicates, on the inner side in the X direction, with a through-hole 23*e* of the lateral wall portion 23*b* and is provided with a space on the outer side in the X direction defined by the longitudinal-direction-side circumferential wall 21*b*.

According to the present invention, an insertion hole 20*a* is composed of the insertion recess 20*c*, the through-hole 23*d* of the lateral wall portion 23*a*, the mount surface 26*a* of the mount portion 26, the through-hole 25*a* of the land portion 25, the mount surface 26*a* of the mount portion 26, the through-hole 23*e* of the lateral wall portion 23*b*, and the locking portion 20*b*, through which the wire 30 is inserted into the plug housing.

As described above, the plug housing 20 includes the housing portion 24 for housing the wire 30, the opening 24*a* that communicates with the housing portion 24 in such a manner as to be open in the perpendicular direction (the Z direction) perpendicular to the wire extending direction (the X direction) in which the wire 30 extends so that the wire 30 housed in the housing portion 24 is exposed to the outside via the opening 24*a* when viewed from the open direction (the Z direction), and the locking portion (the holding portion) 20*b* for holding the wire 30 housed in the housing portion 24. The housing portion 24 can receive, through the opening 24*a*, the contact 50 connected to the board (the member to be connected) 60. The contact 50 is received into the housing portion 24 from one side in the Z direction (from a bottom wall 27 of the plug housing 20). The contact 50 comes into contact with the wire 30 while the contact 50 is received by the housing portion 24. The above-described configuration in which the contact 50 comes into contact with the wire 30 held by the plug housing 20 while the contact 50 is received by the housing portion 24, can decrease the thickness of the connector 10 in the Z direction. In addition, a mutual movement between the contact 50 and the wire 30 in contact with each other can be restricted so as to further improve the contact reliability.

The plug housing 20 is provided with the through-hole (the wire introduction hole) 23*d* by which the housing portion 24 communicates with the outside and through which the wire 30 is inserted so as to be housed in the housing portion 24. This configuration facilitates the process of housing the wire 30 into the housing portion 24. The through-hole 23*d* is not open to other directions (the Z direction and Y direction) other than the X direction. That is, the through-hole 23*d* is a hole which is closed when viewed in the X direction. Accordingly, the wire 30 is housed in the housing portion 24 in a state where a movement of the wire 30 in the other directions (the Z direction and Y direction) other than the X direction is restricted by the circumferential wall (the lateral wall portion 23*a*) of the through-hole 23*d*. Thus, the wire 30 housed in the housing portion 24 is prevented from coming off the housing portion 24 in the directions other than the insertion direction (the X direction). The through-hole 25*a* and the through-hole 23*e* also have the same function to prevent the wire 30 from coming off the housing portion 24 in the directions other than the X direction. Note that the respective through-holes are not required to be closed when viewed in the X direction. For example, even the through-holes provided with a notch smaller than the diameter of the wire 30 when viewed in the X direction, can achieve the similar effect as described above.

In the present embodiment, the locking portion 20*b* is a space defined by wall surfaces of the plug housing 20 and is provided with a through-hole on one of the wall surfaces surrounding the locking portion 20*b* of the plug housing 20 in a manner such that the wire 30 is exposed to the outside when viewed in the penetrating direction (the Z direction in the present embodiment).

More particularly, the upper wall 22 is provided with an opening (open hole: through-hole) 22*b* communicating with the locking portion 20*b* and open in the Z direction so that the wire 30 is exposed to the outside when viewed in the Z direction.

The locking portion 20*b* is further provided with a through-hole (open hole) 27*a* open in the Z direction on the bottom wall 27 on the opposite side of the opening (the through-hole) 22*b*. Thus, the through-holes (the open holes: the opening 22*b* and the through-hole 27*a*) are provided on both sides of the locking portion 20*b* in the Z direction (on the wall surfaces opposite to each other among the wall surfaces surrounding the locking portion). This configuration allows the locking portion 20*b* to penetrate the plug housing 20 on both sides in the Z direction so that the tip of the wire 30 inserted into the locking portion 20*b* is exposed to the outside on both sides when viewed in the thickness direction of the plug housing 20 (the Z direction). The locking portion 20*b* is thus a through-hole penetrating from one side to the other side of the plug housing 20 in the Z direction. The open holes provided on the wall surfaces surrounding the locking portion 20*b* serve as viewing holes for confirming whether the wire 30 is inserted to the end of the plug housing 20. Particularly, when the respective open holes are formed into a through-hole, the presence of the wire 30 can be confined through the holes more easily and reliably.

The wire 30 is formed into an elongated cylindrical shape in a manner such that a conductive core 32 thereof is covered with an insulating covering member 31. The wire 30 is inserted into the insertion hole 20*a* in a state where part of the covering member 31 on the tip side of the wire 30 is removed so that the core 32 is exposed to the outside (refer to FIG. 8). Here, the core 32 of the wire 30 in the present embodiment is composed of a solid wire (single-core wire) made of a single copper wire (4) 0.5).

A tip portion 32*a* of the core 32 inserted into the insertion hole 20*a* is flattened and formed into a flattened portion 32*b* having a plate shape while being inserted in the locking portion 20*b*.

The locking portion 20*b* penetrates through the plug housing 20 from one side to the other side in the Z direction. Therefore, the tip portion 32*a* of the core 32 can be flattened in such a manner as to insert a pressing portion 91 of a jig 90 for flattening from both sides in the Z direction (in the direction of arrow "a" in FIG. 9(*a*)).

In the present embodiment, two jigs 90 for flattening are used to press the tip portion 32*a* of the core 32 several times (two times in the present embodiment) while shifting the tip portions 32*a* in the X direction so as to form the flattened portion 32*b* with a plate shape.

As described above, the flattened portion 32*b* is formed in the state where the wire 30 is inserted into the plug housing 20, so as to form a wired housing 40 in which the wire 30 is attached to the plug housing 20.

More particularly, the wired housing 40 is formed by the following process.

First, the wire 30 is inserted into the housing portion 24 of the plug housing 20, and the tip portion 32 of the wire 30 is exposed to the outside through the through-hole (the locking portion 20*b*, the opening 22*b* and the through hole 27*a*) penetrating the plug housing 20 from one side to the other side in the Z direction.

Next, one of the pressing portions 91 formed on the jigs 90 is inserted into the through hole (the locking portion 20*b*, the opening 22*b* and the through hole 27*a*) from one side in the Z direction, and the other pressing portion 91 of the jigs 90 is inserted into the through hole from the other side. The tip portion 32*a* of the wire 30 is then flattened by the respective pressing portions 91, 91 so as to be provided with a first flattened portion 32*c*. Thus, the through hole (the locking portion 20*b*, the opening 22*b* and the through hole 27*a*) penetrating in the Z direction enables the pressing portions 91 of the jigs 90 to be inserted from both side so as to flatten the tip portion 32*a* of the wire 30 more stably.

Thereafter, the wire 30 is shifted toward the insertion side in the X direction so that a part of the tip portion 32*a* of the wire 30 not flattened is exposed to the outside through the through-hole. The part of the tip portion 32*a* of the wire 30 not flattened is then flattened with the jigs 90 so as to be provided with a second flattened portion 32*d*.

Accordingly, the flattened portion 32*b* is formed at the tip portion 32*a* of the wire 30. The flattened portion 32*b* thus formed comes into contact (is locked) with a wall surface 23*f* of the lateral wall portion 23*b* when the wire 30 inserted in the plug housing 20 is shifted in the removing direction (on the removing side in the inserting-removing direction). As a result, the wire 30 can be attached to the plug housing 20 while being prevented from coming off the plug housing 20.

The wired housing 40 is thus formed.

Here, the process in which the wire 30 is shifted in the X direction, and the part of the tip portion 32*a* of the wire 30 not flattened is exposed to the outside via the through-hole so as to be flattened with the jigs 90, may be repeated several times (two times or more). That is, the process of flattening the wire 30 may be repeated three times or more. Alternately, the tip portion 32*a* of the wire 30 may be flattened with the jigs 90 only once to be provided with the flattened portion 32*b*. In such a case, as described below, a side surface 32*f* of the flattened portion 32*b* is preferably held between both side surfaces 21*e*, 21*e* of a notch 21*c*.

In the present embodiment, the notch 21*c* is formed at the longitudinal-direction-side circumferential wall 21*b* on the opposite side of the upper wall 22. A flat surface 32*e* of the flattened portion 32*b* comes into contact with a deep surface (the surface toward the upper wall 22) 21*d* of the notch 21*c*. This configuration prevents the wire 30 from rotating at the time of, for example, being attached to the contact 50. The side surface 32*f* of the flattened portion 32*b* is held between the side surfaces 21*e*, 21*e* of the notch 21*c* so as to prevent the wire 30 from rotating more reliably.

As described above, the plug housing 20 includes the locking portion 20*b* serving as the holding portion for holding the flattened portion 32*b* of the wire 30 and also serving as a flattened-portion locking portion for locking the flattened portion 32*b*. In the present embodiment, the wall surface 23*f* of the lateral wall portion 23*b* and the deep surface (the surface toward the upper wall 22) 21*d* of the notch 21*c* also serve as the flattened-portion locking portion.

Figure 14:
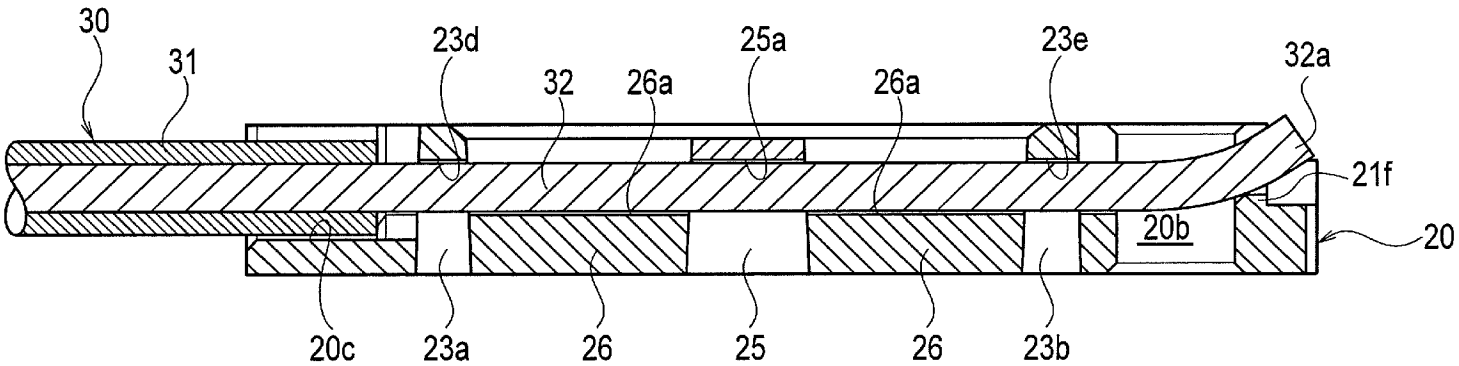
FIG. 14 is a cross-sectional view schematically showing a state where the wire according to the first embodiment of the present invention is temporarily held by a temporarily holding portion of the housing.

In the present embodiment, as shown in FIG. 14, the plug housing 20 further includes a temporarily holding portion for temporarily holding the wire 30 housed in the housing portion 24.

More particularly, the temporarily holding portion is a projection 21*f* projecting from the mount surface 26*a* of the mount portion 26 in the Z direction. Once the wire 30 comes into contact with the projection 21*f*, the wire 30 is bent in the Z direction. Thus, the wire 30 bent in the Z direction due to the projection 21*f* is temporarily held in the plug housing 20.

Figure 15:
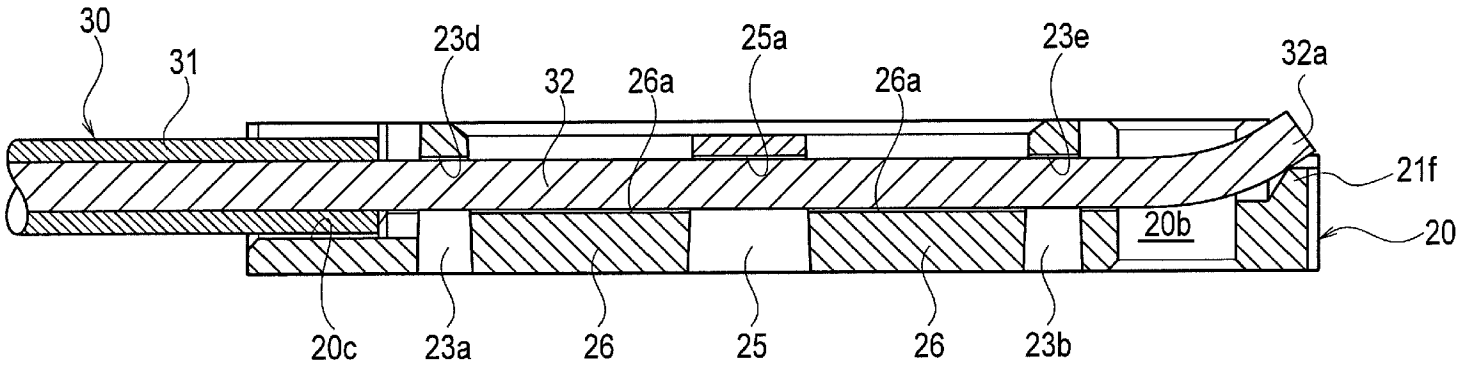
FIG. 15 is a cross-sectional view showing a modified example of the temporarily holding state.

Although FIG. 14 illustrates the projection 21*f* formed on the inner side of the longitudinal-direction-side circumferential wall 21*b* in the X direction (on the removing side in the inserting-removing direction of the wire 30), the projection 21*f* serving as the temporarily holding portion may be formed on the outer side of the longitudinal-direction-side circumferential wall 21*b* in the X direction (on the inserting side in the inserting-removing direction of the wire 30), as shown in FIG. 15. The projection 21*f* is preferably provided with an inclined surface on the inner side thereof in the X direction (on the removing side in the inserting-removing direction of the wire 30), as shown in FIG. 14 and FIG. 15. The wire 30 is guided by the inclined surface so as to be bent in the Z direction easily when the wire 30 is inserted.

The contact 50 is formed in a manner such that a metal plate is subjected to metal processing (pressing) and includes a bottom wall 51 formed substantially into a rectangular shape elongated in the X direction. In the present embodiment, the bottom wall 51 is formed at both edge portions of the contact 50 in the X direction, and a connecting portion 52 is formed in the middle of the contact 50 in the X direction to connect the both bottom walls 51 to each other. In the present embodiment, the connecting portion 52 protrudes outward substantially into a trapezoid on both sides in the Y direction so as to have a wider width than the bottom walls 51. The connecting portion 52 is thus formed substantially into an octagonal shape in the plan view. Note that the connecting portion 52 may be formed into various shapes and may be a polygonal shape such as a rectangular shape or a circular shape.

The bottom walls 51 or the connecting portion 52 can serve as an installation member connected (installed) to the board 60. The bottom walls 51 can serve as an installation member connected (installed) to the board 60, or the connecting portion 52 can serve as an installation member connected (installed) to the board 60. Both the bottom walls 51 and the connecting portion 52 can serve as an installation member connected (installed) to the board 60.

The bottom walls 51 and the connecting portion 52 are formed into a plate shape, and one surface 51*a* of the respective bottom walls 51 and one surface 52*a* of the connecting portion 52 serve as a movement regulation member 50*c* described below. When the bottom walls 51 serve as an installation member, the respective other surfaces 51*b* are installed to the board 60. When the connecting portion 52 serves as an installation member, the other surface 52*b* is installed to the board 60.

Further, in the present embodiment, the one surface 52*a* of the connecting portion 52 includes an adhesion surface 52*c* to which installation equipment (not shown in the drawing) such as a robot arm adheres. The adhesion surface 52 also serves as the movement regulation member 50*c* described below.

The contact 50 thus includes the installation member (at least one of bottom walls 51 and the connecting portion 52) installed and connected to the board (member to be connected) 60. The movement regulation member 50*c* is formed to include the installation member.

The installation member includes the movement regulation member 50*c* on one side and an installation surface on the other side installed to the board (the member to be connected) 60.

The movement regulation member 50*c* is provided with the adhesion surface 52*c* on one surface, which also serves as the movement regulation member 50*c*.

Accordingly, the adhesion surface 52*c* can be used effectively to have another function. In addition, since an additional member is not required for composing the movement regulation member 50*c*, a decrease in size of the contact 50 can be achieved. Further, the other surfaces 51*b* of the bottom walls 51 or the other surface 52*b* of the connecting portion 52 serve as an installation surface so as to eliminate a lead for installation.

The contact 50 includes contact portions 53 coming into contact with and electrically connected to the core 32 of the wire 30, and lock portions 54 for locking the wire 30 in a state where the wire 30 is in contact with the contact portions 53. Here, the state of locking the wire 30 includes a state of restricting a movement of the wire 30 on the contact 50 in the state where the wire 30 is in contact with the contact portions 53. In other words, the state of locking includes not only a state of completely locking the wire 30 but also a state of generating resistance in the moving direction of the wire 30 so that the wire 30 is not easily moved. Therefore, in the present embodiment, the lock portions 54 correspond to a movement restriction member.

The contact 50 further includes the movement regulation member 50*c* for regulating a movement of the wire 30 in the Z direction in the state where the wire 30 is in contact with the contact portion 53. As described above, not only the connecting portion 52 but also the bottom walls 51 serve as the movement regulation member 50*c*. Therefore, the contact 50 including the movement regulation member 50*c* can eliminate an additional member for preventing the contact state between the wire 30 and the contact portions 53 from being released because of a movement of the wire 30 on the contact 50 in the Z direction. Thus, the wire 30 can be prevented, only by use of the contact 50, from coming off the contact 50 caused by excessive insertion of the wire 30.

In the present embodiment, the contact 50 includes the two (plural) contact portions 53 formed on the outer side of the respective bottom walls 51 in the X direction. Each of the contact portions 53 includes outer pieces 53*a* extending upward on both sides of each bottom wall 51 in the Y direction, and elastically deformable inner pieces (contact pieces) 53*b* integrated with the outer pieces 53*a*. The respective tips of the inner pieces 53*b* are provided with holding pieces (contact pieces) 53*c* for holding the core 32 of the wire 30. The holding pieces 53*c* on both sides hold a wall surface 32*g* of the core 32 of the wire 30.

The respective contact portions 53 of the present embodiment thus include the outer pieces 53*a* as first side wall portions located on both sides thereof in the Y direction (the width direction) when viewed in the X direction, and the two holding pieces (at least one second side wall portion) 53*c* located between the outer pieces 53*a*.

The two holding pieces 53*c* (at least one second side wall portion) are formed in an elastically deformable manner in the Y direction. The second side wall portions of the present embodiment thus include the second side wall portions elastically deformable in the Y direction (width direction).

The wire 30 is held on both sides in the Y direction (at least on one side in the Y direction) by the holding pieces 53*c* elastically deformable in the Y direction.

Therefore, force applied to the wire 30 in the Y direction can be absorbed by elastic deformation of the holding pieces 53*c*. Accordingly, force applied to the outer pieces (first wall portions) 53*a* of the contact 50 can be prevented when the wire 30 is pulled in the Y direction so as to prevent the installation of the contact 50 on the board 60 from being released. In addition, removal of the wire 30 from the contact 50 can also be prevented.

Alternatively, only one of the holding pieces 53*c* may be formed in an elastically deformable manner in the Y direction (the width direction) so that the wire 30 is held at least on one side in the Y direction by the holding piece 53*c* elastically deformable in the Y direction.

In the present embodiment, the holding pieces (the contact pieces) 53*c* are formed separately from locking pieces (lock pieces 54*a*) described below formed in the movement restriction member. The holding pieces (the contact pieces) 53*c* and the locking pieces (the lock pieces 54*a*) are aligned in the X direction. Since the holding pieces (the contact pieces) 53*c* and the locking pieces (the lock pieces 54*a*) are formed separately, the respective members can individually function to come into contact with the wire 30 and function to lock the wire 30, so as to determine an appropriate shape for each member. Accordingly, the respective members can exhibit their own functions reliably.

Figure 16:
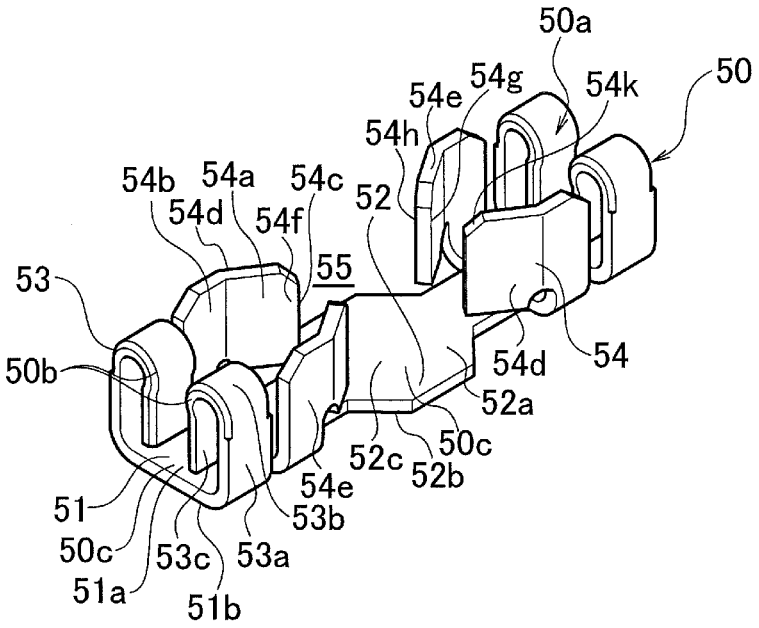
FIG. 16 is a view showing a contact according to the first embodiment of the present invention, wherein FIG. 16(*a*) is a perspective view showing a state where a bottom wall of the contact is located on the lower side, and FIG. 16(*b*) is a perspective view showing a state where the bottom wall of the contact is located on the upper side.
Figure 16:
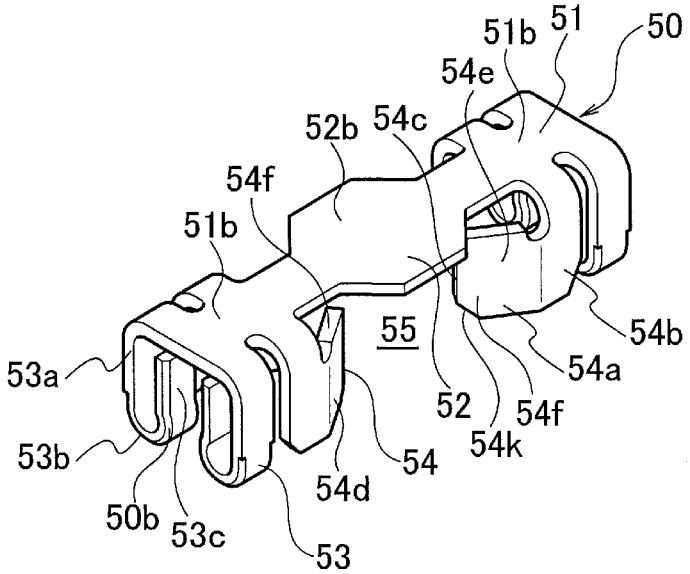

The contact portions 53 are formed to be open on the upper side (on the side opposite to the opening 24*a*) as shown in FIG. 16(*a*). In the present embodiment, when the wire 30 is moved in the direction perpendicular to the axial direction (the extending direction) of the wire 30 and inserted into the contact portions 53, the core 32 of the wire 30 comes into contact with the contact portions 53 so as to be electrically connected to each other. More particularly, the core 32 of the wire 30 is inserted into the opening of the respective contact portions 53 formed on the insertion side of the wire 30 (on the upper side in FIG. 16(*a*)), and the wall surface 32*g* of the core 32 of the wire 30 is held by the holding pieces 53*c* on both sides so that the core 32 of the wire 30 comes into contact with the contact portions 53 to be electrically connected to each other.

Thus, in the present embodiment, when the wire 30 not in contact with the contact portions 53 is moved to one side in the Z direction (in the direction from the opening to the bottom walls 51), the wire 30 comes into contact with the contact portions 53.

The contact 50 further includes drop-off prevention portions 50*b* for covering at least part of the wire 30 on the other side in the Z direction in the state where the wire 30 is in contact with the contact portions 53 (on the opening side in the state where the wire 30 is in contact with the contact portions 53).

In the present embodiment, the drop-off prevention portions 50*b* are formed in the contact pieces (the inner pieces 53*b*) of the contact portions 53.

More particularly, the respective inner pieces (the contact pieces) 53*b* protrude inward in the Y direction in a manner such that the gap between the respective inner pieces (the contact pieces) 53*b* located on both sides in the Y direction is smaller than the diameter of the wire 30. In the present embodiment, the respective inner pieces (the contact pieces) 53*b* are curved greatly so as to protrude inward in the Y direction.

Accordingly, the wire 30 can be prevented from moving in the direction opposite to the direction in which the wire 30 is attached (opposite to the direction in which the wire 30 is inserted into the contact 50) and prevented from coming off the contact 50. In addition, since the wire 30 is inserted into the contact 50 by climbing over the drop-off prevention portions 50*b* protruding inward in the Y direction, a feeling of clicking can be ensured at the time of insertion of the wire 30 so that the connection of the wire 30 can be confirmed easily.

The inner pieces (the contact pieces) 53*b* are each formed into an arc shape protruding toward the other side in the Z direction (toward the opening 50*a*: toward the side from which the wire 30 is inserted) when viewed in the X direction. Therefore, the contact portions 53 are provided, toward the other side in the Z direction (toward the opening 50*a*: toward the side from which the wire 30 is inserted) when viewed in the X direction, with openings defined by the inner pieces of the inner pieces (the contact pieces) 53*b* located on both sides in the Y direction and each having a width increasing toward the opening 50*a*. The openings provided in the respective contact portions 53 and each having a width increasing toward the opening 50*a*, facilitates the insertion of the wire 30 into the contact 50.

The contact 50 also includes the two (plural) lock portions 54 formed on the inner side of the respective contact portions 53 in the X direction (on the inner sides of the respective bottom walls 51 in the X direction). The two lock portions 54 are provided symmetrically with the connecting portion 52 interposed therebetween when viewed in the Z direction.

The respective lock portions 54 include the lock pieces 54*a* for locking the wire 30 in the state where the wire 30 is in contact with the contact pieces 53. The lock pieces 54*a* are formed in a manner such that the metal plate used for the formation of the contact 50 is cut and raised upward. One end 54*b* of the respective lock pieces 54*a* is connected to the bottom wall portion 51*b* serving as the movement regulation member, and the other end 54*c* extends toward the wire 30 in contact with the contact portions 53. More particularly, the other end 54*c* is bent inward in the Y direction from the one end 54*b* so as to form each lock piece 54*a*. Thus, the lock pieces 54*a* are elastically deformable in the Y direction (the width direction).

Further, the bent portion at the boundary between the one end 54*b* and the other end 54*c* is provided with a notched recess curved into an arc toward the movement regulation member 50*c*. Such a recess increases the length in the Z direction at a portion where the wire 30 is locked (an edge 54*g* in the present embodiment) in the respective lock pieces 54*a*, compared with the length in the Z direction at the bent portion. Accordingly, a sufficient region in contact with the wire 30 (the length in the Z direction) can be ensured, and the other end 54*c* can be elastically deformed more easily.

As described above, the respective lock portions 54 include the locking pieces for locking the wire 30 being in contact with the contact pieces 53, and the locking pieces include the lock pieces 54*a* for holding the wire 30 being in contact with the contact pieces 53. Since the lock pieces 54*a* are elastically deformable in the Y direction (the width direction) as described above, the wire 30 can be inserted into the contact 50 in the Z direction due to the elastic deformation. Further, the wire 30 is pressed by elastic restoring force of the lock pieces 54*a* in the state where the wire 30 is inserted into the contact 50. Thus, the lock pieces 54*a* elastically deformable in the Y direction (the width direction) formed in the lock portions 54 can facilitate the insertion of the wire 30 into the contact 50 and also lock the inserted wire 30 more reliably (restrict a movement of the wire 30 in the X direction).

The configuration of the locking pieces is not limited to the lock pieces and may be any kinds of configurations. For example, the locking pieces may pierce the wire so as to lock the wire, may engage with the wire or may increase friction at the contact portions between the locking pieces and the wire. These means may be combined together.

The lock portions 54 each include a first lock piece (a first locking piece) 54*d* and a second lock piece (a second locking piece) 54*e* facing each other with the wire 30 interposed therebetween when viewed in the X direction.

Figure 17:
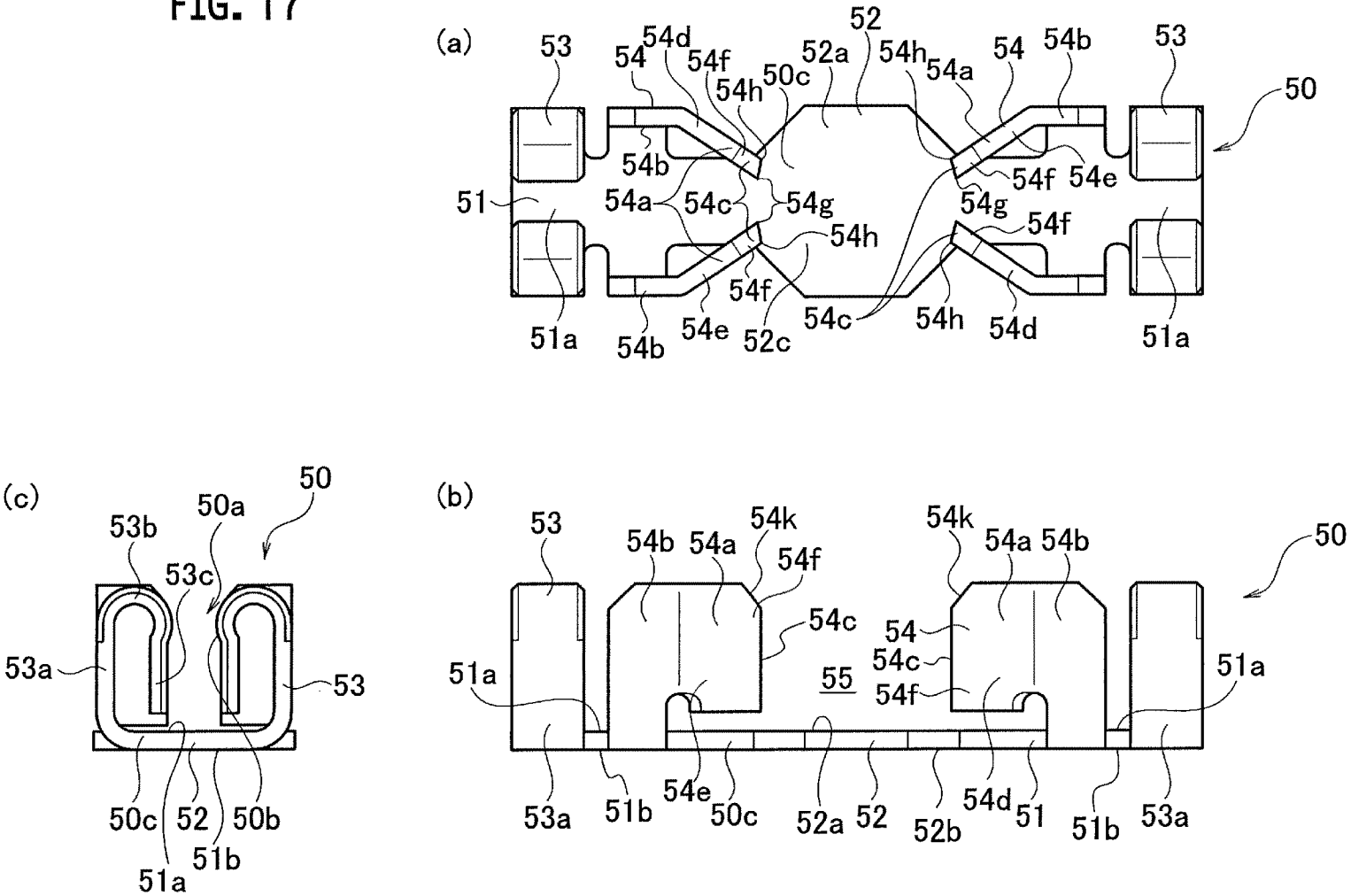
FIG. 17 is a view showing the contact according to the first embodiment of the present invention, wherein FIG. 17(*a*) is a plan view, FIG. 17(*b*) is a side view, and FIG. 17(*c*) is a front view.

As shown in FIG. 17, the movement regulation member 50*c* is located between a locking portion of the first lock piece 54*d* (the edge 54*g* in the present embodiment) and a locking portion of the second lock piece 54*e* (the edge 54*g* in the present embodiment), when viewed in the Z direction.

In other words, the width of the movement regulation member 50*c* in the Y direction at a portion corresponding to the locking portions (the edges 54*g*) is greater than the distance in the Y direction between the locking portion of the first lock piece 54*d* and the locking portion of the second lock piece 54*e* in each lock piece 54.

Thus, the movement of the wire 30 in the insertion direction at the portions locked by the lock portions 54 is regulated by the movement regulation member so that the locked state of the wire 30 locked by the lock portions 54 can be prevented from being released more reliably.

In the present embodiment, the lock pieces 54*a* extend in such a manner as to make an acute angle with the wire 30 being in contact with the contact portions 53 (acute angle to the wire extending direction) when viewed in the Z direction. In other words, the distance between the respective lock pieces 54*a* and the wire 30 gradually decreases from one end 54*b* to the other end 54*c*, when viewed in the Z direction.

Since the lock portions 54 each include the first lock piece 43*d* and the second lock piece 54*e* as the lock pieces 54*a*, the respective sets of the lock pieces 54*a* are tapered having a width gradually decreasing toward a tip 54*f* (toward the inside in the X direction) in the plan view.

The respective lock portions 54 are also open on the upper side (on the side opposite to the opening 24*a*) as shown in FIG. 16(*a*). The wire 30 is moved in the direction perpendicular to the axial direction (the extending direction) of the wire 30 so as to be inserted between the first lock pieces 54*d* and the second lock pieces 54*e* from the respective openings.

The distance in the Y direction between the locking portion of the first lock piece 54*d* and the locking portion of the second lock piece 54*e* in each lock portion 54 is preferably smaller than the diameter of the wire 30 (the core 32) held between the lock pieces 54*a*. The first lock piece 54*d* and the second lock piece 54*e* are elastically deformed outward in the Y direction when the wire 30 is inserted into the contact 50. The first lock piece 54*d* and the second lock piece 54*e* then press the wire 30 by elastic restoring force applied inward in the Y direction in the state where the wire 30 is inserted into the contact 50. This configuration facilitates the insertion of the wire 30 into the contact 50 and also locks the inserted wire 30 more reliably (restricts a movement of the wire 30 in the X direction).

In the present embodiment, the lock pieces 54*a* of the two lock portions 54 extend in opposite directions.

The explanation thereof is made in more detail with reference to FIG. 16(*a*). The lock pieces 54*a* in one lock portion 54 (the lock portion on the lower-left side) extend from the one ends 54*b* to the other ends 54*c* in the upper-right direction, and the lock pieces 54*a* in the other lock portion 54 (the lock portion on the upper-right side) extend from the one ends 54*b* to the other ends 54*c* in the lower-left direction.

Thus, the plural lock portions (the movement restriction member) 54 according to the present embodiment include at least one lock portion (the movement restriction member) 54 having the lock pieces (the locking pieces) 54*a* in which the other ends 54*c* are located on one side in the X direction while the one ends 54*b* are located on the other side, and at least one lock portion (the movement restriction member) 54 having the lock pieces (the locking pieces) 54*a* in which the other ends 54*c* are located on the other side in the X direction while the one ends 54*b* are located on the one side.

Therefore, a movement of the wire 30 to both sides in the X direction can be restricted more reliably. More particularly, when the wire 30 being in contact with (inserted in) the contact 50 is intended to be shifted to the upper-right side in FIG. 16(*a*), the wire 30 is stuck mainly at the lock pieces (the locking pieces) 54*a* of the lock portion 54 located on the upper-right side so as to be prevented from moving to the upper-right side in FIG. 16(*a*). When the wire 30 is intended to be shifted to the lower-left side in FIG. 16(*b*), the wire 30 is stuck mainly at the lock pieces (the locking pieces) 54*a* of the lock portion 54 located on the lower-left side so as to be prevented from moving to the lower-left side in FIG. 16(*b*).

Further, the wall surface 32*g* of the core 32 is held by the tips 54*f* on both sides in the Y direction so that the wire 30 is locked.

In the present embodiment, the wire 30 is held in a state where the tips 54*f* of the lock pieces 54*a* bite the wall surface 32*g* of the core 32. More particularly, the wire 30 is held in the state where the tips 54*f* of the lock pieces 54*a* bite the wall surface 32*g* of the core 32 along the circumference thereof.

The tips 54*f* of the lock pieces 54*a* biting the wall surface 32*g* of the core 32 along the circumference thereof thus can lock and prevent the wire 30 from being shifted in the X direction (the axial direction of the wire 30) more reliably.

In the present embodiment, the contact 50 is formed in such a manner as to be subject to metal press processing. The other ends 54*c* of the lock pieces 54*a* include the edges 54*g* and edges 54*h*, in which the sharper edges 54*g* formed by the metal press processing in the punching direction are located toward the wire 30. As a result, the sharper edges 54*g* bite the wall surface 32*g* of the core 32 so as to lock the wire 30 more rigidly. In the present embodiment, the sharper edges obtained by the press processing serve as a member for biting the wall surface 32*g* of the core 32 (a member for locking the wire 30).

The tips 54*f* of the lock pieces 54*a* are provided with inclined portions 54*k* on the other side in the Z direction (toward the opening 50*a*: on the side where the wire 30 is inserted), and provided with an opening having a width increasing toward the opening 50*a* when viewed in the X direction and defined by the inclined portions 54*k* on both sides in the Y direction. The opening having a width increasing toward the opening 50*a* and formed at the respective lock portions 54 facilitates the insertion of the wire 30 into the contact 50.

As described above, according to the present embodiment, the guide portions for inserting the wire (the tapered openings each having a width increasing toward the opening 50*a*) are formed in the contact portions 53 on the other side in the Z direction (toward the opening 50*a*: on the side where the wire 30 is inserted) and in the lock portions 54 on the other side in the Z direction (toward the opening 50*a*: on the side where the wire 30 is inserted), so as to insert the wire 30 into the contact 50 more easily.

The locked state of the wire 30 with the lock pieces 54*a* can be ensured as follows.

First, the wire 30 is moved to the contact 50 in the direction perpendicular to the axial direction (the wire extending direction) and inserted between the respective holding pieces 53*c* and between the first lock pieces 54*d* and the second lock pieces 54*e*. The wall surface 32*g* of the core 32 of the wire 30 is then held by the holding pieces 53*c* and also held by the tips 54*f* of the lock pieces 54*a*. Once the wire 30 in the held state is pulled in the X direction (the axial direction of the wire 30), the tips 54*f* of the lock pieces 54*a* bite the wall surface 32*g* of the core 32. As a result, the wire 30 is locked with the lock pieces 54*a* so that a movement of the wire 30 in the X direction (the axial direction of the wire 30) is restricted.

As described above, the contact 50 in the present embodiment is provided with the opening 50*a* on the side where the wire 30 is inserted, and provided with the movement regulation member (the bottom walls 51 and the connecting portion 52) 50*c* on the side opposite to the insertion side of the wire 30.

Since the opening 50*a* of the contact 50 is entirely open to the side where the wire 30 is inserted, the wire 30 can be inserted into the contact 50 at any point along the wire 30 (the excluding both ends). The opening 50*a* is open in the direction vertical to one surface (one surface 52*a*) of the movement regulation member 50*c*. Here, the opening 50*a* is not necessarily open in the direction vertical to the one surface of the movement regulation member and may be open in the direction parallel to or lateral direction.

In the present embodiment, the contact 50 is formed to have a symmetrical configuration (point symmetry in the plan view). As a result, the installation direction or the engaging direction is not restricted so as to increase usability.

In addition, a space 55 is provided between the respective lock portions 54 located on both sides in the X direction, and the land portion 25 is housed in the space 55.

The connector configured as described above is assembled as follows.

Figure 8:
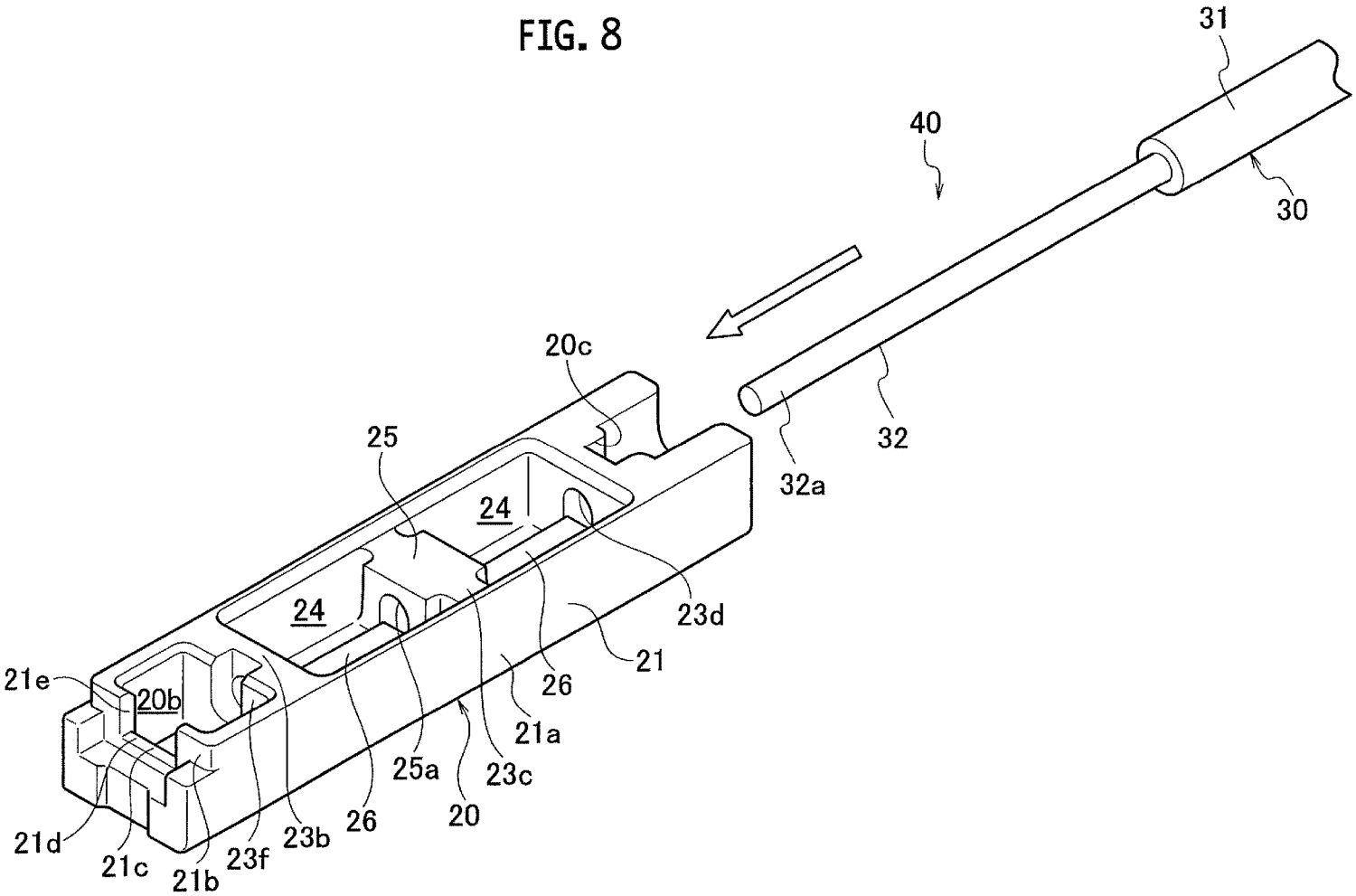
FIG. 8 is a perspective view showing a wire according to the first embodiment of the present invention before being inserted into the housing.
Figure 10:
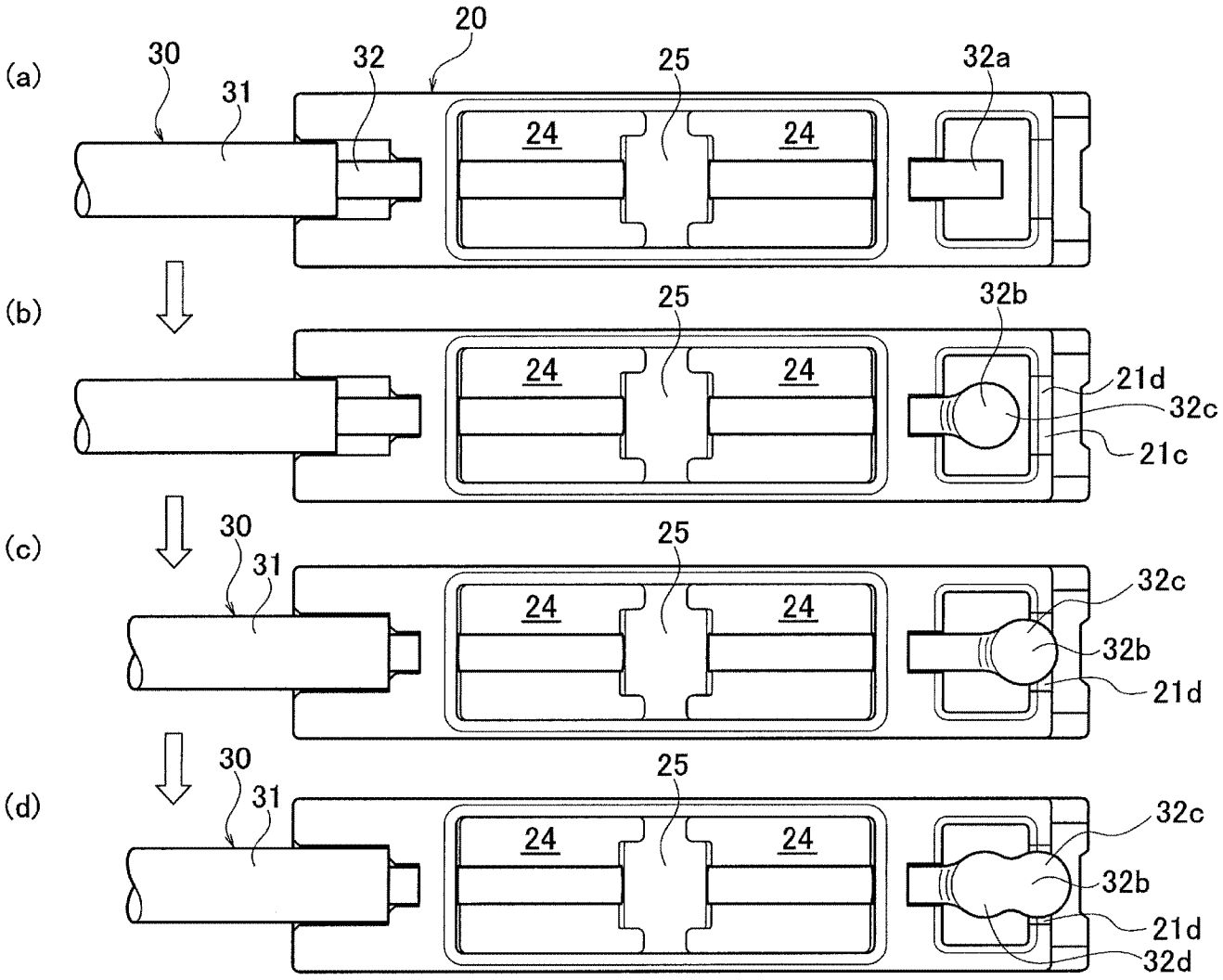
FIG. 10 is a bottom view for explaining a method of forming the flattened portion of the wire according to the first embodiment of the present invention, wherein FIG. 10(*a*) to FIG. 10(*d*) sequentially show the process of the method.
Figure 11:
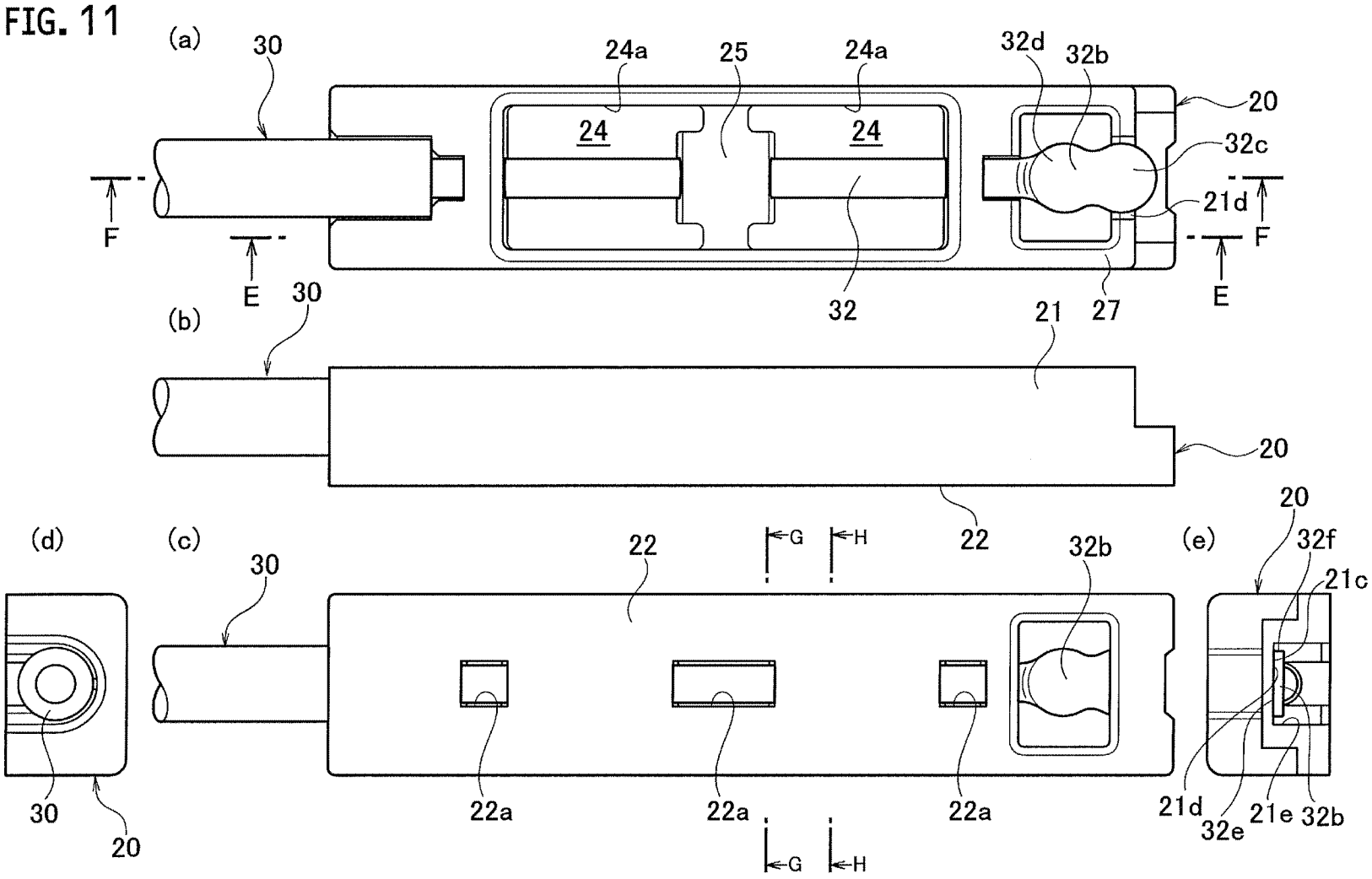
FIG. 11 is a view showing a wired housing according to the first embodiment of the present invention, wherein FIG. 11(*a*) is a bottom view, FIG. 11(*b*) is a side view, FIG. 11(*c*) is a plan view, FIG. 11(*d*) is a front view, and FIG. 11(*e*) is a rear view.
Figure 12:
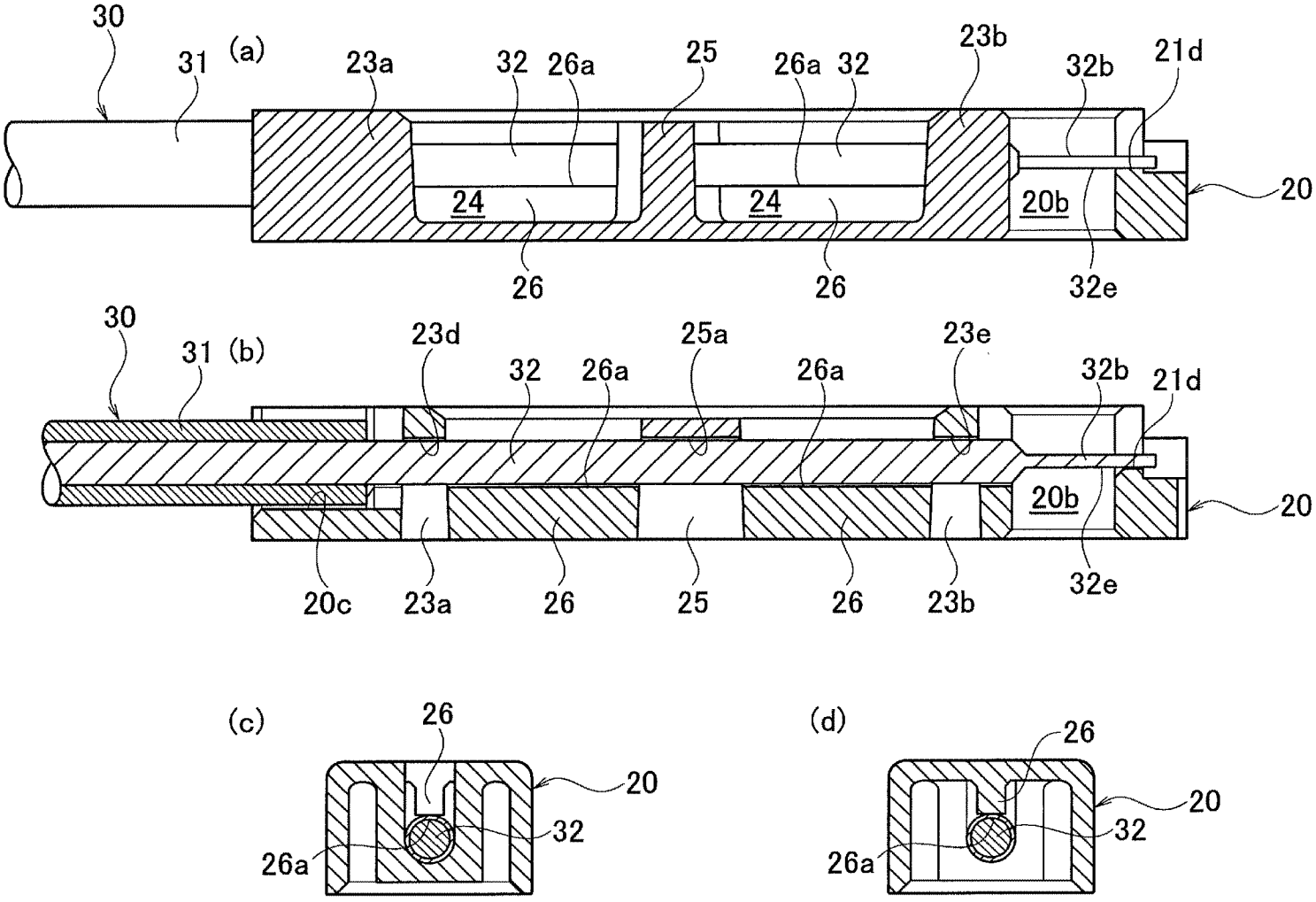
FIG. 12 is a view showing the wired housing according to the first embodiment of the present invention, wherein FIG. 12(*a*) is a cross-sectional view taken along line E-E in FIG. 11(*a*), FIG. 12(*b*) is cross-sectional view taken along line F-F in FIG. 11(*a*), FIG. 12(*c*) is a cross-sectional view taken along line G-G in FIG. 11(*c*), and FIG. 12(*d*) is a cross-sectional view taken along line H-H in FIG. 11(*c*).
Figure 13:
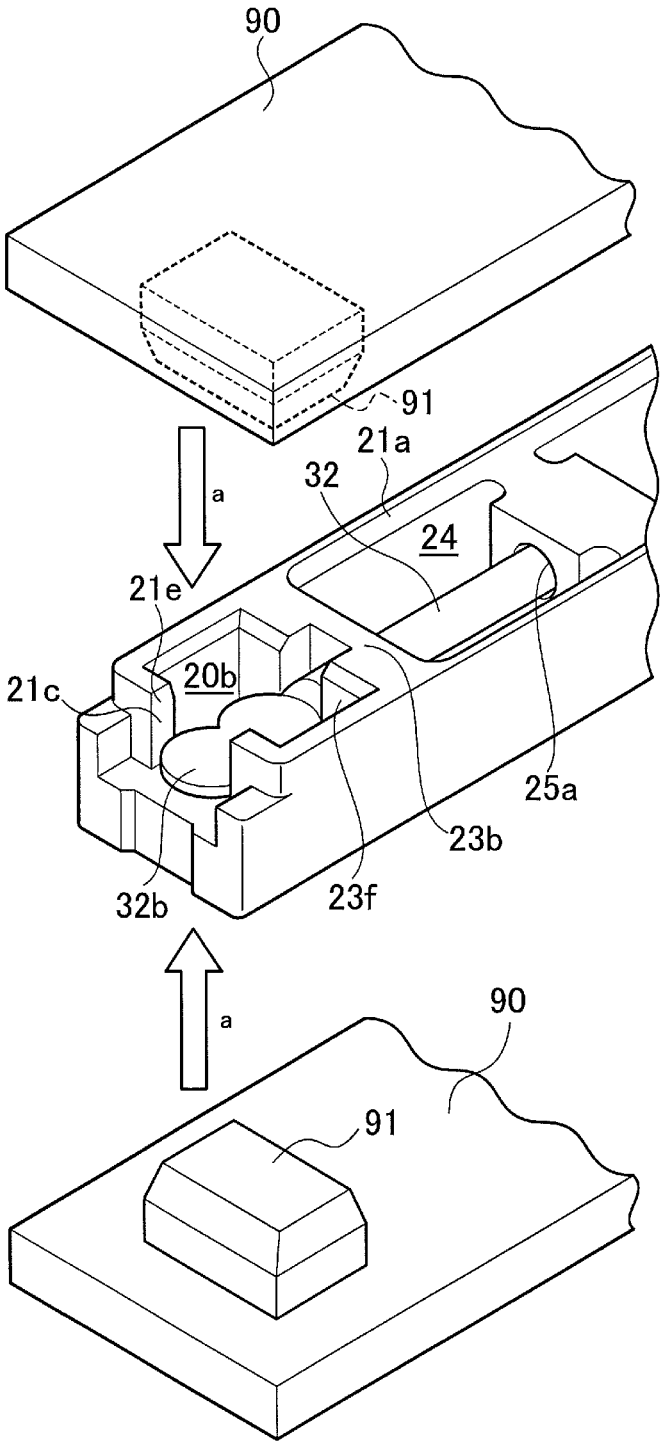
FIG. 13 is a perspective view schematically showing a state where the flattened portion of the wire according to the first embodiment of the present invention is formed by use of jigs.

First, the exposed core 32 of the wire 30 is inserted into the insertion hole 20*a* of the plug housing 20 so as to be set to the state shown in FIG. 10(*a*) from the state shown in FIG. 8.

Figure 9:
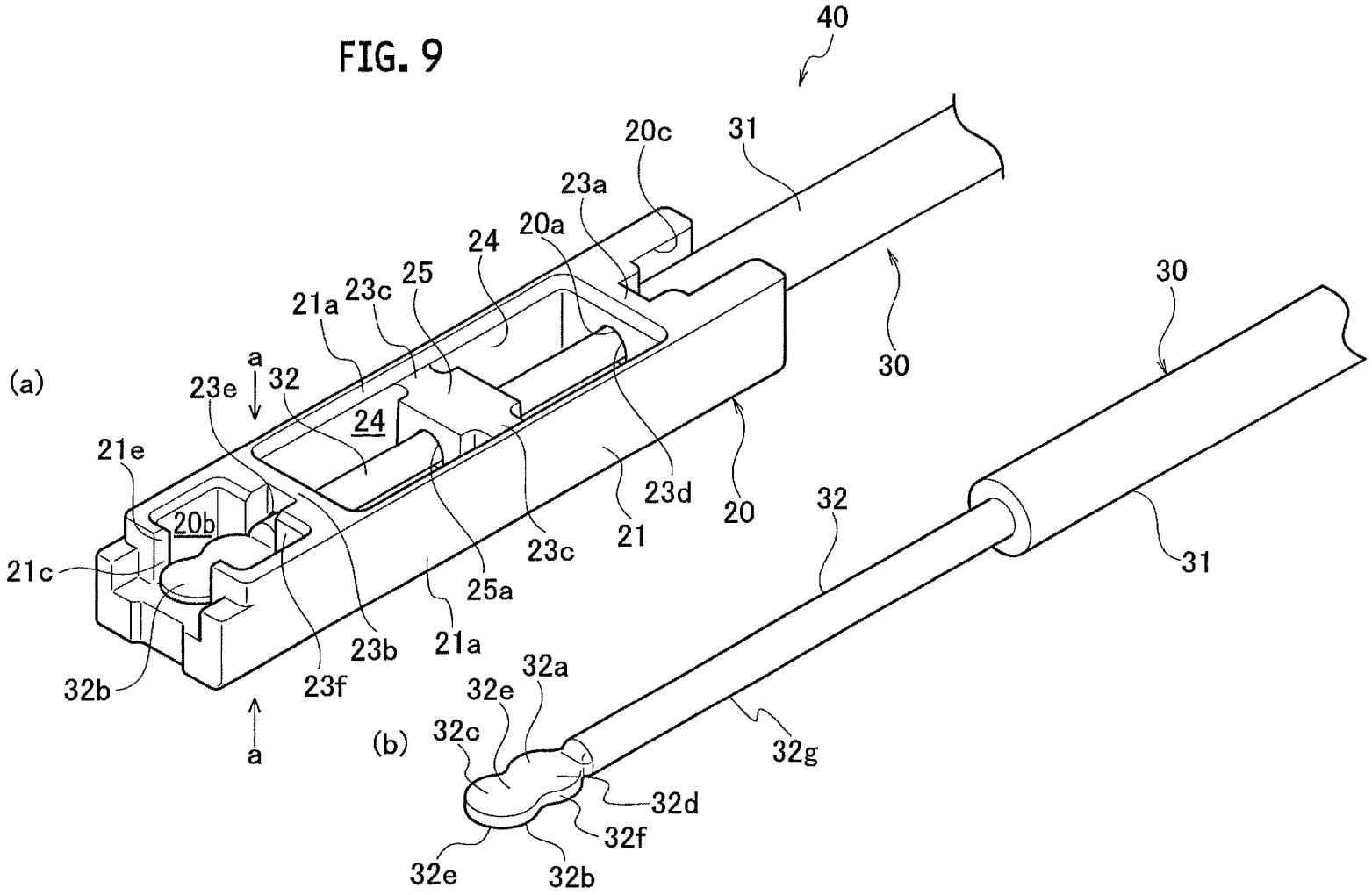
FIG. 9 is a view showing the wire provided with a flattened portion according to the first embodiment of the present invention, wherein FIG. 9(*a*) is a perspective view showing the wire being attached to the housing, and FIG. 9(*b*) is a perspective view showing only the wire.

Then, the jigs 90 for flattening are inserted from both sides in the Z direction (in the direction of arrow "a" in FIG. 9(*a*)) to flatten the tip portion 32*a* of the core 32 once so as to form the first flattened portion 32*c* (refer to FIG. 10(*b*)). Subsequently, the wire 30 is moved in the X direction so that the flattened surface of the first flattened portion 32 comes into contact with the deep surface (the surface toward the upper wall 22) 21*d* of the notch 21*c* (refer to FIG. 10(*c*)).

Thereafter, the pressing portions 91 of the jigs 90 for flattening are inserted from both sides in the Z direction (in the direction of arrow "a" in FIG. 9(*a*)) to flatten the tip portion 32*a* of the core 32 so as to form the second flattened portion 32*d* adjacent to the first flattened portion 32*c* (refer to FIG. 10(*d*)).

The flattened portion 32*b* including the first flattened portion 32*c* and the second flattened portion 32*d* is thus formed and comes into contact (is locked) with the lateral wall portion 23*b* when the wire 30 inserted into the plug housing 20 is moved in the removing direction, so as to prevent the wire 30 from coming off the plug housing 20. Further, the flat surface 32*e* of the flattened portion 32*b* comes into contact (is locked) with the deep surface (the surface toward the upper wall 22) 21*d* of the notch 21*c* so as to prevent the rotation of the wire 30.

Accordingly, the wired housing 40 is formed as shown in FIG. 9(*a*). The wire 30 is housed and fixed (attached) in the plug housing 20 without using the contact 50. The plug housing 20 holds the wire 30 housed in the housing portion 24 in a manner such that the core 32 is exposed to the outside via the opening 24 when viewed in the open direction of the opening 24*a* (the Z direction).

Subsequently, the installation member (at least one of the bottom walls 51 and the connecting portion 52) is connected to the board 60 by soldering or the like so as to install (connect) the contact 50 to the board 60.

Figure 18:
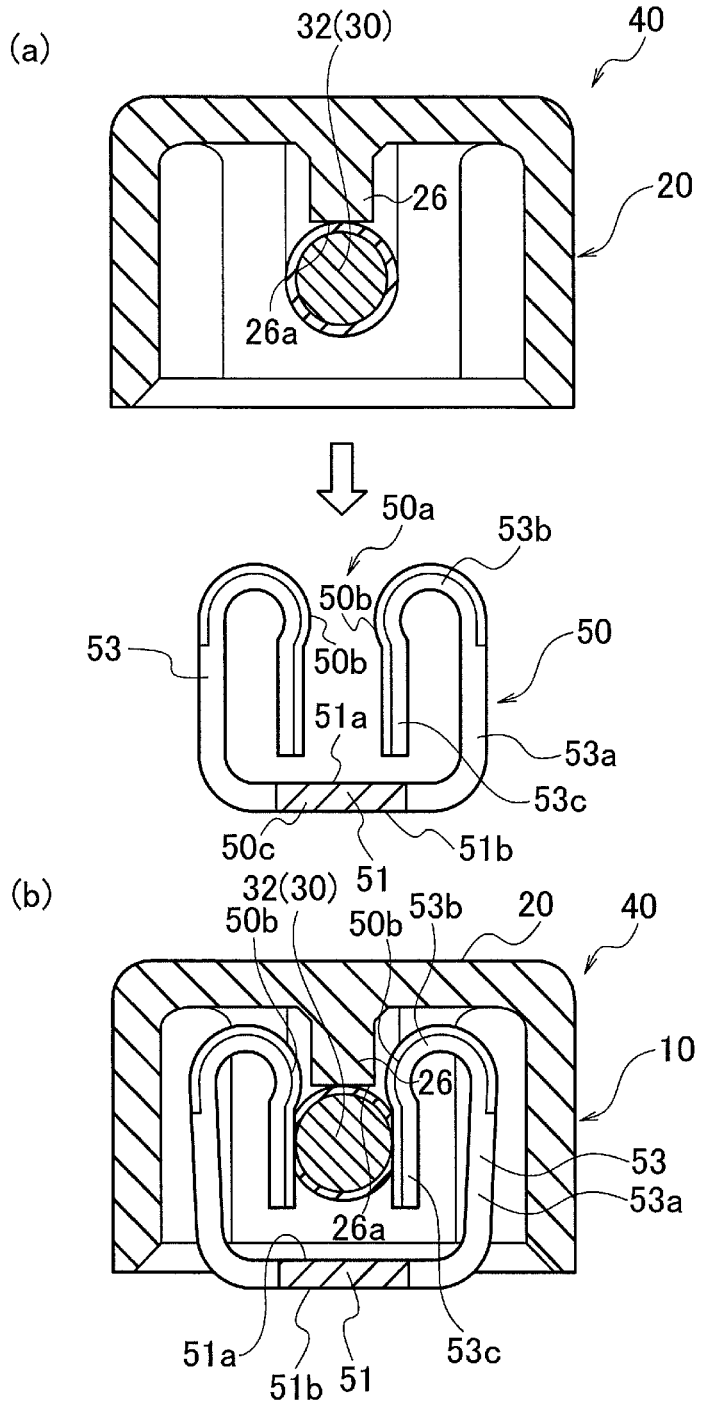
FIG. 18 is a view showing a process of attaching the wired housing to the contact according to the first embodiment of the present invention at a position corresponding to a contact portion, wherein FIG. 18(*a*) is a view showing the wired housing before being attached to the contact, and FIG. 18(*b*) is a view showing the wired housing after being attached to the contact.

In a state where the wired housing 40 and the contact 50 attached to the board 60 are placed in a manner such that the plug housing 20 on the opening 24 side is opposed to the contact portions 53 of the contact 50 on the opening side, the contact portions 53 are housed in the opening 24, and the exposed core 32 of the wire 30 is inserted into the contact portions 53 from the opening side and held by the holding pieces 53*c* (refer to FIG. 18). When the core 32 is inserted into the contact portions 53 from the opening side, the core 32 is pushed by the mount surfaces 26*a* of the mount portions 26 provided in the plug housing 20 on the side opposite to the contact portions 53 (on the upper side in FIG. 18) so as to prevent the core 32 from bending.

Figure 19:
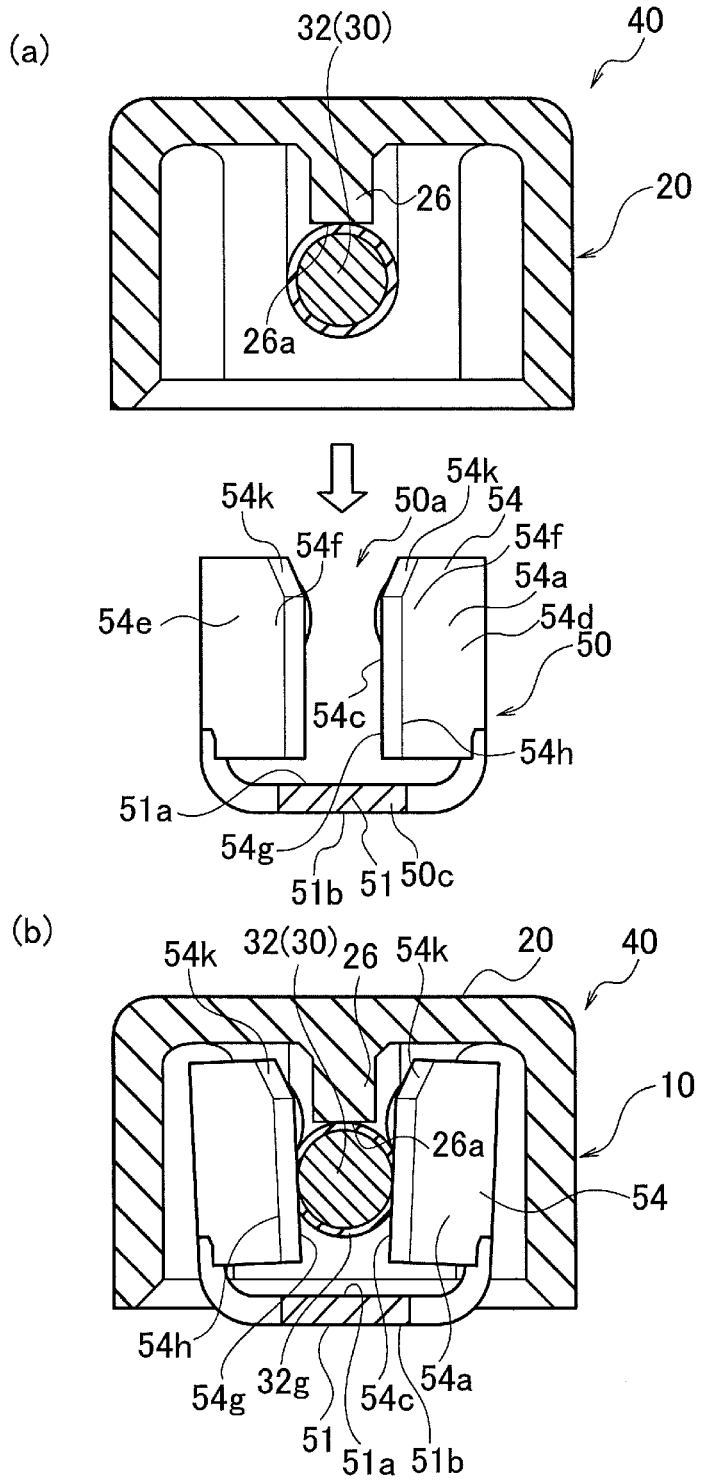
FIG. 19 is a view showing a process of attaching the wired housing to the contact according to the first embodiment of the present invention at a position corresponding to a lock portion, wherein FIG. 19(*a*) is a view showing the wired housing before being attached to the contact, and FIG. 19(*b*) is a view showing the wired housing after being attached to the contact.

The tips 54*f* of the lock pieces 54*a* of the lock portions 54 hold the wall surface 32*g* of the core 32 (refer to FIG. 19).

Once the wire 30 is pulled in the X direction (the axial direction of the wire 30), the tips 54*f* of the lock pieces 54*a* bite the wall surface 32*g* of the core 32 so that the wire 30 is locked with the lock pieces 54*a*. The land 25 is thus housed in the space 55.

Accordingly, the board 60 and the wire 30 are electrically connected to each other.

Next, application examples of the connector 10 according to the present embodiment are explained below. Note that the following explanations are examples, and the usage manner of the connector 10 is not limited to those examples described below.

Figure 20:
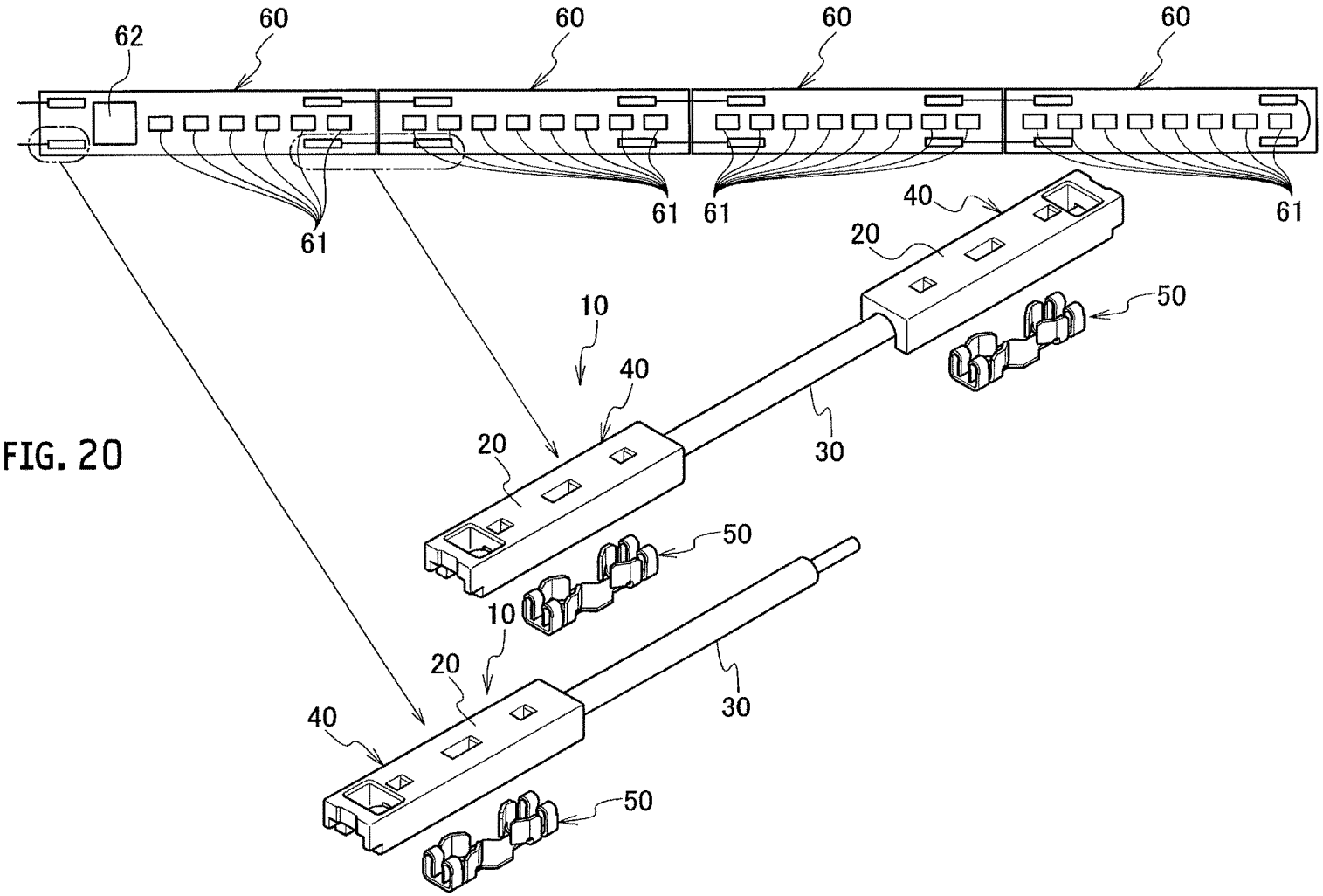
FIG. 20 is a view for schematically explaining a first used state of the connector according to the first embodiment of the present invention.

First, as shown in FIG. 20, the connector 10 according to the present embodiment can be used for electrically connecting boards (LED boards) 60 equipped with LEDs 61 to each other. FIG. 20 discloses a case where four boards 60 are connected in series. The leftmost board 60 in FIG. 20 is further equipped with a power supply circuit 62 in addition to the LEDs 61. The other three boards 60 are not equipped with the power supply circuit 62 but only equipped with the LEDs 61. The leftmost board 60 equipped with the power supply circuit 62 shown in FIG. 20 is provided with the board-to-wire connectors 10 attached on the left side of the board 60. Two contacts 50 are installed (connected) in parallel in the width direction (in the vertical direction in FIG. 20) on the left side of the leftmost board 60 in FIG. 20. The two contacts 50 are each housed in the housing portion 24 of the plug housing 20 fixed (attached) to one side of the wire 30 so as to come into contact with the wire 30. As a result, the wires 30 and the board 60 are electrically connected to each other. The other side of each wire 30 is electrically connected to an external power source (not shown in the drawing) so as to be supplied with power. The leftmost board 60 in FIG. 20 is further provided, on the right side, with two contacts 50 installed (connected) in parallel in the width direction (in the vertical direction in FIG. 20). The other boards 60 of the four boards 60 are also provided with two contacts 50 installed (connected) in parallel in the width direction (in the vertical direction in FIG. 20) toward the respective adjacent boards 60.

These portions in the boards 60 (the right side of the leftmost board 60 and the both right and left sides of each of the other three boards 60) are attached with the connectors 10 connected to the wires 30 on both sides (board-to-board type connectors 10).

More particularly, the contacts 50 installed on the right side of the leftmost board 60 in FIG. 20 and the contacts 50 installed on the left side of the second board 60 from the left in FIG. 20 are housed in the respective housing portions 24 of the plug housings 20 so as to come into contact with the wires 30. Thus, the board-to-board type connectors 10 are attached and extend across the leftmost board 60 in FIG. 20 and the second board 60 from the left in FIG. 20 in a manner such that the respective ends of the wires 30 fixed to the respective plug housings 20 are fitted (inserted) into the contacts 50 installed on the right side of the leftmost board 60 in FIG. 20 and the contacts 50 installed on the left side of the second board 60 from the left in FIG. 20. As a result, the leftmost board 60 in FIG. 20 and the second board 60 from the left in FIG. 20 are electrically connected to each other. The connection between the second board 60 from the left in FIG. 20 and the second board 60 from the right in FIG. 20, and the connection between the rightmost board 60 in FIG. 20 and the second board 60 from the right in FIG. 20 are performed in the same manner as described above. The two contacts 50 vertically arranged and installed on the right side of the rightmost board 60 in FIG. 20 are each housed in the housing portion 24 of the plug housing 20 so as to come into contact with the wire 30. The two contacts 50 vertically arranged and installed on the right side of the rightmost board 60 in FIG. 20 is thus short-circuited.

The use of such board-to-board type connectors 10 can eliminate the use of a jumper pin for short-circuiting, and eliminate the use of a board to which a jumper pin can be attached. In other words, short-circuiting can be executed by any of the boards 60 shown in FIG. 20 so as to increase versatility.

As described above, the board-to-wire type connectors 10 and the board-to-board type connectors 10 are used so as to electrically connect the respective boards 60 to each other and turn on the LEDs 61 installed on the boards 60. The use of the connectors 10 described above further facilitates the attachment of the wires 30 to the contacts 50. In addition, since the respective connectors 10 (the board-to-wire type connectors 10 and the board-to-board type connectors 10) are low-profile connectors, the attachment of the connectors 10 to the boards 60 can be achieved without blocking emission of the LEDs 61.

Figure 21:
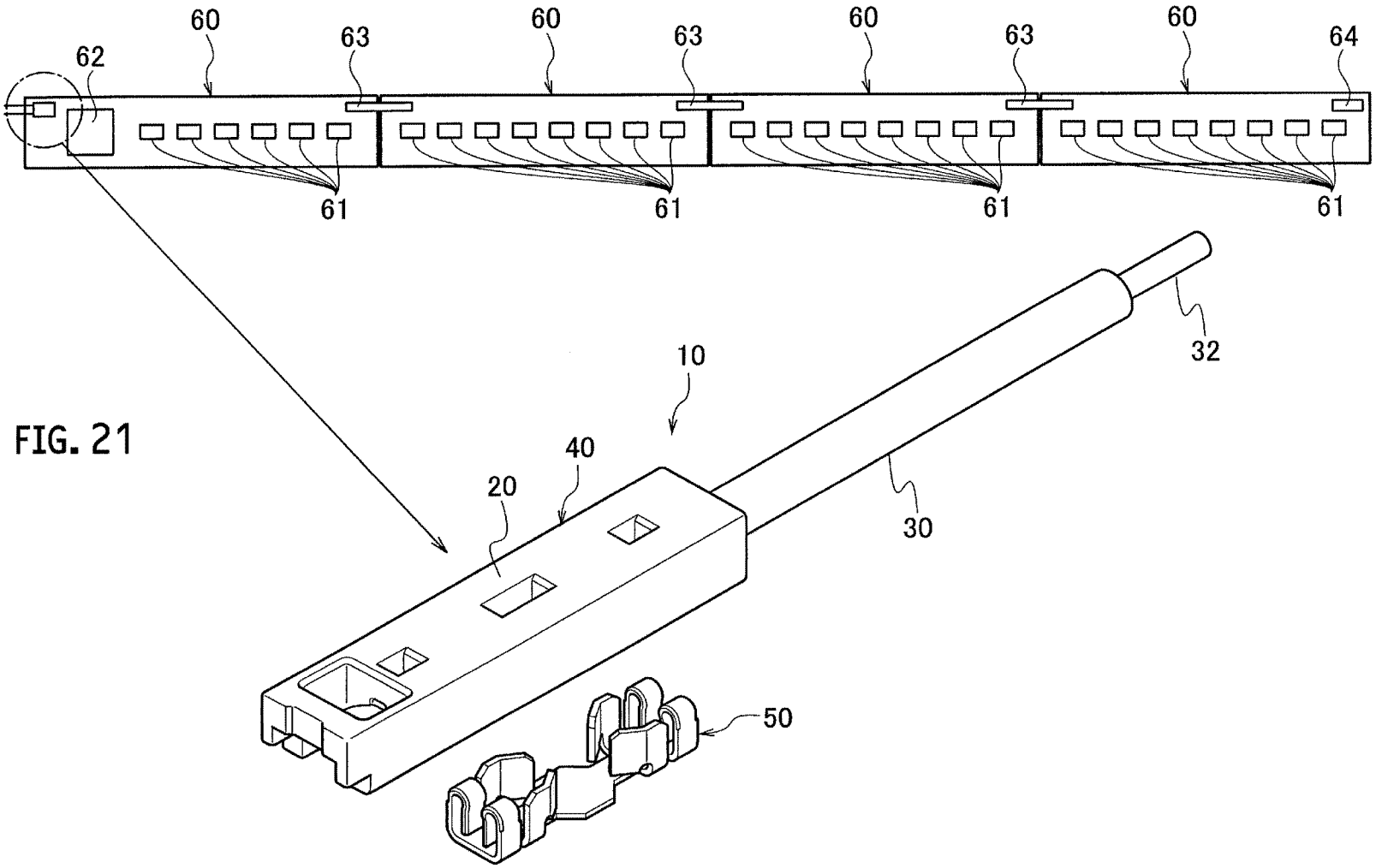
FIG. 21 is a view for schematically explaining a second used state of the connector according to the first embodiment of the present invention.

As shown in FIG. 21, the connector 10, floating connectors 63 and a short-circuit connector 64 may be used so as to connect the boards (LED boards) 60 with which the LEDs 61 are equipped. FIG. 21 also discloses the case where four boards 60 are connected in series. The leftmost board 60 in FIG. 21 is equipped with the power supply circuit 62 in addition to the LEDs 61. The other three boards 60 are not equipped with the power supply circuit 62 but only equipped with the LEDs 61. The leftmost board 60 equipped with the power supply circuit 62 shown in FIG. 21 is provided on the left side with the connector 10 according to the present embodiment that is electrically connected to an external power source (not shown in the drawing) so as to be supplied with power. The leftmost board 60 and the two boards 60, 60 located in the middle are electrically connected to each other via the floating connectors 63. The floating connectors 63 are used in order to absorb displacement and electrically connect the respective boards to each other.

The rightmost board 60 in FIG. 21 is provided with the short-circuit connector 64 on the right side thereof.

As described above, the connector 10, the floating connectors 63 and the short-circuit connector 64 are used so as to electrically connect the respective boards 60 to each other and turn on the LEDs 61 installed on the boards 60 as in the case described above.

When the respective connectors (the connector 10, the floating connectors 63 and the short-circuit connector 64) used are low-profile connectors, the attachment of the connectors to the boards 60 can be achieved without blocking emission of the LEDs 61.

Figure 22:
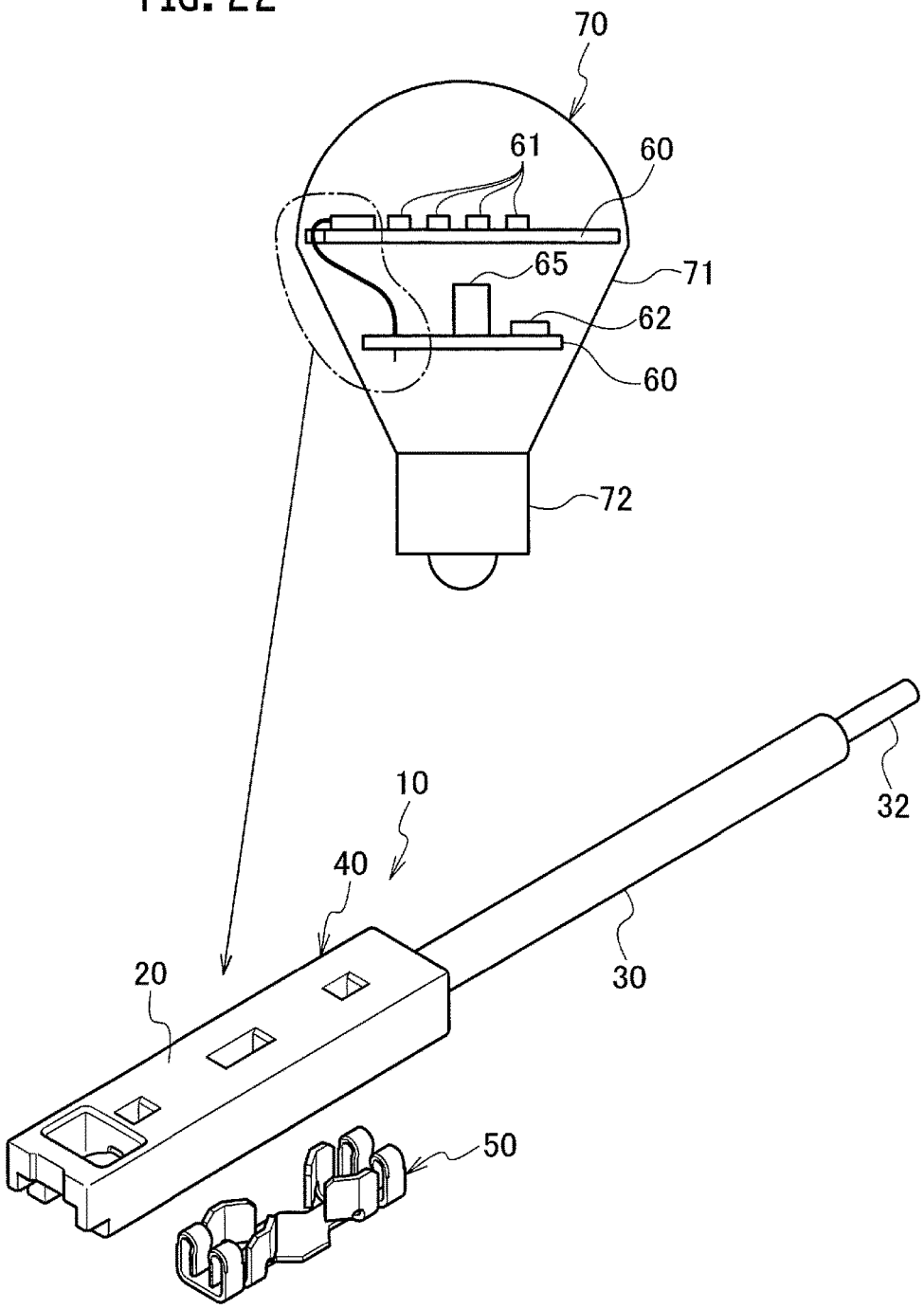
FIG. 22 is a view for schematically explaining a third used state of the connector according to the first embodiment of the present invention.

As shown in FIG. 22, the connector 10 according to the present embodiment may be used for an LED bulb 70. More particularly, the connector 10 can be used for electrically connecting the board (LED board) 60 placed in a glass spherical body 71 of the LED bulb 70 and equipped with the LEDs 61 to the board (power source board) 60 equipped with the power supply circuit 62.

In FIG. 22, the board (the LED board) 60 equipped with the LEDs 61 are substantially horizontally placed in the glass spherical body 71 in a manner such that the board 60 on the side where the LEDs 61 is installed faces upward. In addition, the board (the power supply board) 60 equipped with the power supply circuit 62 is substantially horizontally placed below the board (the LED board) 60. Here, the member indicated by reference numeral 65 is a circuit component such as a capacitor.

In FIG. 22, the board (the LED board) 60 and the board (the power supply board) 60 are electrically connected to each other via the board-to-wire type connector 10. More particularly, the contact 50 installed on the board (the LED board) 60 is housed in the housing portion 24 of the plug housing 20 fixed (attached) to one side of the wire 30 so that the contact 50 is connected to the wire 30. The wire 30 and the board (the LED board) 60 are thus electrically connected to each other. The exposed part of the core 32 on the other side of the wire 30 is soldered onto the board (the power source board) 60 so that the wire 30 and the board (the power source board) 60 are electrically connected to each other. The board (the LED board) 60 and the board (the power supply board) 60 are thus electrically connected to each other via the board-to-wire type connector 10 so as to turn on the LEDs 61. Alternatively, the connector 10 of the board-to-wire type connector 10 may be attached to the board (the power supply board) 60, and the other side of the wire 30 may be soldered onto the board (the LED board) 60.

The board (the power supply board) 60 is also electrically connected to a base 72 via a lead (not shown in the drawing). The base 72 is attached to a socket (not shown in the drawing) electrically connected to an external power source so as to supply power to the LEDs 61 and turn on the LEDs 61.

Figure 23:
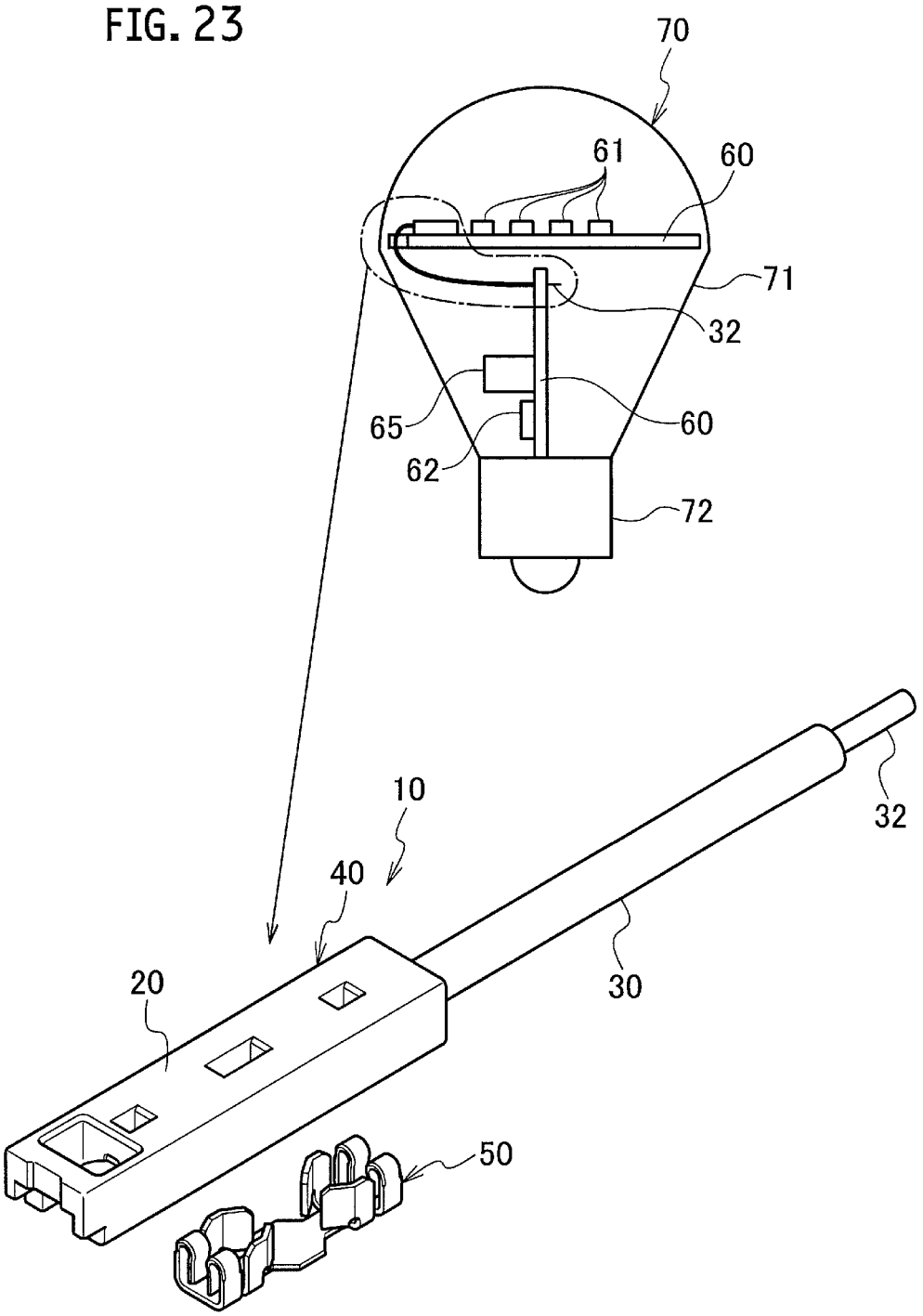
FIG. 23 is a view for schematically explaining a fourth used state of the connector according to the first embodiment of the present invention.

As shown in FIG. 23, the board (the power supply board) 60 may be placed substantially vertically below the board (the LED board) 60. In FIG. 23, the board-to-wire type connector 10 is used to connect the board (the LED board) 60 to the board (the power supply board) 60 as in the case described above.

In the configurations shown in FIG. 22 and FIG. 23, the board-to-board type connector 10 in which the wire 30 is provided with the connectors 10 on both sides may be used.

When the board-to-wire type connector 10 or the board-to-board type connector 10 is a low-profile connector in the configuration shown in FIG. 22 or FIG. 23, the attachment of the connector 10 to the boards 60 can be achieved without blocking emission of the LEDs 61.

As described above, according to the present embodiment, the wire 30 is moved in the perpendicular direction (the Z direction) to the axial direction (the wire extending direction: the X direction) so as to be inserted into the contact 50. Therefore, the wire 30 can be prevented from being bent when the wire 30 is inserted into the contact 50, which further facilitates the attachment of the wire 30 to the contact 50.

In the embodiment, the connector 10 according to the present embodiment includes the lock portions (movement restriction member) 54 having the lock pieces 54*a* holding the wire 30 in the state the wire 30 is in contact with the contact portions 53. Therefore, the wire 30 can be locked with the lock portions 54 in the state where the wire 30 is attached to the contact 50. Accordingly, the wire 30 can be prevented from coming off the contact 50 more reliably. Particularly, the lock portions (the movement restriction member) 54 can restrict a movement of the wire 30 in the wire extending direction (the X direction), so that the wire 30 can be prevented from being bent or coming off the plug housing 20 when the wire 30 is pulled outward from the plug housing 20 in the inserting-removing direction (the X direction) for some reasons such as because of other members being stuck.

In the present embodiment, the tips 54*f* of the lock pieces 54*a* hold the wire 30 while biting the wall surface 32*g* of the core 32. More particularly, the tips 54*f* of the lock pieces 54*a* hold the wire 30 while biting the wall surface 32*g* of the core 32 along the circumference thereof. Therefore, the tips 54*f* of the lock pieces 54*a* biting the wall surface 32*g* of the core 32 along the circumference thereof can lock and prevent the wire 30 from being shifted in the X direction (the axial direction of the wire 30).

In the present embodiment, the wire 30 is housed and fixed (attached) in the plug housing 20 without using the contact 50. The plug housing 20 houses the core 32 (the wire 30) in a manner such that the core 32 is exposed to the outside via the opening 24 when viewed in the open direction of the opening 24*a* (the Z direction). In other words, the core 32 of the wire 30 is directly attached to the contact portions 53 of the contact 50. Since the wire 30 is detachable from the contact 50, the core 32 of the wire 30 can be removed from the contact portions 53 of the contact 50 easily, and the engagement between the wire 30 and the contact 50 can be released easily.

The contact 50 further includes the movement regulation member 50*c* for regulating a movement of the wire 30 in the Z direction in the state where the wire 30 is in contact with the contact portions 53. The movement regulation member 50*c* provided in the contact 50 can eliminate an additional member for preventing the contact state between the wire 30 and the contact portions 53 from being released because of a movement of the wire 30 on the contact 50 in the Z direction. Thus, the wire 30 can be prevented from coming off the contact 50 because of excessive insertion of the wire 30 with no additional member used. Therefore, even when the plug housing 20 is used, the plug housing 20 is not necessarily formed into a complicated shape, and the configuration thereof can be further simplified so as to reduce manufacturing costs.

According to the present embodiment, the contact portions 53 include the outer pieces 53*a* as the first side wall portions located on both sides in the Y direction (the width direction) when viewed in the X direction, and the two holding pieces (at least one second side wall portion) 53*c* located between the outer pieces 53*a*.

The two holding pieces 53*c* (at least one second side wall portion) are formed in an elastically deformable manner so that the wire 30 is held on both sides in the Y direction (at least one side in the Y direction) by the holding pieces 53*c* elastically deformable in the Y direction.

Therefore, when the wire 30 is pulled in the Y direction for some reasons such as because of other members being stuck, force in the Y direction applied to the contact 50 can be absorbed by elastic deformation of the holding pieces 53*c*. Accordingly, the outer pieces (the first side wall portions) 53*a* of the contact 50 can be prevented from receiving the force, and the contact 50 installed on the board 60 can be prevented from being removed. Such a configuration can increase the rigidity of the outer pieces (the first side wall portions) 53*a* of the contact 50 and prevent the wire 30 from coming off the contact 50 so as to prevent the external shape of the contact 50 from being deformed. Thus, when the plug housing 20 is used, the contact 50 can be prevented from failing to be housed in the housing portion 24 of the plug housing 20 because of deformation of the contact 50.

According to the present embodiment, the two (plural) lock portions (movement restriction member) 54 are provided and symmetrically located when viewed in the Z direction (the perpendicular direction). Therefore, the contact 50 can lock the wire 30 at two points (plural points) more evenly and stably.

According to the present embodiment, the contact 50 is formed in a manner such that a metal plate is subjected to metal processing (pressing), which facilitates the process of formation of the contact 50. The sharper edges 54*g* formed by the metal press processing in the punching direction are located toward the wire 30. Thus, the strength to lock the wire 30 with the lock portions 54 can be increased more easily by use of the characteristics of the metal press processing.

The lock portions (movement restriction member) 54 include locking pieces for locking the wire 30 in the state where the wire 30 is in contact with the contact portions 53. The locking pieces include the lock pieces 54 for holding the wire 30 in contact with the contact portions 53 so as to lock the wire 30 with a simpler configuration and form the lock portions (movement restriction member) 54 more easily.

According to the present embodiment, the core 32 (the wire 30) includes the flattened portion 32*b* formed in such a manner as to flatten the tip portion 32*a*. The plug housing 20 includes the locking portion 20*b* for locking the flattened portion 32*b* of the core 32 (the wire 30). This configuration can fix the wire 30 to the plug housing 20 with the simple process of flattening the tip portion 32*a* of the core 32 (the wire 30).

According to the present embodiment, the plug housing 20 includes the housing portion 24 for housing the wire 30, the opening 24*a* communicating with the housing portion 24 in such a manner as to be open in the perpendicular direction (the Z direction) perpendicular to the wire extending direction (the X direction) in which the wire 30 extends so that the wire 30 housed in the housing portion 24 is exposed to the outside via the opening 24*a* when viewed in the open direction of the opening 24*a* (the Z direction), and the locking portion (the holding portion) 20*b* for holding the wire 30 housed in the housing portion 24. The housing portion 24 can receive the contact 50 connected to the board (the member to be connected) 60 via the opening 24*a*. Thus, the direct electrical connection between the wire 30 attached to the plug housing 20 having the configuration described above and the contact 50 can be achieved without depending on the plug housing 20, which further facilitates the electrical connection between the wire 30 and the board (the member to be connected) 60.

According to the present embodiment, the plug housing 20 is provided with the through-hole 22*b* open on one of the wall surfaces surrounding the locking portion 20*b* so that the tip portion 32*a* (the wire 30) of the core 32 is exposed to the outside via the through-hole 22*b*. The through-hole 22*b* enables the tip portion 32*a* of the core 32 (the wire 30) to be flattened after the tip portion 32*a* of the core 32 (the wire 30) is inserted into the locking portion 20*b* of the plug housing 20 so as to further facilitate the attachment of the wire 30 to the plug housing 20.

According to the present embodiment, the through-holes are provided on both sides in the Z direction (the wall surfaces opposed to each other) of the wall surfaces surrounding the locking portion 20*b* so that the locking portion 20*b* penetrates in the Z direction. Thus, the through-holes enable the pressing portions 91 of the jigs 90 for flattening to be inserted from both sides in the Z direction so as to further facilitate the process of flattening the tip portion 32*a* of the core 32 (the wire 30).

According to the present embodiment, the wire 30 includes the core 32 composed of a solid wire. Therefore, the wire 30 is suitable for laying for longer distances (such as 10 m or longer) with lower cost than the case where the core 32 is composed of a stranded wire, so as to ensure stable communication while being hardly influenced by noise.

Second Embodiment

A connector 10A according to the present embodiment has a configuration substantially similar to the first embodiment.

The connector 10A according to the present embodiment also includes the contact 50 connected to the board 60. The wire 30 is connected to the contact 50 so that the wire 30 is electrically connected to the board 60.

Figure 24:
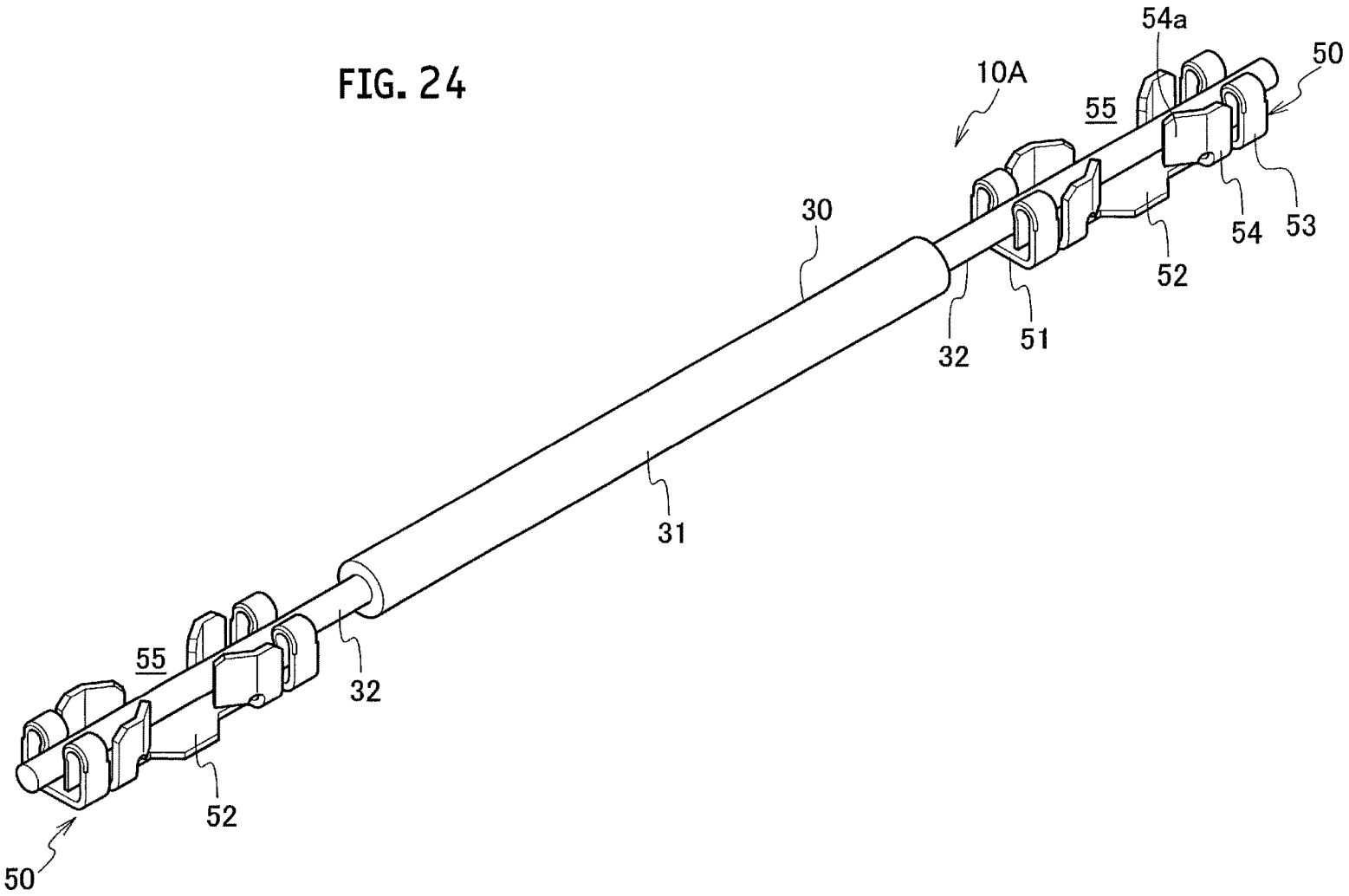
FIG. 24 is a perspective view showing a connector according to a second embodiment of the present invention.
Figure 25:
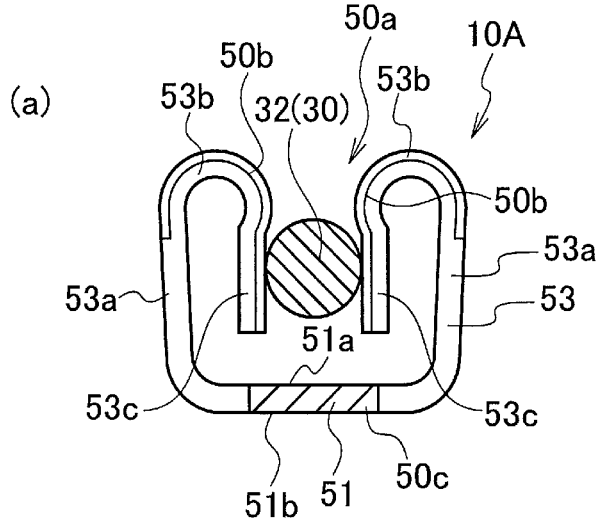
FIG. 25 is a view showing a state where a wire is attached to a contact according to the second embodiment of the present invention, wherein FIG. 25(*a*) is a view at a position corresponding to a contact portion, and FIG. 25(*b*) is a view at a position corresponding to a lock portion.
Figure 25:
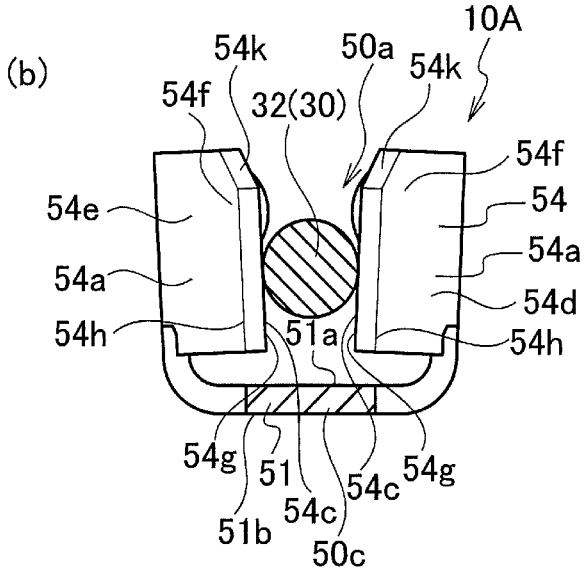

The connector 10A according to the present embodiment differs from the connector 10 according to the first embodiment in that, as shown in FIG. 24 and FIG. 25, the core 32 of the wire 30 is directly brought into contact with the contact portions 53 of the contact 50 without the plug housing 20 used.

Figure 26:
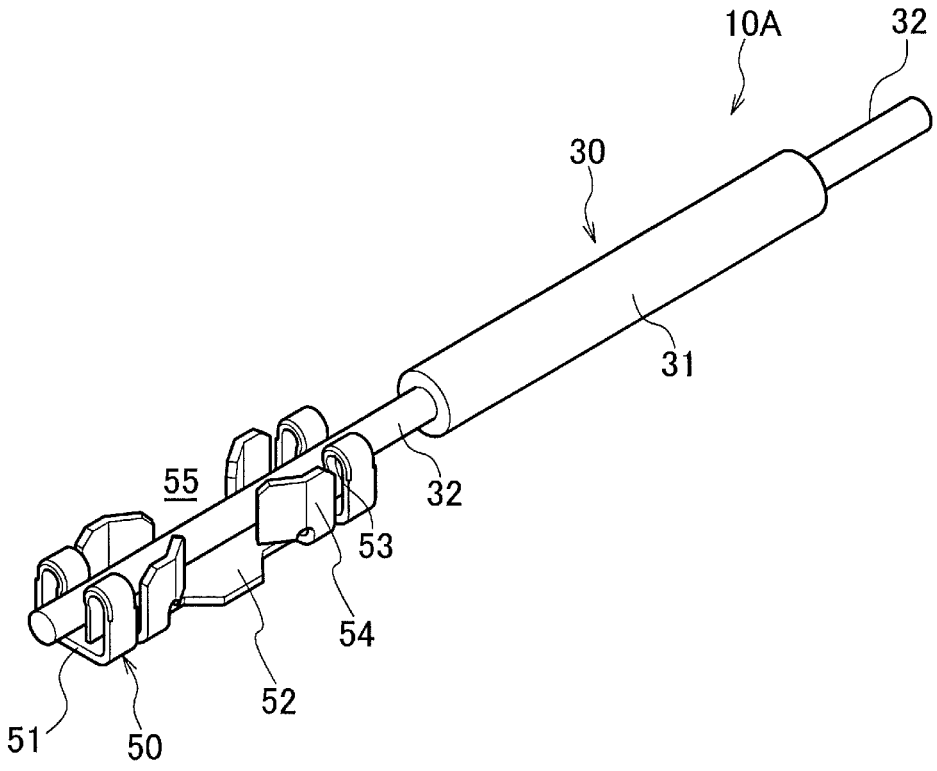
FIG. 26 is a perspective view showing a connector according to a modified example of the second embodiment of the present invention.

As shown in FIG. 26, the present embodiment may be applied to a board-to-wire type connector so that the wire 30 may be directly fitted (inserted) on one side to the contact portions 53 of the contact 50 without the plug housing 20 used.

The present embodiment described above can also achieve the operations and effects similar to the first embodiment.

According to the present embodiment, the core 32 of the wire 30 is directly brought into contact with the contact portions 53 of the contact 50 without the plug housing 20 used. This configuration can simplify the connector 10A and reduce the weight thereof.

Particularly, the movement regulation member 50*c* formed in the contact 50 can prevent the wire 30 from coming off the contact 50 caused by excessive insertion of the wire 30 without using other members such as a housing. Thus, reliability of connection between the contact 50 and the wire 30 can be improved without using other members such as a housing.

Further, the connector 10A according to the present embodiment is applicable to the application examples shown in FIG. 20 to FIG. 23.

Next, modified examples of the wire 30 are explained below.

Figure 27:
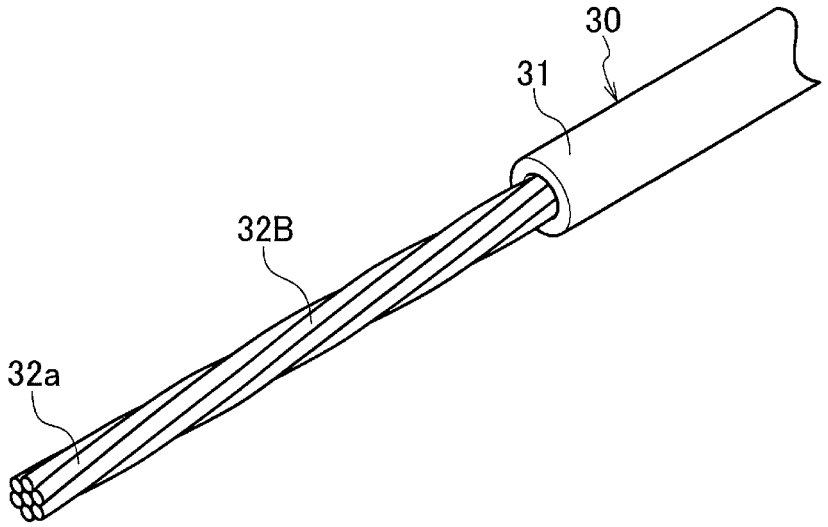
FIG. 27 is a perspective view showing a first modified example of the wire.

The wire 30 shown in FIG. 27 includes a core 32B composed of a stranded wire. The wire 30 shown in FIG. 27 is a crossover cable in which seven thin copper wires (φ0.2) are stranded. The core 32B composed of the stranded wire is covered with the insulating covering member 31 so as to form the wire 30. The wire 30 is inserted into the insertion hole 20*a* in a state where part of the covering member 31 on the tip side is removed to expose the core 32B to the outside. The use of the crossover cable facilitates the insertion of the core 32B composed of the stranded wire into the insertion hole 20*a* (the insertion recess 20*c*, the through-hole 25*a*, the locking portion 20*b*) of the plug housing 20.

This wire 30 is more flexible than the wire 30 using the solid wire as a core so as to facilitate the laying operation.

Figure 28:
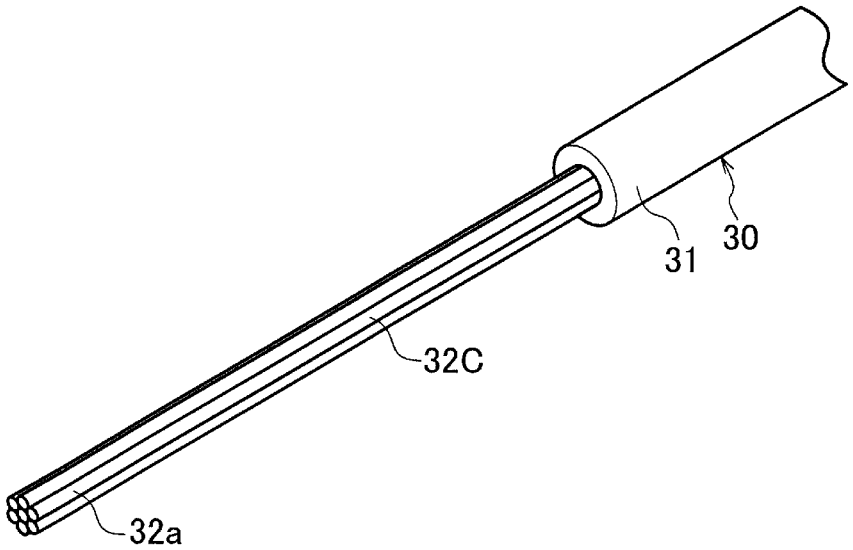
FIG. 28 is a perspective view showing a second modified example of the wire.

The wire 30 shown in FIG. 28 is a straight cable including a core 32C composed of a stranded wire.

More particularly, as shown in FIG. 28, seven thin copper wires (φ0.2) are aligned straight. The core 32C composed of the stranded wire is covered with the insulating covering member 31 so as to form the wire 30. The wire 30 is inserted into the insertion hole 20*a* in the state where part of the covering member 31 on the tip side is removed to expose the core 32C to the outside. The use of the straight stranded wire described above may cause the copper wires of the core 32C to spread out in directions so that it is difficult to insert the wire into the insertion hole 20*a*. Thus, when the covering member 31 of the wire 30 is removed to expose the core 32C to the outside, the core 32C is preferably subjected to pretreatment such as soldering. Such pretreatment facilitates the insertion of the core 32C composed of the stranded wire into the insertion hole 20*a* (the insertion recess 20*c*, the through-hole 25*a*, the locking portion 20*b*) of the plug housing 20.

The wire 30 includes the core 32C composed of the stranded wire. Therefore, the wire 30 is more flexible than the wire 30 using the solid wire as a core so as to facilitate the laying operation.

Figure 29:
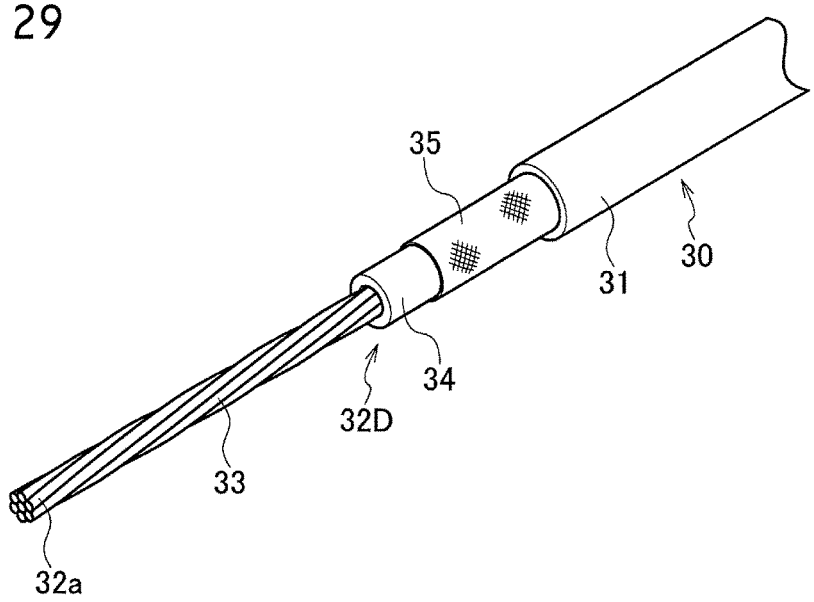
FIG. 29 is a perspective view showing a third modified example of the wire.

FIG. 29 illustrates a configuration in which the wire 30 is composed of a coaxial cable 32D. In FIG. 29, an internal conductor 33 (core) composed of a stranded wire is covered with an insulator 34, and an external conductor 35 formed on the outside of the insulator 34 is covered with the covering member 31. The coaxial cable 32D is flexible so as to facilitate the laying operation and prevent external leakage of electromagnetic waves.

Although FIG. 29 illustrates the case where the internal conductor 33 (the core) is composed of the stranded wire, the internal conductor 33 (the core) composed of a solid wire may be used.

Next, modified examples of the contact are explained below.

Figure 30:
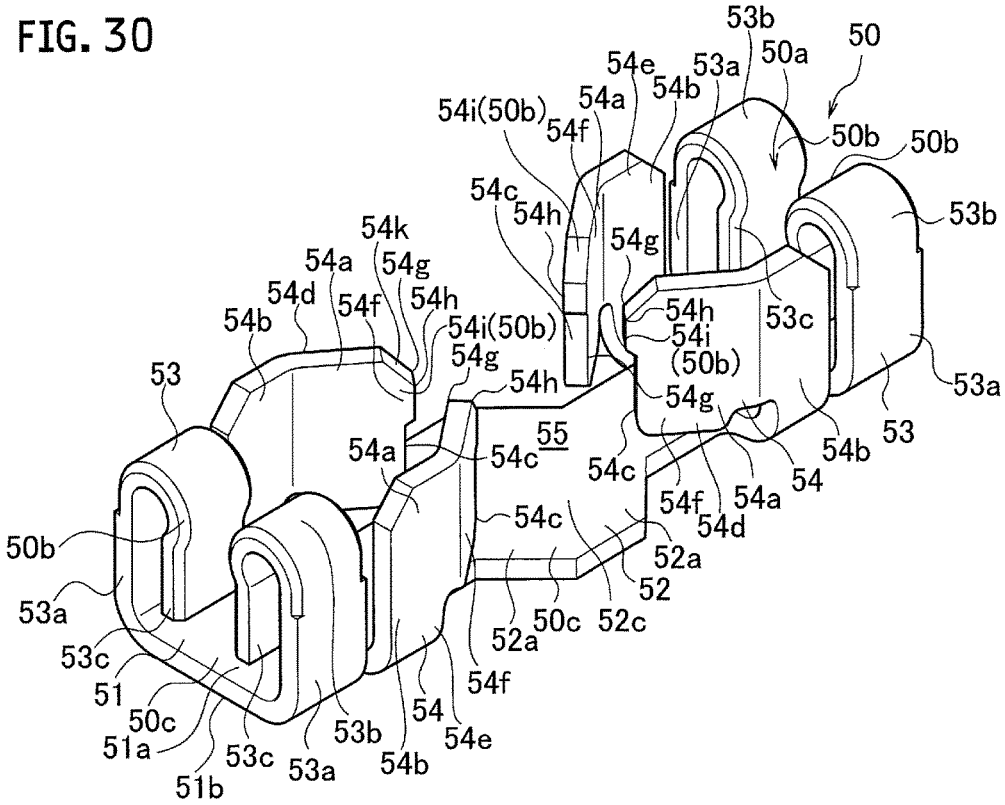
FIG. 30 is a perspective view showing a first modified example of the contact.

The contact 50 shown in FIG. 30 includes the drop-off prevention portions formed in the lock pieces (the locking pieces) 54*a* of the lock portions (the movement restriction member) 54 for covering at least part of the wire 30 on the other side in the Z direction while being in contact with the contact portions 53 (toward the opening 50*a* in the state where the wire 30 is in contact with the contact portions 53).

More particularly, the tips 54*f* of the lock pieces (the locking pieces) 54*a* are provided, on the opening 50*a* side, with projections 54*i* projecting in the Y direction and the X direction. The gap between the respective projections 54*i* on both sides in the Y direction is smaller than the diameter of the wire 30.

The projections 54*i* shown in FIG. 30 are each formed substantially into a trapezoid having a thickness decreasing toward the tip thereof when viewed from the side surface (when viewed in the Y direction). Therefore, inclined surfaces of the projections 54*i* toward the opening 50*a* can serve as a guide when the wire 30 is inserted so as to prevent the insertion of the wire 30 into the contact 50 from being blocked by the projections 54*i*.

The projections 54*i* having such a configuration can prevent the wire 30 from moving in the direction opposite to the direction in which the wire 30 is attached (the direction in which the wire 30 is inserted) and prevent the wire 30 from coming off. Further, since the wire 30 is inserted into the contact 50 by climbing over the drop-off prevention portions protruding inward in the Y direction, a feeling of clicking can be ensured at the time of insertion of the wire 30 so that the connection of the wire 30 can be confirmed easily. Although FIG. 30 illustrates the case where the drop-off prevention portions are formed in the contact portions 53 and the lock portions (the movement restriction member) 54 to cover at least part of the wire 30 on the other side in the Z direction while being in contact with the contact portions 53 (toward the opening 50*a* in the state where the wire 30 is in contact with the contact portions 53), the drop-off prevention portions may be formed only in the lock portions (the movement restriction member) 54, instead of being formed in both the contact portions 53 and the lock portions (the movement restriction member) 54.

The contact 50 described above can also achieve substantially the same operations and effects as those in the first and second embodiments. Further, the contact 50 shown in FIG. 30 has a configuration in which the locking portions of the lock pieces 54*a* at which the wire 30 is locked (the edges 54*g*) and the holding pieces 53*c* of the contact portions 53 are arranged approximately at even intervals in the X direction. The edges 54*g* and the holding pieces 53*c* are portions by which the insertion of the wire 30 into the contact 50 is blocked (portions at which the wire 30 is hardly inserted if greater force is not applied thereto than that applied to other portions in the contact) when the wire 30 is inserted into the contact 50 while two parts of the wire 30 on the outside of the contact 50 in the X direction are gripped. Thus, the blocking portions are arranged approximately at even intervals in the X direction in the contact 50 shown in FIG. 30. As a result, the force applied to the wire 30 can be dispersed evenly in the X direction so as to be prevented from being partly applied to the wire 30 when the wire 30 is inserted into the contact 50.

Figure 31:
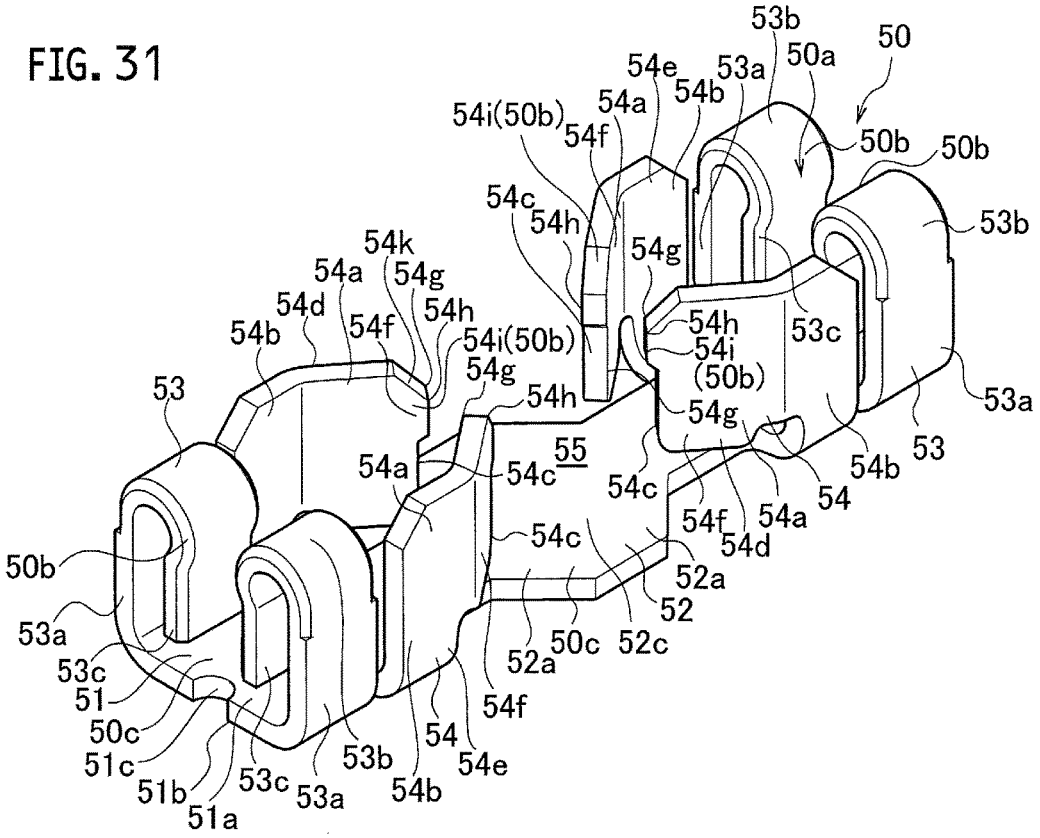
FIG. 31 is a perspective view showing a second modified example of the contact.

The contact 50 shown in FIG. 31 has a configuration, as in the case of the contact shown in FIG. 30, in which the drop-off prevention portions are formed in the lock pieces (the locking pieces) 54*a* of the lock portions (the movement restriction member) 54 for covering at least part of the wire 30 on the other side in the Z direction while being in contact with the contact portions 53 (toward the opening 50*a* in the state where the wire 30 is in contact with the contact portions 53).

Further, the contact 50 shown in FIG. 31 includes recesses 51*c* formed on the bottom walls 51 serving as the installation member on the outer side in the X direction. In the contact 50 shown in FIG. 31, the recesses 51*c* are formed at the edges of the bottom walls 51 in the X direction. More particularly, the recesses 51*c* are each formed in a manner such that a part of the edge of the bottom wall 51 in the X direction is notched into an arc shape. The recesses 51*c* are each formed to penetrate in the Z direction so that the board (the member to be connected) 60 is exposed to the outside when viewed in the Z direction (viewed from one side of the installation member). Here, the recesses 51*c* may each be formed in a manner such that the entire edge of the bottom wall 51 in the X direction is notched into an arc shape, instead of being formed in a manner such that a part of the edge of the bottom wall 51 in the X direction is notched. Alternatively, the recesses may each be formed at an edge of the installation member in the Y direction. Further, the recesses are not limited to the arc shape and may be any shapes, and the number of the recesses may also be determined as appropriate.

The recesses 51*c* can each serve as a soldering confirmation portion at which a solder fillet is formed. In particular, the recesses 51*c* are formed on the bottom walls 51*c* so that a state of solder wetting can be confirmed with the solder fillets formed at the recesses 51*c* when the contact 50 is soldered onto the board (the member to be connected) 60. The recesses 51*c* thus contribute to easily determining whether the board (the member to be connected) 60 and the contact 50 are connected (installed) appropriately, and further improving the reliability of connection (installation) between the board (the member to be connected) 60 and the contact 50. Although FIG. 31 illustrates the case where the bottom walls 51 compose at least part of the installation member provided with the recesses 51*c* serving as a soldering confirmation portion, the connecting portion 52 may serve as the installation member where the soldering confirmation portion is formed. The soldering confirmation portion is not limited to the shape notched into a U-shape and may be various shapes such as a through-hole penetrating the bottom walls 51 in the thickness direction (the Z direction) formed adjacent to the edges of the bottom walls 51. Further, the position and the number of the solder confirmation portion formed may be determined as appropriate. For example, the recesses or through holes may be formed at positions where soldering installation is performed, instead of the edges of the bottom walls 51, so as to serve as the soldering confirmation portion.

Figure 32:
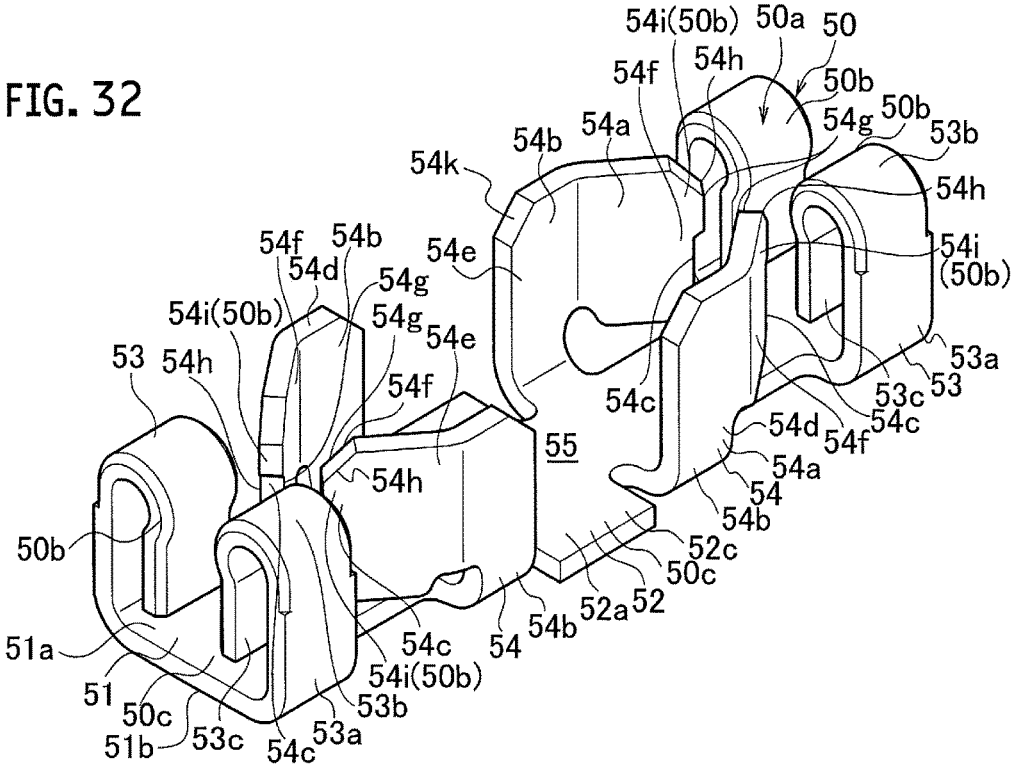
FIG. 32 is a perspective view showing a third modified example of the contact.

The contact 50 shown in FIG. 32 has a configuration in which the connecting portion 52 is formed into a rectangular shape, and the lock pieces (the locking pieces) 54*a* of the respective lock portions (the movement restriction member) 54 are formed in a manner such that the tips 54*f* extend outward in the X direction. The lock pieces 54*a* of the two lock portions 54 having the shape described above also extend in opposite directions.

Thus, the contact 50 having the configuration described above can achieve substantially the same operations and effects as those in the first and second embodiments. The contact 50 can also achieve substantially the same operations and effects as the contact 50 shown in FIG. 30.

In the contact shown in FIG. 32, the distance between the locking portions of the lock pieces 54*a* at which the wire 30 is locked (the edges 54*g*) and the holding pieces 53*c* of the contact portions 53 is smaller than that in the contact 50 shown in FIG. 30. Therefore, the wire 30 can be inserted more easily when the insertion of the wire 30 into one contact portion 53 and the insertion of the wire 30 into the lock portion 54 adjacent to the contact portion 53 are made simultaneously. For example, the contact 50 shown in FIG. 30 is provided with the four blocking portions by which the insertion of the wire 30 into the contact 50 is blocked. On the other hand, the contact 50 shown in FIG. 32 is provided with approximately two blocking portions. Thus, the contact 30 can be prevented from being bent upward (prevented from being inserted into the contact portions 53 located on the outer side in the X direction while the wire 30 is not inserted into the lock portions 54 located on the inner side in the X direction) when the wire 30 is inserted into the contact 50 while two parts of the wire 30 on the outside of the contact 50 in the X direction are gripped. Accordingly, the operability of insertion of the wire 30 into the contact 50 can be further improved.

Figure 33:
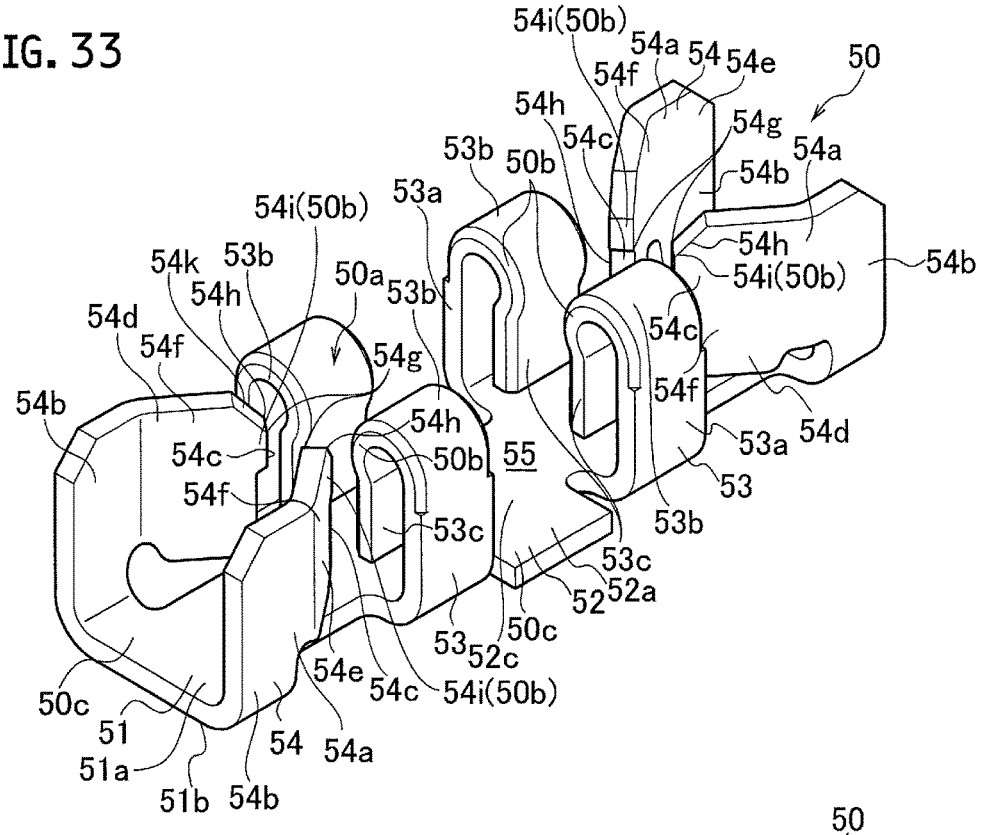
FIG. 33 is a perspective view showing a fourth modified example of the contact.

The contact 50 shown in FIG. 33 has a configuration in which the connecting portion 52 is formed into a rectangular shape, and the contact portions 53 are located on the inner side in the X direction and the lock portions (the movement restriction member) 54 are located on the outer side in the X direction. Further, the lock pieces (the locking pieces) 54*a* of the respective lock portions (the movement restriction member) 54 are formed in a manner such that the tips 54*f* extend inward in the X direction.

Thus, the contact 50 having the configuration described above can achieve substantially the same operations and effects as those in the first and second embodiments. The contact 50 can also achieve substantially the same operations and effects as the contact 50 shown in FIG. 32.

Further, the contact 50 shown in FIG. 33 is provided with the two blocking portions closer to each other at which the insertion of the wire 30 into the contact 50 is blocked, in which the one ends 54*b* of the lock portions 54 (the sides on which the wire 30 is not locked in the lock portions 54) are located on both sides of the contact 50 in the X direction. Thus, the contact 30 can more reliably be prevented from being bent upward (prevented from being inserted into the contact portions 53 located on the inner side in the X direction while the wire 30 is not inserted into the lock portions 54 located on the outer side in the X direction) when the wire 30 is inserted into the contact 50 while two parts of the wire 30 on the outside of the contact 50 in the X direction are gripped. Further, since the width of the contact 50 in the Y direction is larger on both sides in the X direction than the diameter of the wire 30, the wire 30 can be shifted in the Y direction on both sides of the contact 50 in the X direction. Therefore, the wire 30 can be bent in the Y direction without decreasing the radius of curvature of the wire 30 adjacent to the contact 50. Accordingly, the wire 30 can be bent in the Y direction at the position closer to the contact 50 so as to further expand the possibility of positioning of the contact 50 installed on the board (member to be connected) 60 (the possibility of arrangement of the contact 50).

Figure 34:
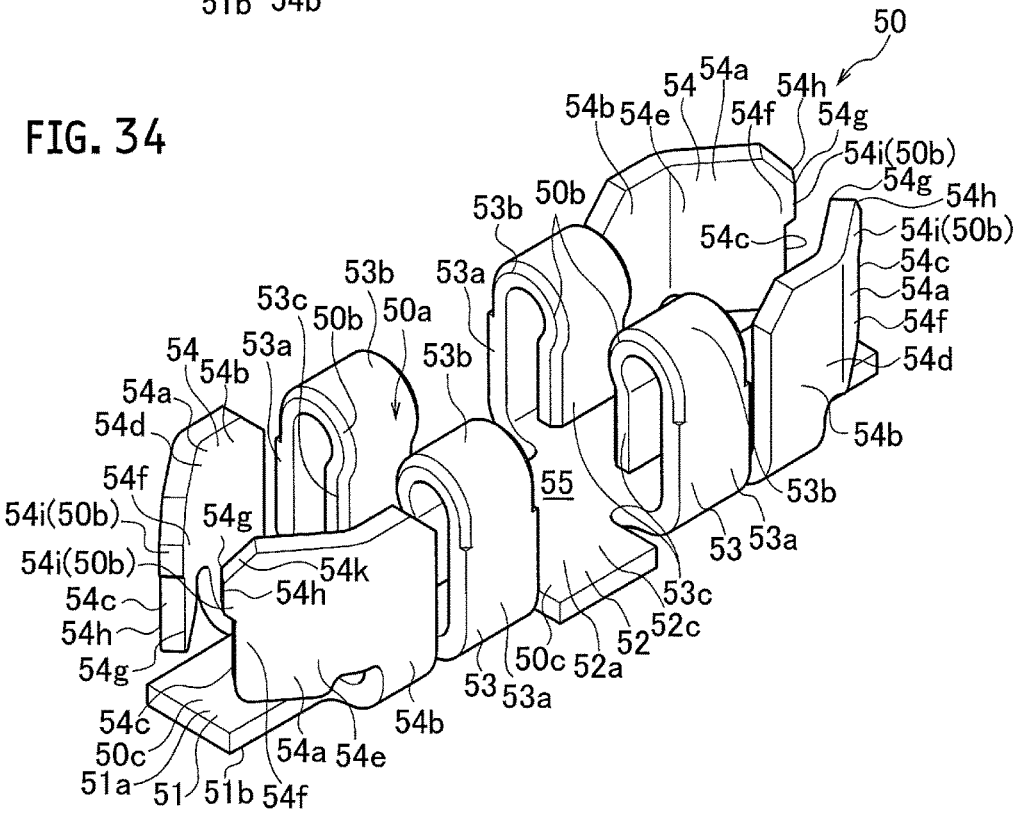
FIG. 34 is a perspective view showing a fifth modified example of the contact.

The contact 50 shown in FIG. 34 has a configuration in which the connecting portion 52 is formed into a rectangular shape, and the contact portions 53 are located on the inner side in the X direction and the lock portions 54 are located on the outer side in the X direction. Further, the lock pieces (locking pieces) 54*a* of the respective lock portions 54 are formed in a manner such that the tips 54*f* extend outward in the X direction.

Thus, the contact 50 having the configuration described above can achieve substantially the same operations and effects as those in the first and second embodiments. The contact 50 can also achieve substantially the same operations and effects as the contact 50 shown in FIG. 30.

Further, in the contact 50 shown in FIG. 34, the locking portions of the lock pieces 54*a* at which the wire 30 is locked (the edges 54*g*) are located on both sides of the contact 50 in the X direction. Therefore, the wire 30 locked on both sides of the contact 50 in the X direction and placed in the contact 50 can be prevented from being bent.

The contact 50 shown in FIG. 34 includes the edges 54*g* of the lock pieces 54*a* located on both sides of the contact 50 in the X direction where it is relatively difficult to insert the wire 30, and the contact portions 53 located on the inner side in the X direction where the wire 30 is relatively easily inserted. This configuration leads the contact 50 to have four blocking portions at which the insertion of the wire 30 into the contact 50 is blocked. However, the blocking portions located on the inner side in the X direction, among the four blocking portions at which the insertion of the wire 30 into the contact 50 is blocked, have a configuration that enables the wire 30 to be relatively easily inserted into the contact 50. Thus, the contact 30 can relatively be prevented from being bent upward (prevented from being inserted into the contact portions 53 located on the outer inner side in the X direction while the wire 30 is not inserted into the lock portions 54 located on the inner outer side in the X direction) when the wire 30 is inserted into the contact 50 while two parts of the wire 30 on the outside of the contact 50 in the X direction are gripped.

Figure 35:
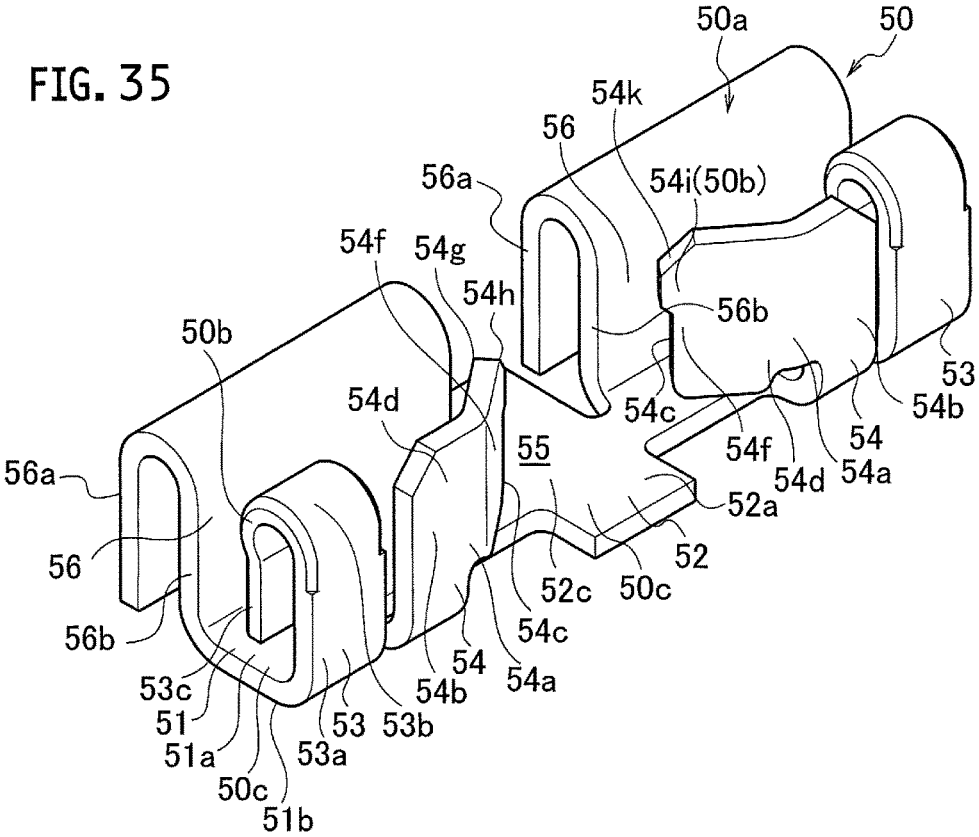
FIG. 35 is a perspective view showing a sixth modified example of the contact.

The contact 50 shown in FIG. 35 has a configuration in which the connecting portion 52 is formed into a rectangular shape. The respective contact portions 53 are provided with the contact pieces only on one side in the Y direction. More particularly, the contact portions 53 each include the outer piece 53*a* extending upward on one side of each bottom wall 51 in the Y direction, the elastically deformable inner piece (the contact piece) 53*b* integrated with the outer piece 53*a*, and the elastically deformable holding piece (the contact piece) 53*c* for holding the core 32 of the wire 30. Further, the lock pieces 54*a* of the lock portions 54 are also formed on one side of the bottom walls 51 in the Y direction. The lock pieces 54*a* provided only on one side in the Y direction are formed in a manner such that the tips 54*f* extend inward in the X direction.

The other side of the respective bottom walls 51 in the Y direction is provided with a substantially inverse U-shaped side wall 56. The side walls 56 are formed on both sides in the X direction with the connecting portion 52 interposed therebetween, and formed in such a manner as to overlap with the contact portions 53 and the lock portions 54 when viewed in the Y direction. Note that the respective side walls 56 are not necessarily formed into a plate shape to overlap with the contact portions 53 and the lock portions 54 when viewed in the Y direction. For example, the side walls 56 may be provided with slits extending in the Z direction so as to be divided into plural parts in the X direction. Here, each slit is not required to be formed from the top to the bottom when viewed in the Y direction, and only part of (for example, only the upper half of) the side walls 56 may be provided with slits. The same explanations are also applied to the side walls 56 described below.

Therefore, the wire 30 inserted into the contact 50 is held between the holding pieces 53*c* located on one side in the Y direction and the side walls 56 located on the other side in the Y direction. In other words, the contact 50 is provided with the holding pieces 53*c*, of the holding pieces 53*c* and the side walls 56, which are only formed to be elastically deformable in the Y direction (the width direction) so that the wire 30 is held at least on one side in the Y direction by the holding pieces 53*c* elastically deformable in the Y direction. Further, the wire 30 inserted into the contact 50 is held between the lock pieces 54*a* formed in an elastically deformable manner on one side in Y direction and the side walls 56 formed on the other side so that a movement of the wire 30 in the X direction is locked (restricted).

The contact 50 shown in FIG. 35 having the configuration described above has line symmetry when viewed in the Z direction.

The contact 50 having the configuration described above can achieve substantially the same operations and effects as those in the first and second embodiments. The contact 50 can also achieve substantially the same operations and effects as the contact 50 shown in FIG. 30.

Further, since the contact 50 shown in FIG. 35 is provided with the side walls 56 having relatively high rigidity on the other side of the bottom walls 51 in the Y direction, the wire 30 inserted into the contact 50 can be prevented from moving toward the other side in the Y direction due to the side walls 56. Thus, the contact 50 shown in FIG. 35 is effectively used when the wire 30 should be prevented from moving to the other side in the Y direction (toward the side walls 56). Here, the wire 30 can be prevented from moving to the one side in the Y direction when the contact 50 shown in FIG. 35 is reversed so that the side walls 56 are located on one side in the Y direction. Thus, the side walls 56 can be formed on either side to which the wire 30 should be prevented from moving so that the force applied to another side in the Y direction can be absorbed by the holding pieces 53*c* or the lock pieces 54*a* so as to prevent the installation of the contact 50 on the board 60 from being released, while the movement of the wire 30 to one side is restricted by the side walls 56.

Although FIG. 35 illustrates the case where the substantially inverse U-shaped side walls 56 each include a first side wall 56*a* located on the outer side in the Y direction (the width direction) when viewed in the X direction and a second side wall 56*b* located between the first side wall 56*a* and the holding piece 53*c*, the configuration of the respective side walls 56 is not limited thereto. For example, the side walls 56 may each be formed into merely a plate shape extending upward from the bottom wall 51. In other words, the side walls 56 may be provided only with the second side wall 56*b* serving as the first side wall 56*a* without being provided with the first side wall 56*a*. In such a case, the contact includes only one holding piece 53*c* serving as the second side wall between the side wall only having the first side wall and the outer piece (another first side wall) 53*a*. Further, although FIG. 35 illustrates the case where the side walls 56 are provided on both sides in the X direction, the side wall 56 may be provided only on one side in the X direction. The same explanations are also applied to the side walls 56 described below.

Figure 36:
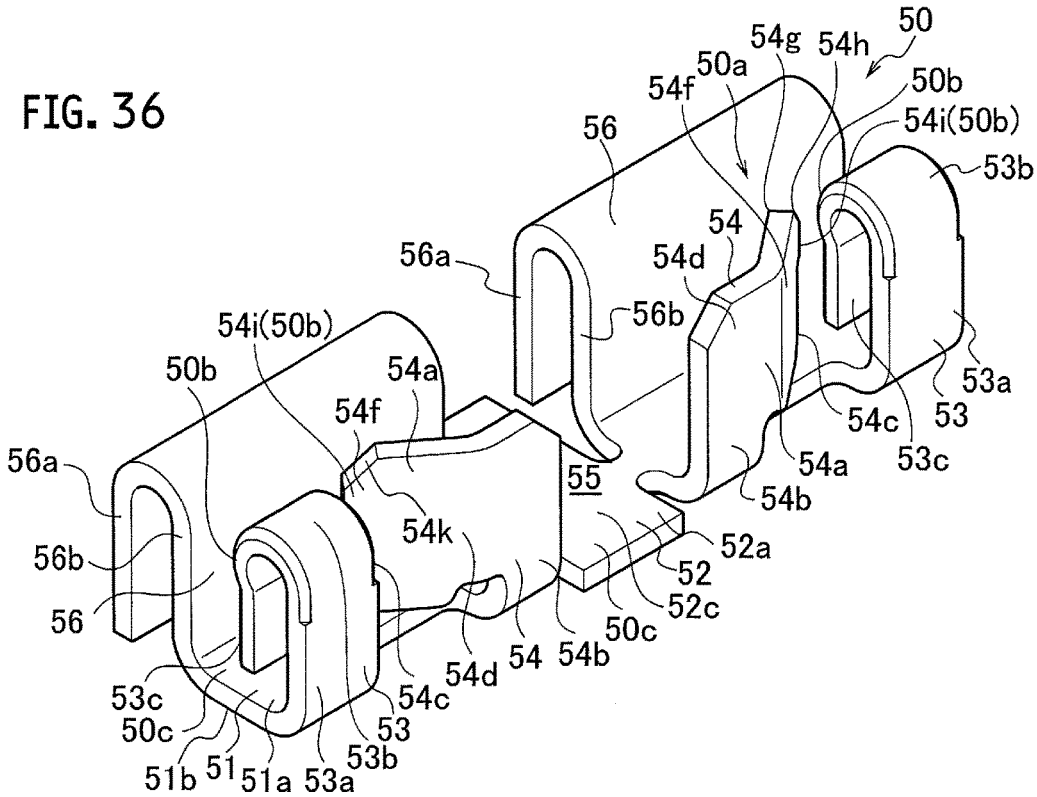
FIG. 36 is a perspective view showing a seventh modified example of the contact.

The contact 50 shown in FIG. 36 has a configuration in which the lock pieces 54*a* extend in the direction opposite to that in the contact 50 shown in FIG. 35.

The contact 50 having the configuration described above can achieve substantially the same operations and effects as those in the first and second embodiments. The contact 50 can also achieve substantially the same operations and effects as the contacts 50 shown in FIG. 32 and FIG. 35.

Figure 37:
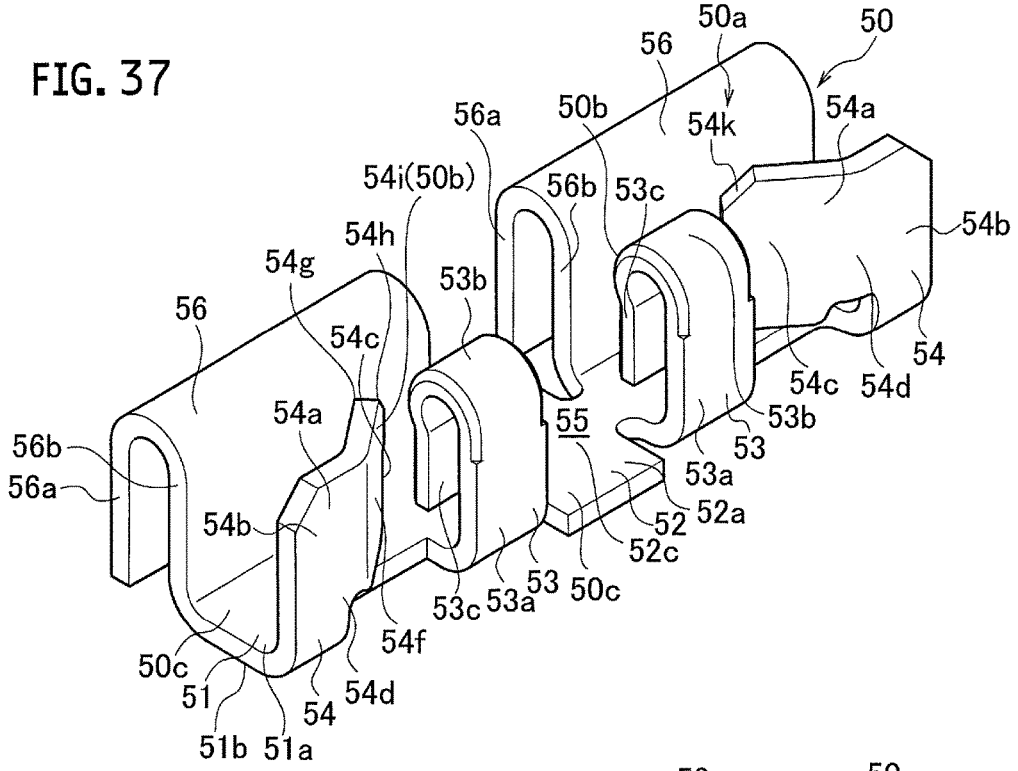
FIG. 37 is a perspective view showing an eighth modified example of the contact.

The contact 50 shown in FIG. 37 has a configuration in which the contact pieces and the lock pieces are replaced with those in the contact 50 shown in FIG. 35 in a manner such that the contact pieces are located on the inner side in the X direction, and the lock pieces are located on the outer side in the X direction.

The contact 50 having the configuration described above can achieve substantially the same operations and effects as those in the first and second embodiments. The contact 50 can also achieve substantially the same operations and effects as the contacts 50 shown in FIG. 33 and FIG. 35.

Figure 38:
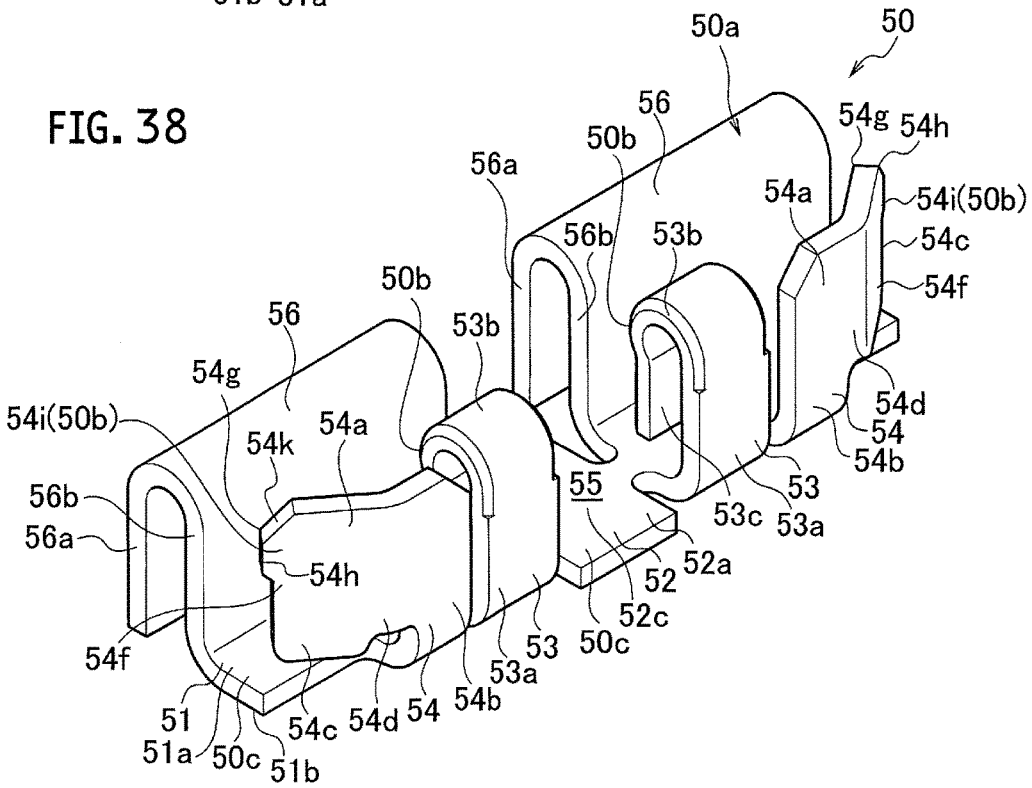
FIG. 38 is a perspective view showing a ninth modified example of the contact.

The contact 50 shown in FIG. 38 has a configuration in which the contact pieces and the lock pieces are replaced with those in the contact 50 shown in FIG. 36 in a manner such that the contact pieces are located on the inner side in the X direction, and the lock pieces are located on the outer side in the X direction.

The contact 50 having the configuration described above can achieve substantially the same operations and effects as those in the first and second embodiments. The contact 50 can also achieve substantially the same operations and effects as the contacts 50 shown in FIG. 34 and FIG. 36.

Figure 39:
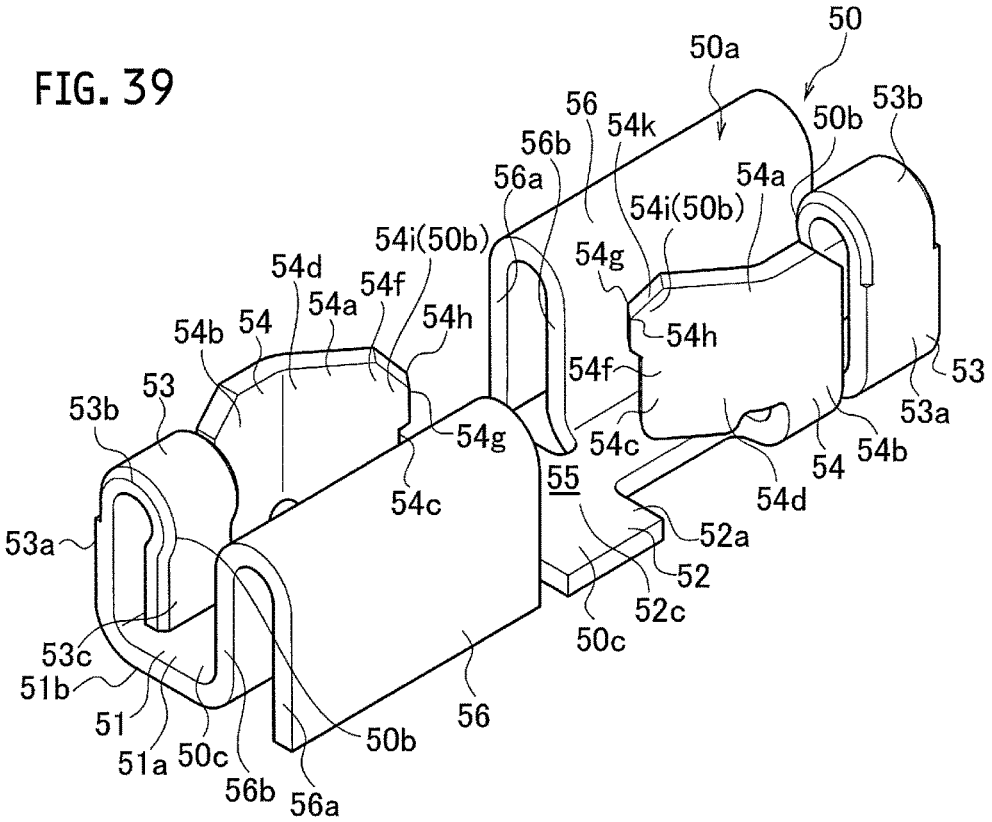
FIG. 39 is a perspective view showing a 10th modified example of the contact.

The contact 50 shown in FIG. 39 has a configuration in which the contact pieces, the lock piece 54*a* and the side wall 56 on one side in the X direction (on the lower left side in FIG. 35) in the contact 50 shown in FIG. 35 are replaced with each other in the Y direction. Therefore, the side walls 56 on both sides in the X direction are arranged in the diagonal line when viewed in the Z direction. The contact portions 53 and the lock portions 54 on both sides in the X direction are also arranged in the diagonal line when viewed in the Z direction. The contact 50 shown in FIG. 39 has a symmetrical configuration (point symmetry in the plan view).

Since the contact 50 shown in FIG. 39 having such a configuration is provided with the contact pieces elastically deformable in the Y direction placed on both sides in the Y direction, force applied to either side can be absorbed by elastic deformation of the contact pieces.

Further, since the lock pieces 54*a* elastically deformable in the Y direction are also placed on both sides in the Y direction, the lock pieces 54*a* can bite the wire 30 on both sides in the Y direction. Accordingly, the wire 30 can be locked (restricted) more reliably.

The contact 50 having the configuration described above can achieve substantially the same operations and effects as those in the first and second embodiments. The contact 50 can also achieve substantially the same operations and effects as the contact 50 shown in FIG. 35.

Further, since the contact 50 shown in FIG. 39 is provided with the side walls 56 having relatively high rigidity on both sides in the Y direction, the movement of the wire 30 in the Y direction (the movement to one side in the Y direction and the movement to the other side in the Y direction) can be suppressed by the respective side walls 56, and the force applied in the Y direction (the force applied to one side in the Y direction and the force applied to the other side in the Y direction) can be absorbed by the holding pieces 53*c* or the lock pieces 54*a* so as to prevent the installation of the contact 50 on the board 60 from being released.

Figure 40:
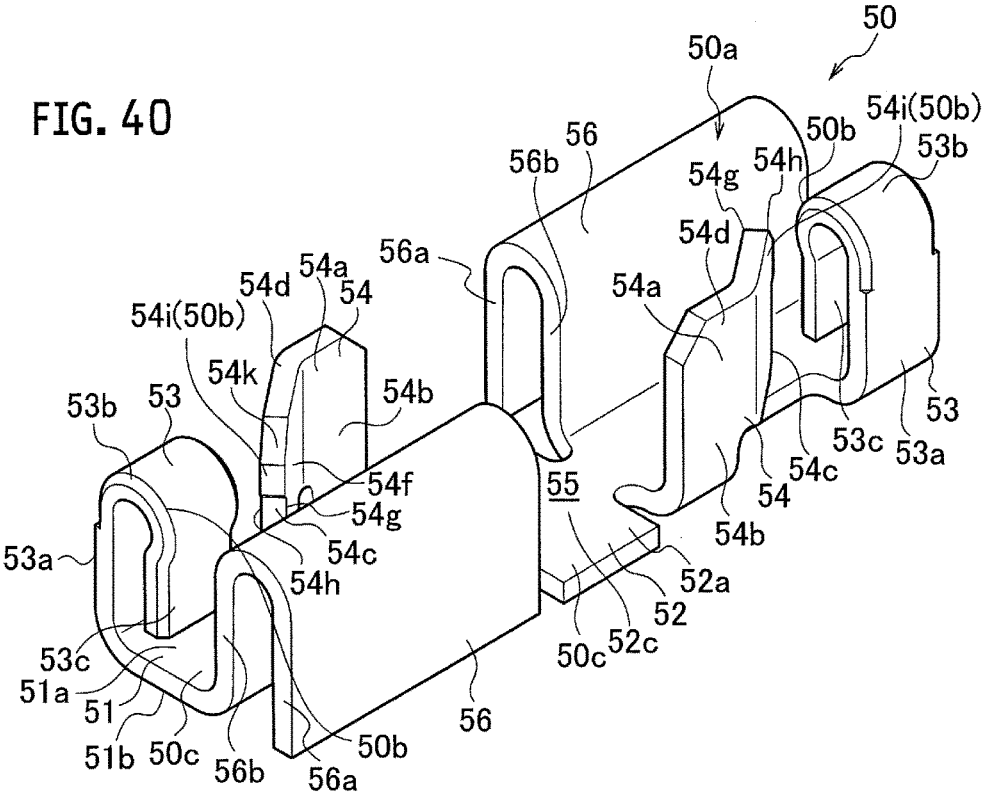
FIG. 40 is a perspective view showing an 11th modified example of the contact.

The contact 50 shown in FIG. 40 has a configuration in which the contact pieces, the lock piece 54*a* and the side wall 56 on one side in the X direction (on the lower left side in FIG. 36) in the contact 50 shown in FIG. 36 are replaced with each other in the Y direction.

Since the contact 50 shown in FIG. 40 having such a configuration is provided with the contact pieces elastically deformable in the Y direction placed on both sides in the Y direction, force applied to either side can be absorbed by elastic deformation of the contact pieces.

Further, since the lock pieces 54*a* elastically deformable in the Y direction are also placed on both sides in the Y direction, the lock pieces 54*a* can bite the wire 30 on both sides in the Y direction. Accordingly, the wire 30 can be locked (restricted) more reliably.

The contact 50 having the configuration described above can achieve substantially the same operations and effects as those in the first and second embodiments. The contact 50 can also achieve substantially the same operations and effects as the contacts 50 shown in FIG. 36 and FIG. 39.

Figure 41:
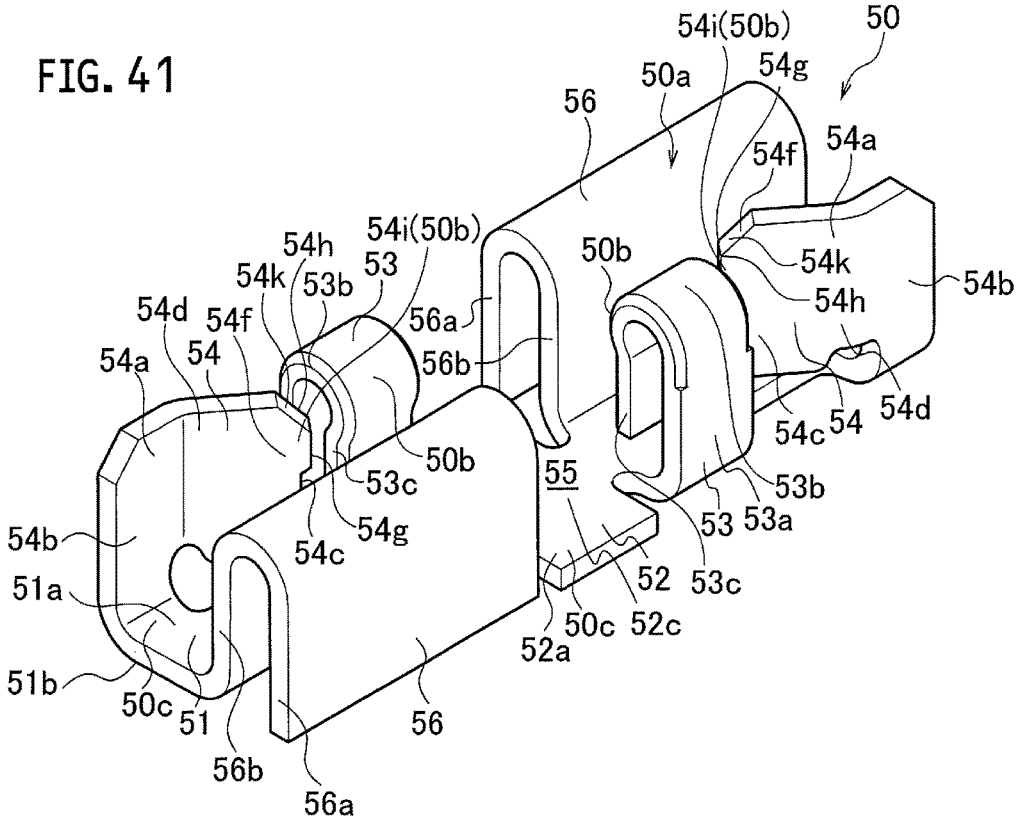
FIG. 41 is a perspective view showing a 12th modified example of the contact.

The contact 50 shown in FIG. 41 has a configuration in which the contact pieces, the lock piece 54*a* and the side wall 56 on one side in the X direction (on the lower left side in FIG. 37) in the contact 50 shown in FIG. 37 are replaced with each other in the Y direction.

Since the contact 50 shown in FIG. 41 having such a configuration is provided with the contact pieces elastically deformable in the Y direction placed on both sides in the Y direction, force applied to either side can be absorbed by elastic deformation of the contact pieces.

Further, since the lock pieces 54*a* elastically deformable in the Y direction are also placed on both sides in the Y direction, the lock pieces 54*a* can bite the wire 30 on both sides in the Y direction. Accordingly, the wire 30 can be locked (restricted) more reliably.

The contact 50 having the configuration described above can achieve substantially the same operations and effects as those in the first and second embodiments. The contact 50 can also achieve substantially the same operations and effects as the contacts 50 shown in FIG. 37 and FIG. 39.

Figure 42:
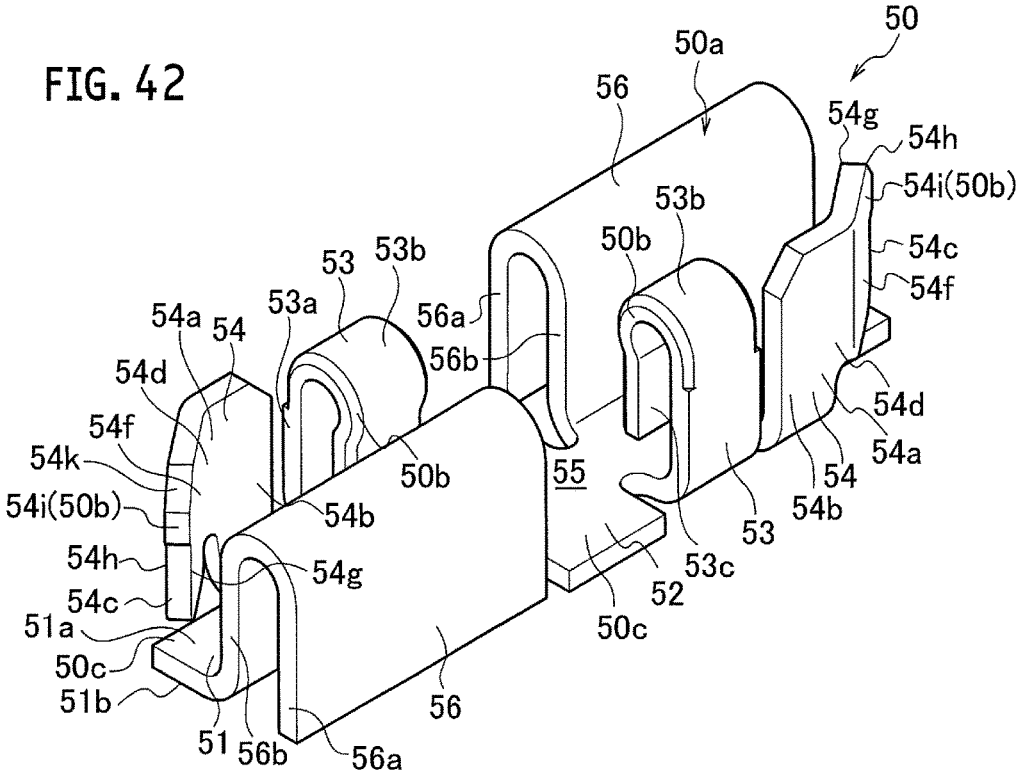
FIG. 42 is a perspective view showing a 13th modified example of the contact.

The contact 50 shown in FIG. 42 has a configuration in which the contact pieces, the lock piece 54*a* and the side wall 56 on one side in the X direction (on the lower left side in FIG. 38) in the contact 50 shown in FIG. 38 are replaced with each other in the Y direction.

Since the contact 50 shown in FIG. 42 having such a configuration is provided with the contact pieces elastically deformable in the Y direction placed on both sides in the Y direction, force applied to either side can be absorbed by elastic deformation of the contact pieces.

Further, since the lock pieces 54*a* elastically deformable in the Y direction are also placed on both sides in the Y direction, the lock pieces 54*a* can bite the wire 30 on both sides in the Y direction. Accordingly, the wire 30 can be locked (restricted) more reliably.

The contact 50 having the configuration described above can achieve substantially the same operations and effects as those in the first and second embodiments. The contact 50 can also achieve substantially the same operations and effects as the contacts 50 shown in FIG. 38 and FIG. 39.

Figure 43:
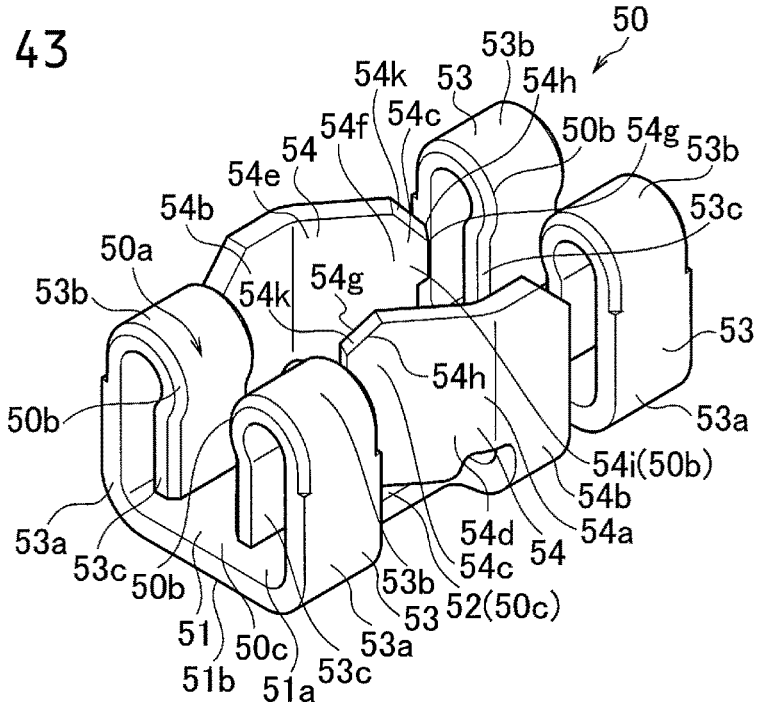
FIG. 43 is a perspective view showing a 14th modified example of the contact.

The contact 50 shown in FIG. 43 has a configuration in which one lock portion 54 is located between the two contact portions 53 (located in the middle in the X direction). The lock portion 54 is provided with the first lock piece 54*d* and the second lock piece 54*e*, and the extending direction of the first lock piece 54*d* is opposite to the extending direction of the second lock piece 54*e*.

Therefore, the locking portion of the first lock piece 54*d* at which the wire 30 is locked (the edge 54*g*) and the locking portion of the second lock piece 54*e* at which the wire 30 is locked (the edge 54*g*) are shifted in the X direction when viewed in the Y direction. Since the locking portions of the lock pieces 54*a* at which the wire 30 is locked (the edges 54*g*) are shifted from each other, the number of the locking portions at which the wire 30 is locked can be increased when viewed in the Y direction. Further, the locking portions of the lock pieces 54*a* at which the wire 30 is locked (the edges 54*g*) can be arranged in a manner such that the distance therebetween from the center of the contact 50 in the X direction is substantially the same when viewed in the Y direction. In other words, the lock portion 54 can be prevented from being displaced to either side in the X direction.

The contact 50 having the configuration described above can also achieve substantially the same operations and effects as those in the first and second embodiments. Further, a reduction in size of the contact 50 in the X direction can be achieved.

Figure 44:
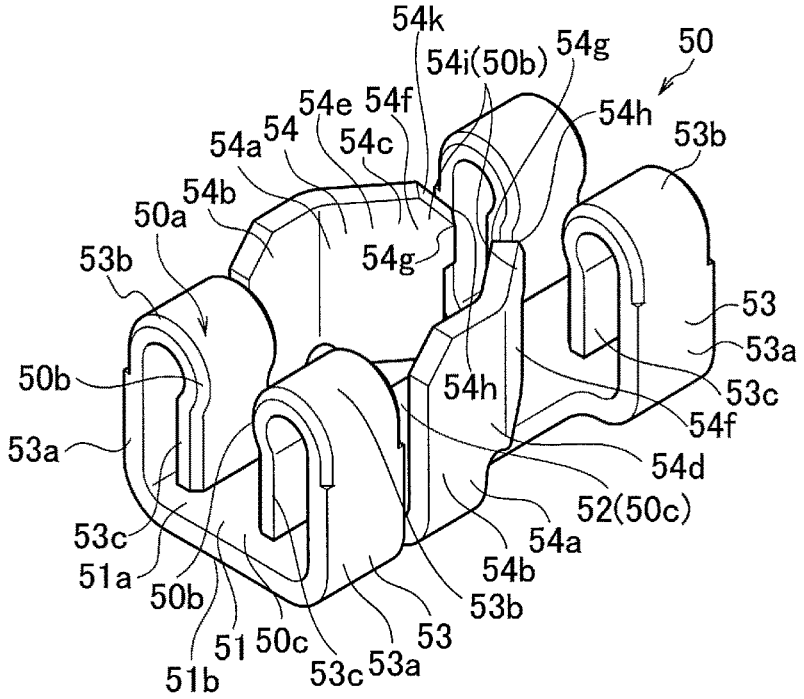
FIG. 44 is a perspective view showing a 15th modified example of the contact.

The contact 50 shown in FIG. 44 has a configuration in which one lock portion 54 is located between the two contact portions 53 (located in the middle in the X direction). The lock portion 54 is provided with the first lock piece 54*d* and the second lock piece 54*e*, and the extending direction of the first lock piece 54*d* is the same as the extending direction of the second lock piece 54*e*.

Therefore, the locking portion of the first lock piece 54*d* at which the wire 30 is locked (the edge 54*g*) and the locking portion of the second lock piece 54*e* at which the wire 30 is locked (the edge 54*g*) substantially coincide with each other when viewed in the Y direction. The locking portions of the lock pieces 54*a* at which the wire 30 is locked (the edges 54*g*) coinciding with each other can further increase the strength to lock the wire 30 with the lock portion 54.

The contact 50 having the configuration described above can achieve substantially the same operations and effects as those in the first and second embodiments. Further, a reduction in size of the contact 50 in the X direction can be achieved.

Figure 45:
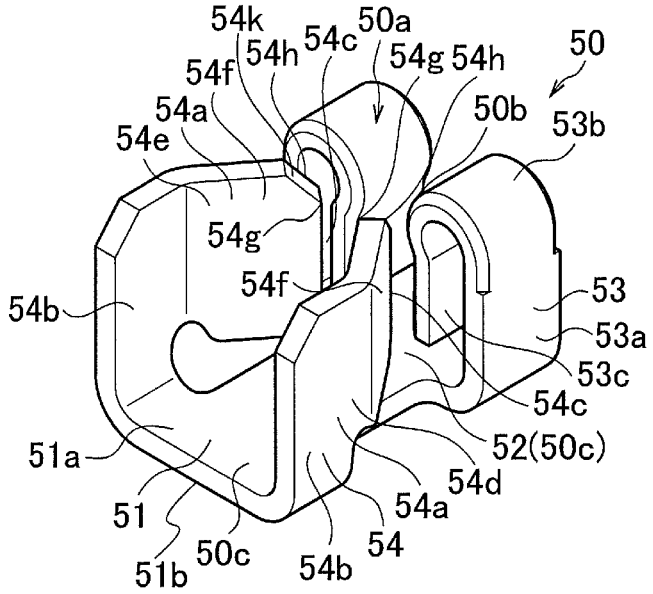
FIG. 45 is a perspective view showing a 16th modified example of the contact.

The contact 50 shown in FIG. 45 has a configuration in which one contact portion 53 and one lock portion 54 are aligned in the X direction. The lock pieces 54*a* extend in a manner such that the tips 54*f* face the contact portion 53 in the X direction.

The contact 50 having the configuration described above can achieve substantially the same operations and effects as those in the first and second embodiments. The contact 50 can also achieve substantially the same operations and effects as the contact 50 shown in FIG. 32. In addition, a further reduction in size of the contact 50 in the X direction can be achieved.

Figure 46:
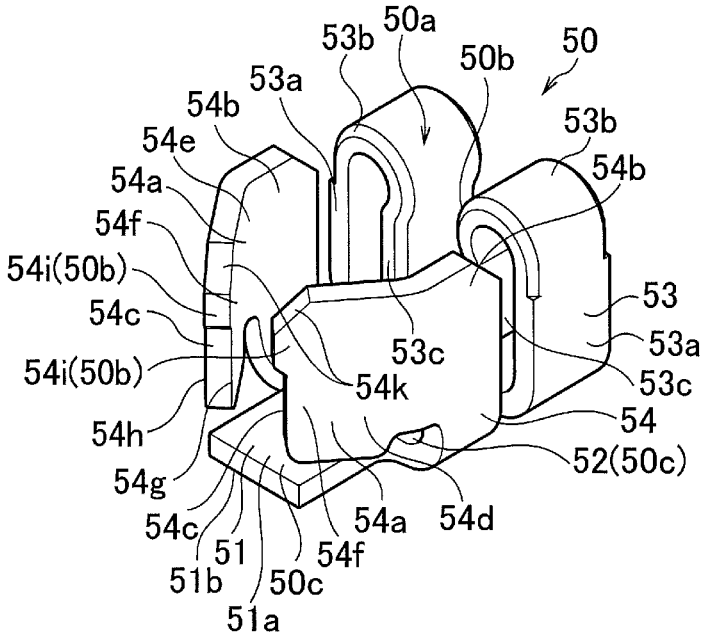
FIG. 46 is a perspective view showing a 17th modified example of the contact.

The contact 50 shown in FIG. 46 has a configuration in which one contact portion 53 and one lock portion 54 are aligned in the X direction. The lock pieces 54*a* extend in a manner such that the tips 54*f* are located on the opposite side of the contact portion 53 in the X direction.

The contact 50 having the configuration described above can achieve substantially the same operations and effects as those in the first and second embodiments. The contact 50 can also achieve substantially the same operations and effects as the contact 50 shown in FIG. 30. In addition, a further reduction in size of the contact 50 in the X direction can be achieved.

Figure 47:
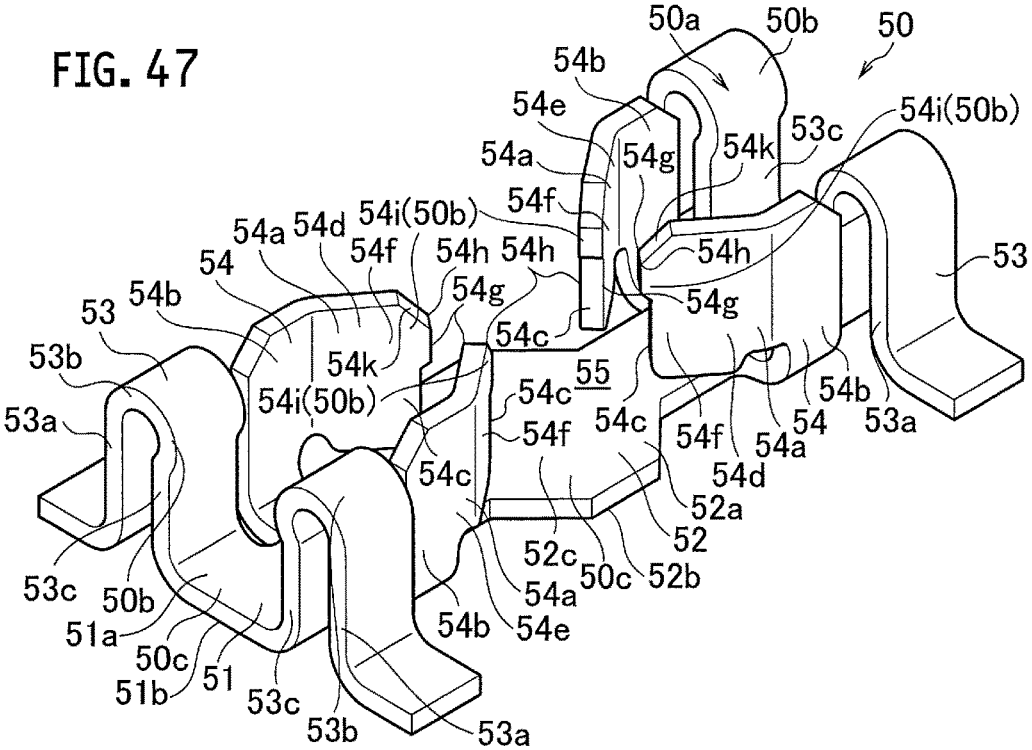
FIG. 47 is a perspective view showing an 18th modified example of the contact.

The contact 50 shown in FIG. 47 has a configuration in which the contact portions 53 are placed on both sides in the X direction, and the two lock portions 54 are placed between the respective contact portions 53. The connecting portion 52 is formed into a trapezoidal shape, and the lock pieces (locking pieces) 54*a* of the respective lock portions 54 extend in a manner such that the tips 54*f* face inward in the X direction.

The respective contact portions 53 are bent outward on the tip side so that bases of the side walls cut and extending upward from both sides of the bottom walls 51 in the Y direction serve as contact pieces. In other words, the respective contact pieces of the contact portions 53 on both sides in the Y direction are connected on one side opposite to the opening 50*a* so as to be formed substantially into a U-shape.

When tip portions of the outer pieces 53*a* projecting in the Y direction are mounted on the board (the member to be connected) 60, the inner U-shaped portions (the holding pieces 53*c* connected to each other) can be elastically deformed in the Y direction (the width direction). Alternatively, the portions connecting the holding pieces 53*c* to each other may be mounted on the board (the member to be connected) 60.

The contact 50 having the configuration described above can achieve substantially the same operations and effects as those in the first and second embodiments. The contact 50 can also achieve substantially the same operations and effects as the contact 50 shown in FIG. 30. In addition, the outer pieces 53*a* are formed in a manner such that the tips of the holding pieces 53*c* bent upward from the bottom walls 51 are bent outward in the Y direction, which facilitates the manufacture of the contact portions 53.

Figure 48:
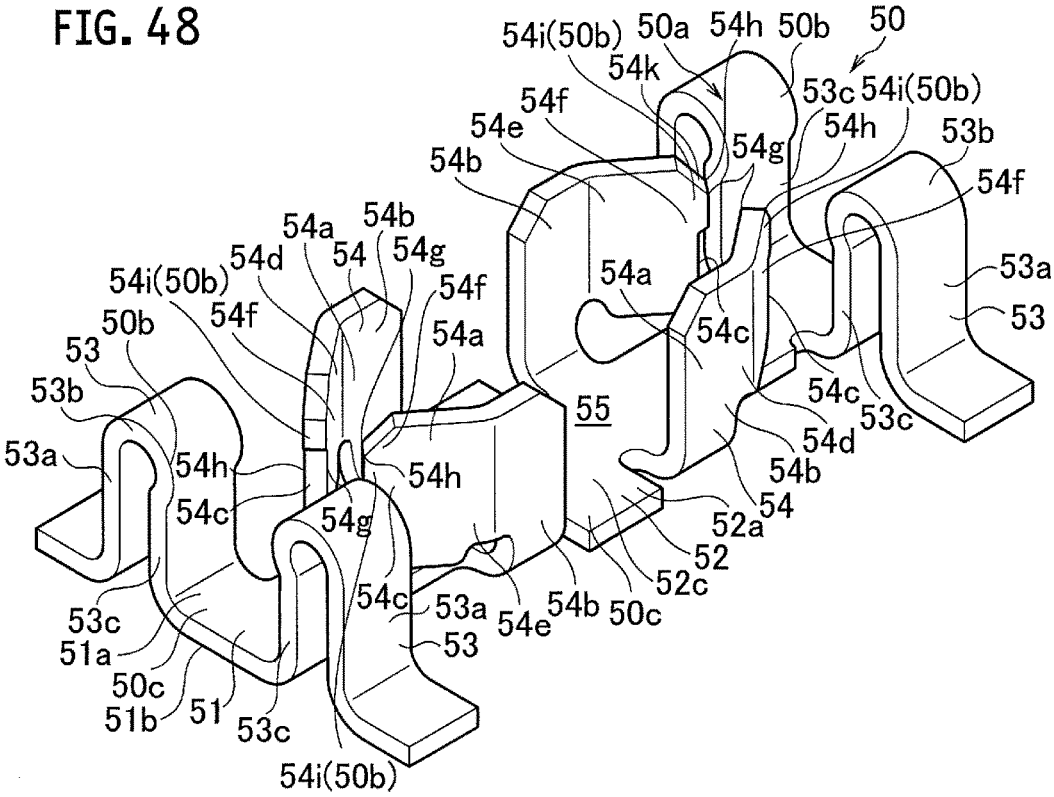
FIG. 48 is a perspective view showing a 19th modified example of the contact.

The contact 50 shown in FIG. 48 has a configuration in which the lock pieces 54*a* extend in the direction opposite to that in the contact 50 shown in FIG. 47.

The contact 50 having the configuration described above can achieve substantially the same operations and effects as those in the first and second embodiments. The contact 50 can also achieve substantially the same operations and effects as the contacts 50 shown in FIG. 32 and FIG. 47.

Figure 49:
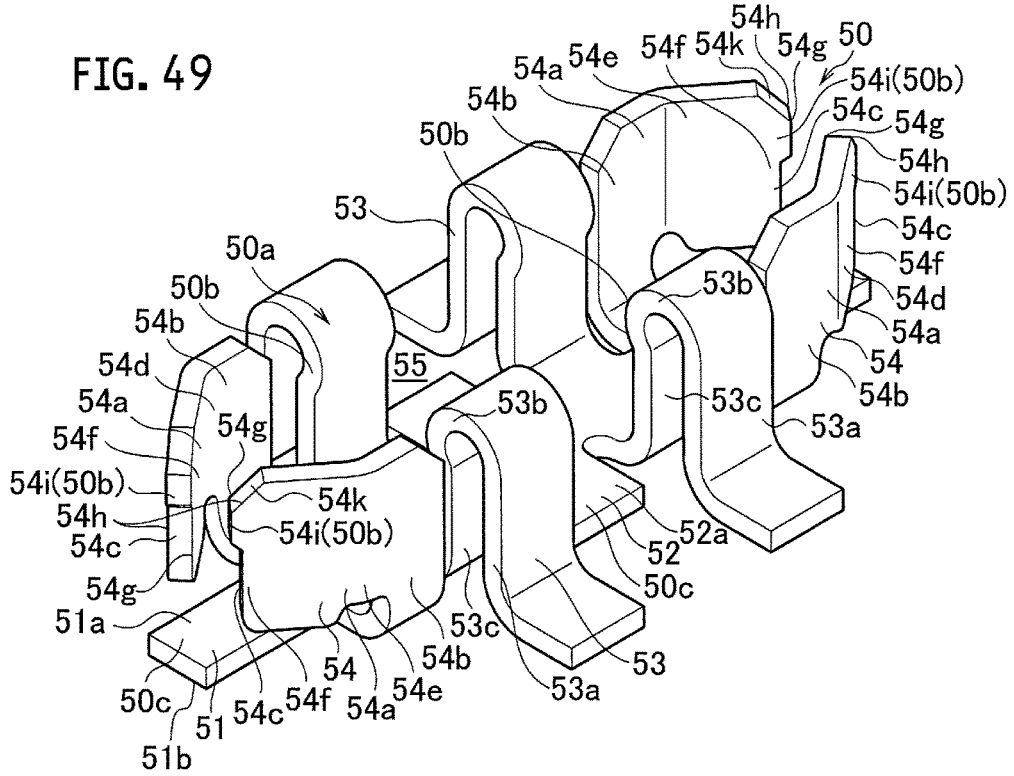
FIG. 49 is a perspective view showing a 20th modified example of the contact.

The contact 50 shown in FIG. 49 has a configuration in which the contact portions 53 and the lock portions 54 are replaced with those in the contact 50 shown in FIG. 48 in a manner such that the contact portions 53 are located on the inner side in the X direction, and the lock portions 54 are located on the outer side in the X direction.

The contact 50 having the configuration described above can achieve substantially the same operations and effects as those in the first and second embodiments. The contact 50 can also achieve substantially the same operations and effects as the contacts 50 shown in FIG. 34 and FIG. 47.

Figure 50:
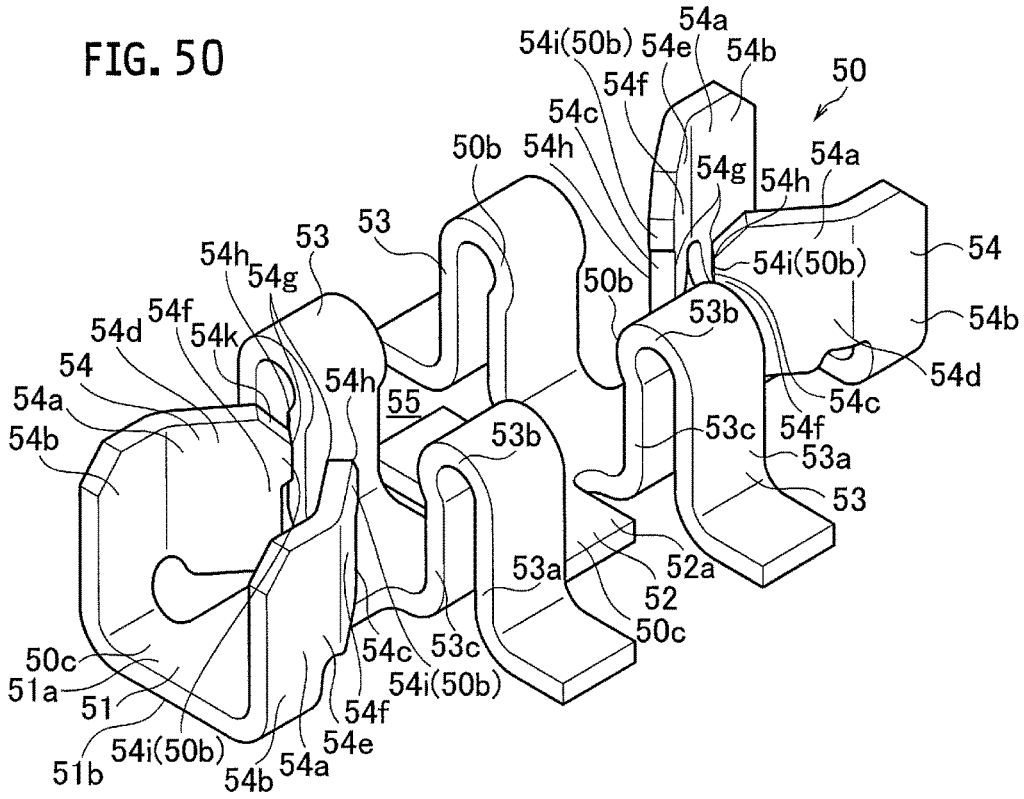
FIG. 50 is a perspective view showing a 21st modified example of the contact.

The contact 50 shown in FIG. 50 has a configuration in which the contact portions 53 and the lock portions 54 are replaced with those in the contact 50 shown in FIG. 47 in a manner such that the contact portions 53 are located on the inner side in the X direction, and the lock portions 54 are located on the outer side in the X direction.

The contact 50 having the configuration described above can achieve substantially the same operations and effects as those in the first and second embodiments. The contact 50 can also achieve substantially the same operations and effects as the contacts 50 shown in FIG. 33 and FIG. 47.

Figure 51:
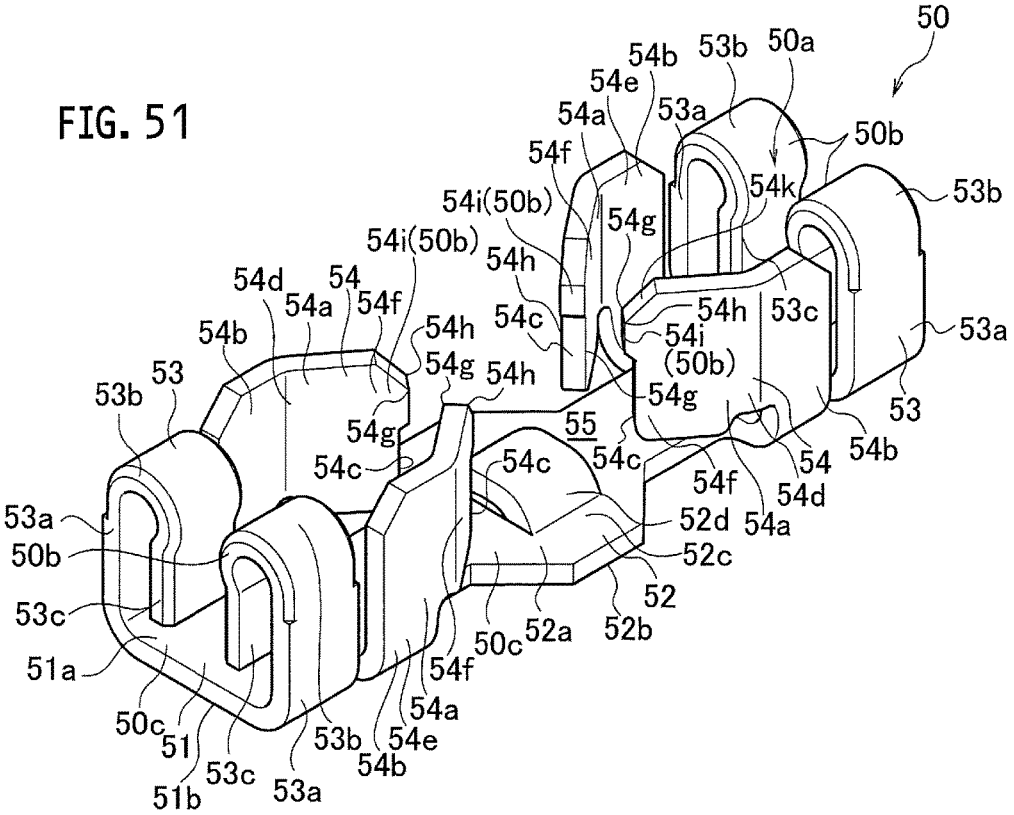
FIG. 51 is a perspective view showing a 22nd modified example of the contact.

The contact 50 shown in FIG. 51 has a configuration in which the connecting portion 52 in the contact 50 shown in FIG. 30 is provided with a projection 52*d* projecting toward the opening 50*a*. The projection 52*d* can be formed in a manner such that the connecting portion 52 is subjected to shearing processing.

Figure 52:
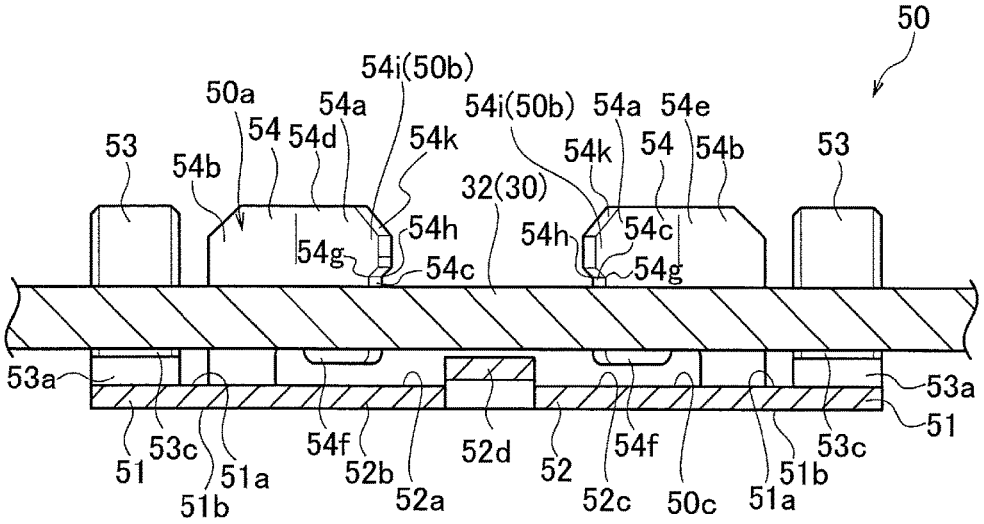
FIG. 52 is a cross-sectional view schematically showing a state where the contact of FIG. 51 holds the wire.

As shown in FIG. 52, the projection 52*d* thus formed can prevent the wire 30 from moving to both sides in the Z direction in association with the projections 54*i* so as to hold the wire 30 in the contact 50 more reliably. In addition, since the number of the contact points between the contact 50 and the wire 30 increases, the electrical connection can be further stabilized.

The contact 50 having the configuration described above can also achieve substantially the same operations and effects as those in the first and second embodiments.

Figure 53:
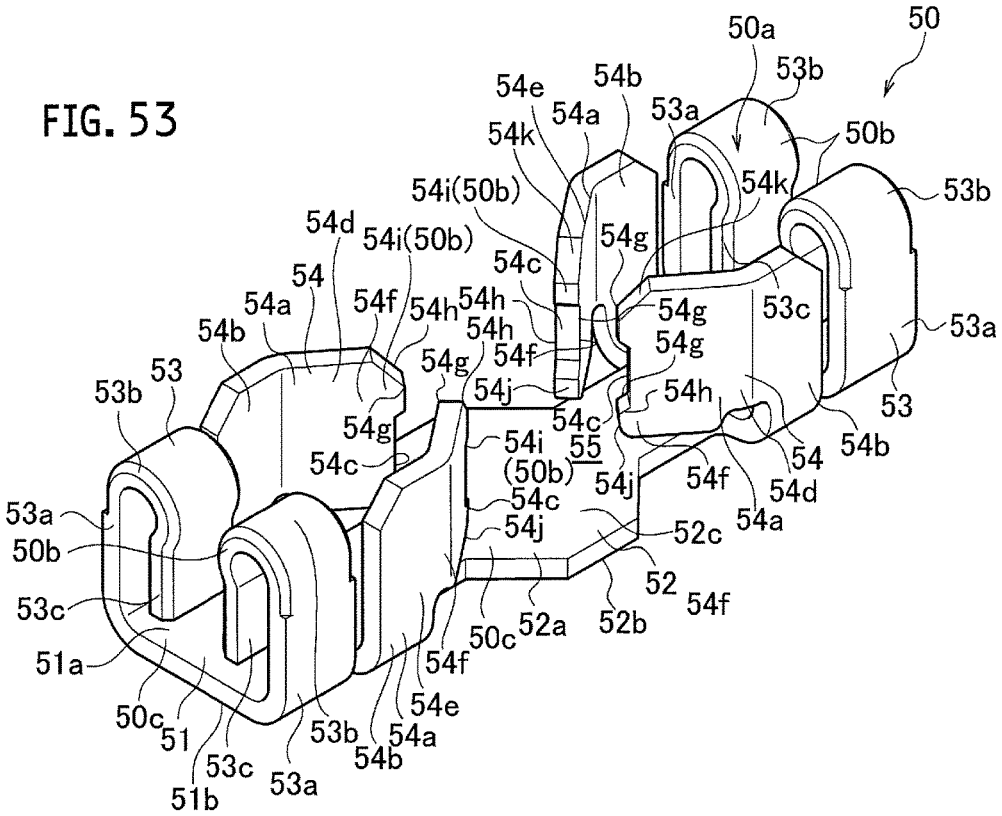
FIG. 53 is a perspective view showing a 23rd modified example of the contact.

The contact 50 shown in FIG. 53 has a configuration in which the drop-off prevention portions for covering at least part of the wire 30 in contact with the contact portions 5 are formed at the lock pieces (the locking pieces) 54*a* of the lock portions (the movement restriction member) 54 on one side in the Z direction (toward the movement regulation member), in addition to the other side in the Z direction.

More particularly, the projections 54*i* projecting in both the Y direction and the X direction are formed at the tips 54*f* of the lock pieces (the locking pieces) 54*a* toward the opening 50*a* in a manner such that the gap between the respective projections 54*i* located on both sides in the Y direction is smaller than the diameter of the wire 30. In addition, projections 54*j* projecting in both the Y direction and the X direction are formed at the tips 54*f* of the lock pieces (the locking pieces) 54*a* toward the movement regulation member in a manner such that the gap between the respective projections 54*j* located on both sides in the Y direction is smaller than the diameter of the wire 30.

Figure 54:
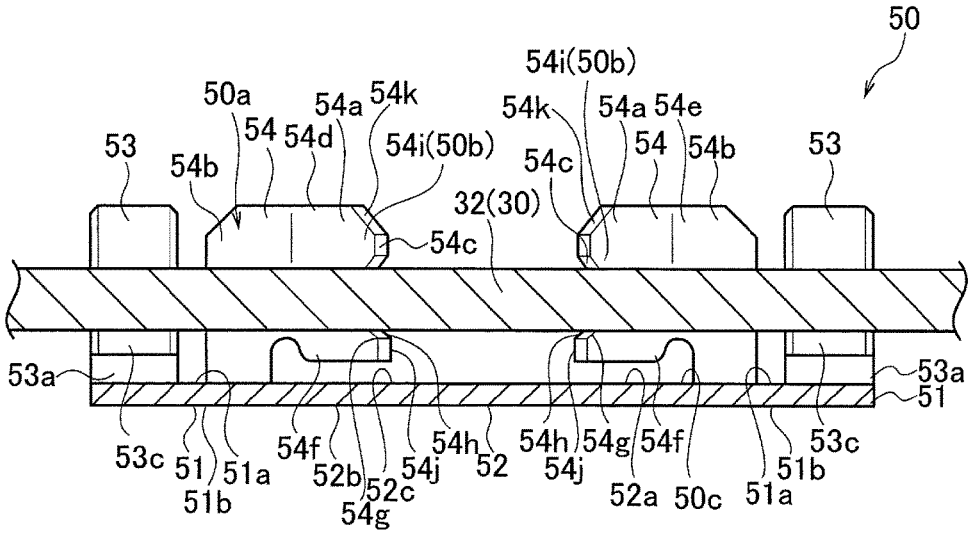
FIG. 54 is a cross-sectional view schematically showing a state where the contact of FIG. 53 holds the wire.

As shown in FIG. 54, the projections 54*i* and the projections 54*j* of the lock pieces (the locking pieces) 54*a* having such a configuration can prevent the wire 30 from moving to both sides in the Z direction so as to hold the wire 30 in the contact 50 more reliably. In addition, since the number of the contact points between the contact 50 and the wire 30 increases, the electrical connection can be further stabilized.

The contact 50 having the configuration described above can also achieve substantially the same operations and effects as those in the first and second embodiments.

Figure 55:
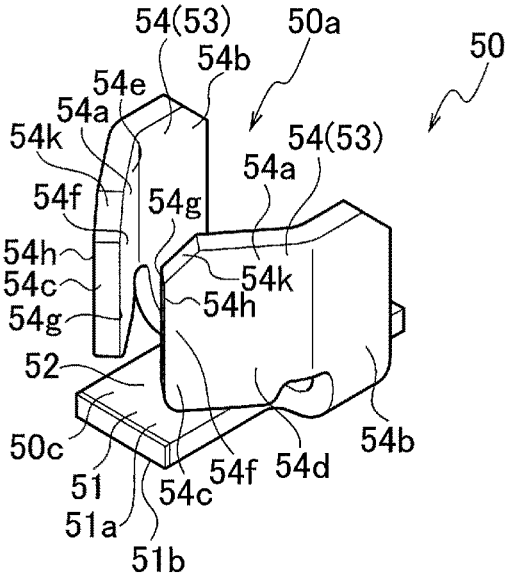
FIG. 55 is a perspective view showing a 24th modified example of the contact.

The contact 50 shown in FIG. 55 has a configuration in which one lock portion (the movement restriction member) 54 is formed on the bottom wall 51 so that the lock portion (the movement restriction member) 54 also serves as the contact portion 53, and the bottom wall 51 serves as the movement regulation member. In particular, once the wire 30 is inserted into the contact 50 shown in FIG. 55, the movement of the wire 30 in the X direction is restricted by the lock pieces 54*a* of the lock portion 54, and the contact 50 and the wire 30 is electrically connected to each other due to the lock pieces 54*a*.

Accordingly, a reduction in size of the contact 50 in the X direction can be achieved. The contact 50 having the configuration described above can also achieve substantially the same operations and effects as those in the first and second embodiments.

Figure 56:
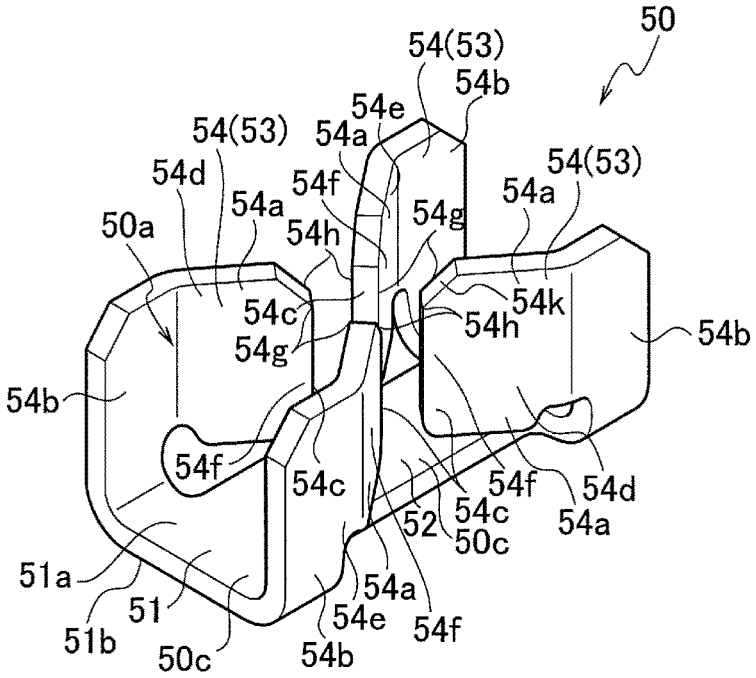
FIG. 56 is a perspective view showing a 25th modified example of the contact.

The contact 50 shown in FIG. 56 has a configuration in which the two lock portions (the movement restriction member) 54 also serving as the contact portions 53 are aligned in the X direction. The lock pieces 54*a* of the two lock portions 54 extend in the directions opposite to each other. In FIG. 56, the lock pieces (the locking pieces) 54*a* of the respective lock portions 54 extend in a manner such that the respective tips 54*f* face inward in the X direction.

The contact 50 having the configuration described above can achieve substantially the same operations and effects as those in the first and second embodiments. The contact 50 can also achieve substantially the same operations and effects as the contacts 50 shown in FIG. 32 and FIG. 55. The contact 50 shown in FIG. 56 comes into contact with and locks the wire 30 at two points when viewed in the Y direction. Accordingly, a reduction in size of the contact 50 can be achieved, a movement of the wire 30 can be restricted, and reliability of connection between the contact 50 and the wire 30 can be improved.

Figure 57:
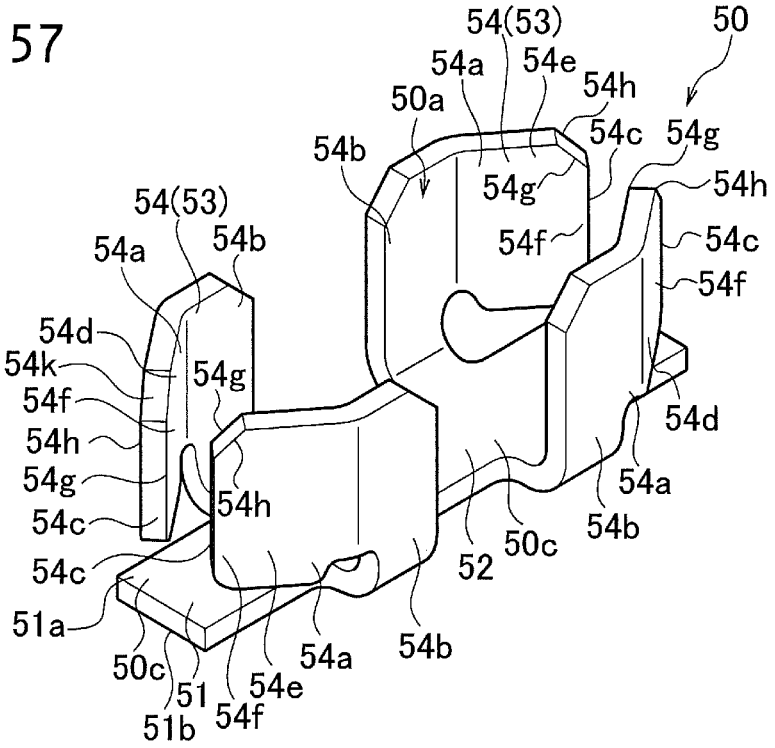
FIG. 57 is a perspective view showing a 26th modified example of the contact.

The contact 50 shown in FIG. 57 has a configuration in which the two lock portions (the movement restriction member) 54 also serving as the contact portions 53 are aligned in the X direction. The lock pieces 54*a* of the two lock portions 54 extend in the directions opposite to each other. In FIG. 57, the lock pieces (the locking pieces) 54*a* of the respective lock portions 54 extend in a manner such that the respective tips 54*f* face outward in the X direction.

The contact 50 having the configuration described above can achieve substantially the same operations and effects as those in the first and second embodiments. The contact 50 can also achieve substantially the same operations and effects as the contacts 50 shown in FIG. 34 and FIG. 56.

Figure 58:
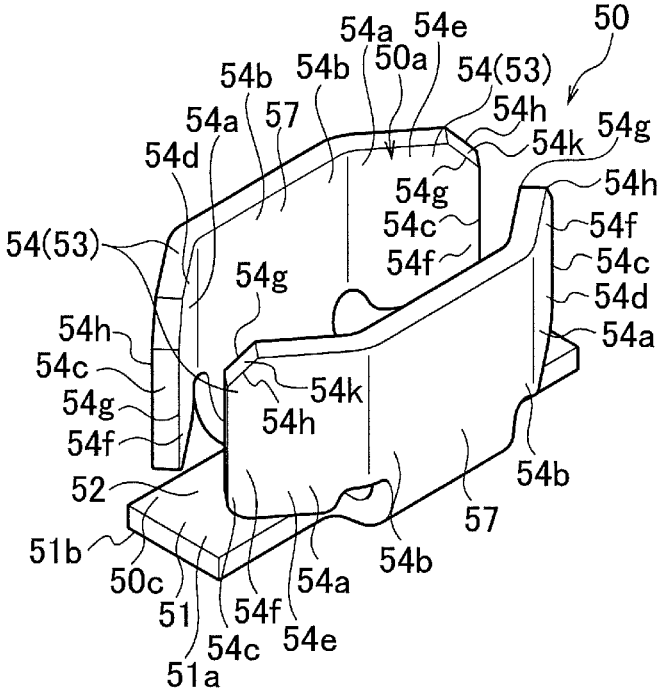
FIG. 58 is a perspective view showing a 27th modified example of the contact.

The contact 50 shown in FIG. 58 has a configuration in which the two lock portions (the movement restriction member) 54 also serving as the contact portions 53 are aligned in the X direction. The lock pieces 54*a* of the two lock portions 54 extend in the directions opposite to each other. In FIG. 58, the lock pieces (the locking pieces) 54*a* of the respective lock portions 54 extend in a manner such that the respective tips 54*f* face outward in the X direction. In addition, the respective lot pieces 54*a* located on the same side in the Y direction extend from one side wall 57.

The contact 50 having the configuration described above can achieve substantially the same operations and effects as those in the first and second embodiments. The respective lock pieces 54*a* located on the same side in the Y direction extend from the same side wall 57 without being formed separately on the same side in the Y direction so as to further facilitate the formation of the contact 50.

Here, the respective side walls 57 are not necessarily formed into a plate when viewed in the Y direction. For example, the side walls 57 may be provided with slits extending in the Z direction so as to be divided into plural parts in the X direction. Each slit is not required to be formed from the top to the bottom when viewed in the Y direction, and only part of (for example, only the upper half of) the side walls 57 may be provided with slits.

Further, the side wall 57 is not necessarily provided on both sides in the Y direction and may be provided only one side in the Y direction.

Figure 59:
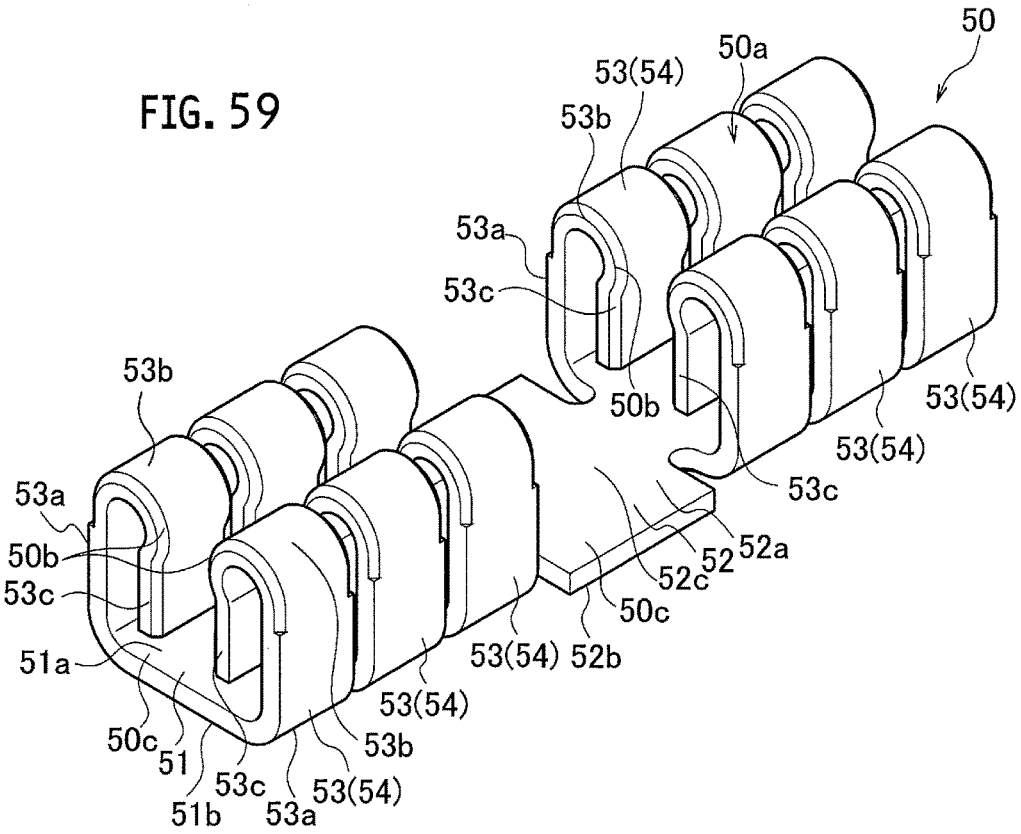
FIG. 59 is a perspective view showing a 28th modified example of the contact.

The contact 50 shown in FIG. 59 has a configuration in which the respective three contact portions 53 also serving as the lock portions (the movement restriction member) 54 are provided on both sides in the X direction with the connecting portion 52 interposed therebetween. In particular, the holding pieces 53*c* hold the wire 30 to electrically connect the wire 30 and the contact 50, and at the same time, a movement of the wire 30 in the X direction is restricted (locked) due to frictional force of the holding pieces 53*c*.

The contact 50 having the configuration described above can achieve substantially the same operations and effects as those in the first and second embodiments. Further, the configuration in which the contact portions having the same shape are aligned in the X direction has the advantage of facilitating the manufacture of the contact 50.

Alternatively, the edges of the contact pieces of the contact portions 53 (the edges in the Z direction or the X direction) may be bent inward in the Y direction so as to lock the wire 30 with the bent portions thus obtained.

Although FIG. 59 illustrates the case where the respective contact portions 53 are individually provided with the outer pieces 53*a*, the inner pieces 53*b* and the holding pieces 53*c*, part of or the entire outer pieces 53*a* may be connected at least between the two contact portions 53. The same configuration may also be applied to the inner pieces 53*b* or the holding pieces 53*c*.

Figure 60:
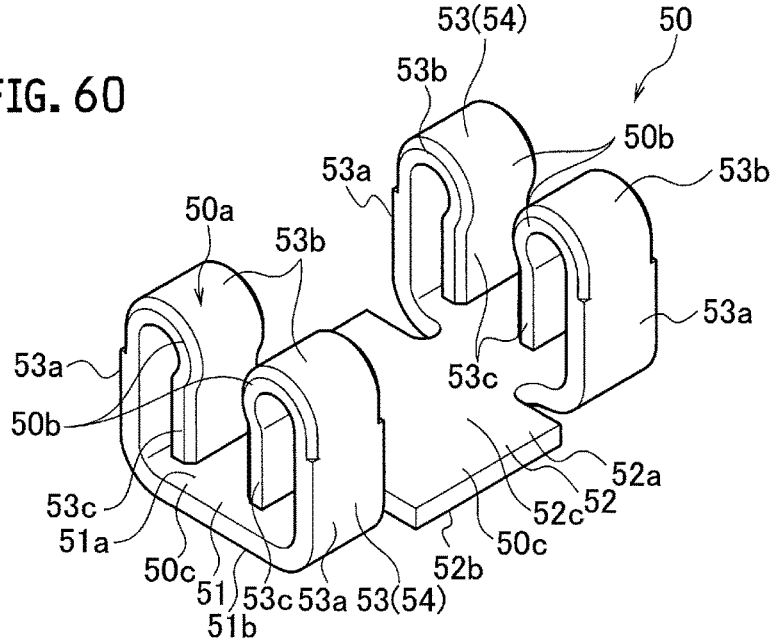
FIG. 60 is a perspective view showing a 29th modified example of the contact.

The contact 50 shown in FIG. 60 has a configuration in which the contact portion 53 also serving as the lock portion (the movement restriction member) 54 is provided on each side in the X direction with the connecting portion 52 interposed therebetween.

The contact 50 having the configuration described above can achieve substantially the same operations and effects as those in the first and second embodiments. The contact 50 can also achieve substantially the same operations and effects as the contact 50 shown in FIG. 59.

Alternatively, the edges of the contact pieces of the contact portions 53 (the edges in the Z direction or the X direction) may be bent inward in the Y direction so as to lock the wire 30 with the bent portions thus obtained.

Figure 61:
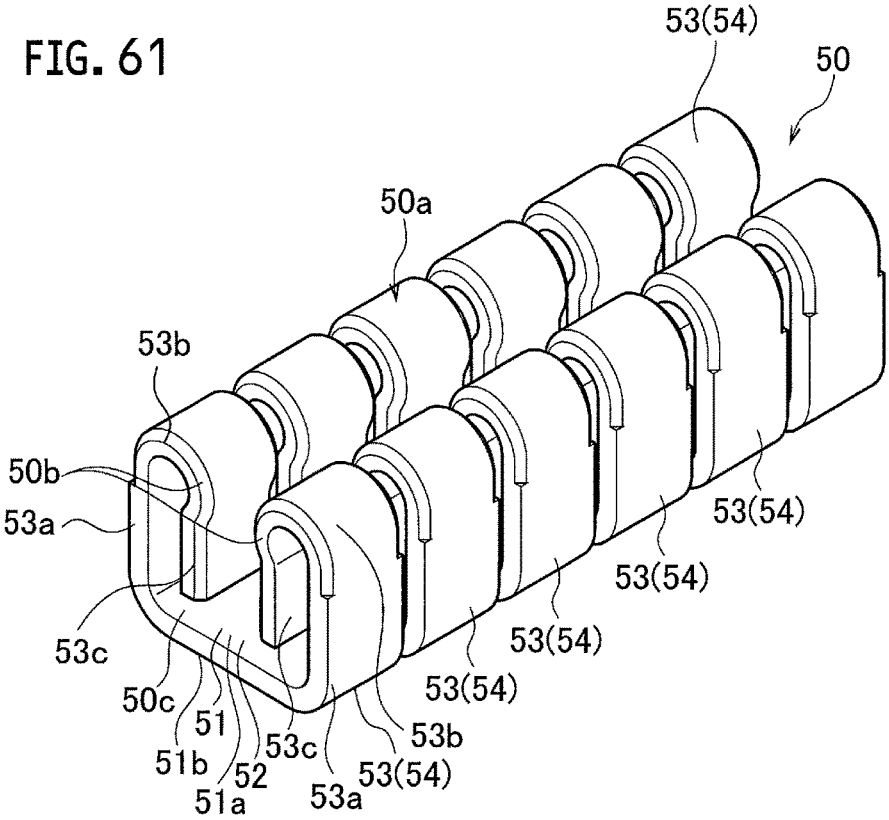
FIG. 61 is a perspective view showing a 30th modified example of the contact.

The contact 50 shown in FIG. 61 has a configuration in which the six contact portions 53 also serving as the lock portions (the movement restriction member) 54 are aligned in the X direction.

The contact 50 having the configuration described above can achieve substantially the same operations and effects as those in the first and second embodiments. The contact 50 can also achieve substantially the same operations and effects as the contact 50 shown in FIG. 59.

Alternatively, the edges of the contact pieces of the contact portions 53 (the edges in the Z direction or the X direction) may be bent inward in the Y direction so as to lock the wire 30 with the bent portions thus obtained.

Although FIG. 61 illustrates the case where the respective contact portions 53 are individually provided with the outer pieces 53*a*, the inner pieces 53*b* and the holding pieces 53*c*, part of or the entire outer pieces 53*a* may be connected at least between the two contact portions 53. The same configuration may also be applied to the inner pieces 53*b* or the holding pieces 53*c*.

Figure 62:
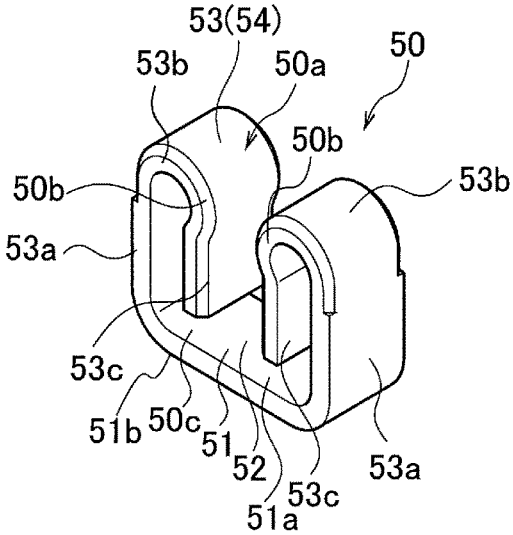
FIG. 62 is a perspective view showing a 31st modified example of the contact.

The contact 50 shown in FIG. 62 has a configuration in which only one contact portion 53 also serving as the lock portion (the movement restriction member) 54 is provided.

The contact 50 having the configuration described above can achieve substantially the same operations and effects as those in the first and second embodiments. The contact 50 can also achieve substantially the same operations and effects as the contact 50 shown in FIG. 59.

Alternatively, the edges of the contact pieces of the contact portion 53 (the edges in the Z direction or the X direction) may be bent inward in the Y direction so as to lock the wire 30 with the bent portions thus obtained.

Figure 63:
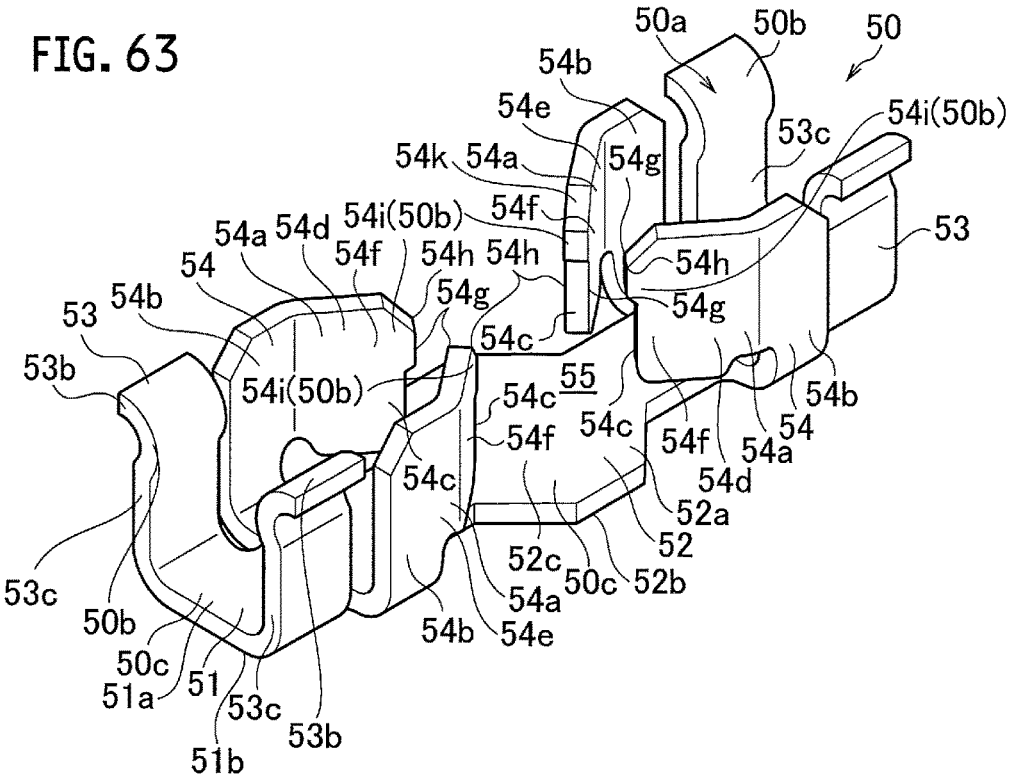
FIG. 63 is a perspective view showing a 32nd modified example of the contact.

The contact 50 shown in FIG. 63 has a configuration in which the contact portions 53 are placed on both sides in the X direction, and the two lock portions 54 are placed between the respective contact portions 53. The connecting portion 52 is formed into a trapezoidal shape, and the lock pieces (the locking pieces) 54*a* of the respective lock portions 54 extend in a manner such that the tips 54*f* face inward in the X direction.

The respective contact portions 53 are bent outward on the tip side so that bases of the side walls cut and extending upward from both sides of the bottom walls 51 in the Y direction serve as contact pieces (the holding pieces 53*c*). In other words, the respective contact pieces (the holding pieces 53*c*) of the contact portions 53 on both sides in the Y direction are integrated with each other on one side opposite to the opening 50*a* so as to be formed substantially into a U-shape. Further, the substantially U-shaped contact portions 53 are provided toward the opening 50*a* with the contact pieces 53*b* gradually widening on both sides in the Y direction. The contact pieces 53*b* having such a configuration enable the wire 30 to be inserted into the contact 50 easily.

The contact 50 is provided, to serve as the contact pieces 53*b* of the contact portions 53, with the drop-off prevention portions 50*b* for covering at least part of the wire 30 on the other side in the Z direction while being in contact with the contact portions 53 (on the opening side in the state where the wire 30 is in contact with the contact portions 53).

More particularly, the respective contact pieces 53*b* protrude inward in the Y direction in a manner such that the gap between the respective contact pieces 53*b* located on both sides in the Y direction is smaller than the diameter of the wire 30. In FIG. 63, the contact pieces 53*b* are curved greatly so as to protrude inward in the Y direction.

Accordingly, the wire 30 can be prevented from moving in the direction opposite to the direction in which the wire 30 is attached (to the direction in which the wire 30 is inserted into the contact 50) and prevented from coming off the contact 50. In addition, since the wire 30 is inserted into the contact 50 by climbing over the drop-off prevention portions 50*b* protruding inward in the Y direction, a feeling of clicking can be ensured at the time of insertion of the wire 30 so that the connection of the wire 30 can be confirmed easily. Here, the contact portions 53 are not necessarily provided with the contact pieces 53*b*. In addition, the contact pieces 53*b* do not necessarily serve as the drop-off prevention portions 50*b*.

The contact 50 having the configuration described above can achieve substantially the same operations and effects as those in the first and second embodiments. The contact 50 can also achieve substantially the same operations and effects as the contact 50 shown in FIG. 47. In addition, the contact 50 shown in FIG. 63 does not have a double-layer structure but is provided with a single side wall at the respective contact portions on each side in the Y direction when viewed in the X direction, which can facilitate the manufacture of the contact 50 and achieve a simplification of the structure thereof.

Figure 64:
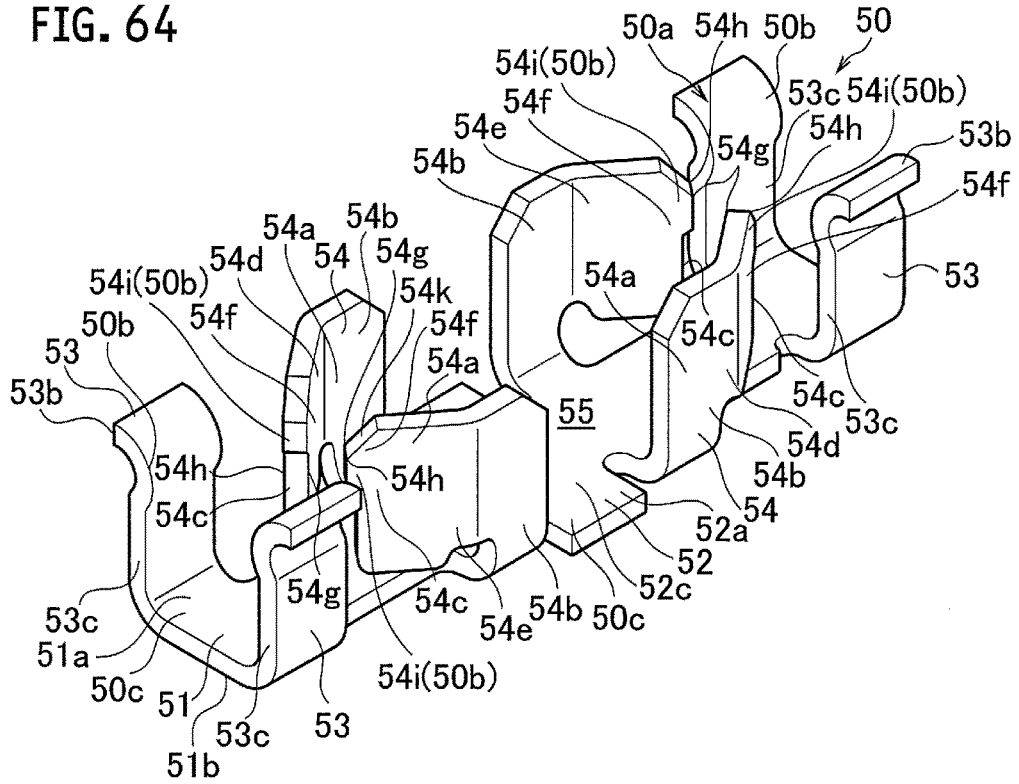
FIG. 64 is a perspective view showing a 33rd modified example of the contact.

The contact 50 shown in FIG. 64 has a configuration in which the lock pieces 54*a* extend in the direction opposite to that in the contact 50 shown in FIG. 63.

The contact 50 having the configuration described above can achieve substantially the same operations and effects as those in the first and second embodiments. The contact 50 can also achieve substantially the same operations and effects as the contacts 50 shown in FIG. 47 and FIG. 48 and the contact 50 shown in FIG. 63.

Figure 65:
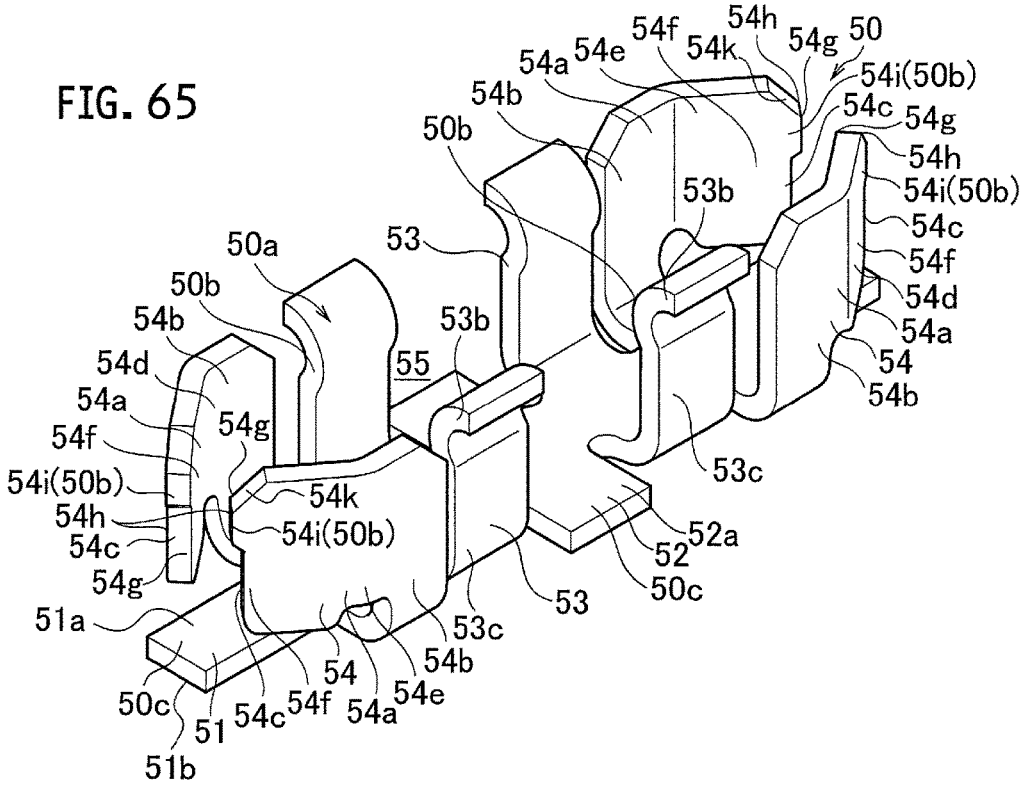
FIG. 65 is a perspective view showing a 34th modified example of the contact.

The contact 50 shown in FIG. 65 has a configuration in which the contact portions 53 and the lock portions 54 are replaced with those in the contact 50 shown in FIG. 64 in a manner such that the contact portions 53 are located on the inner side in the X direction, and the lock portions 54 are located on the outer side in the X direction.

The contact 50 having the configuration described above can achieve substantially the same operations and effects as those in the first and second embodiments. The contact 50 can also achieve substantially the same operations and effects as the contacts 50 shown in FIG. 47 and FIG. 49 and the contact 50 shown in FIG. 63.

Figure 66:
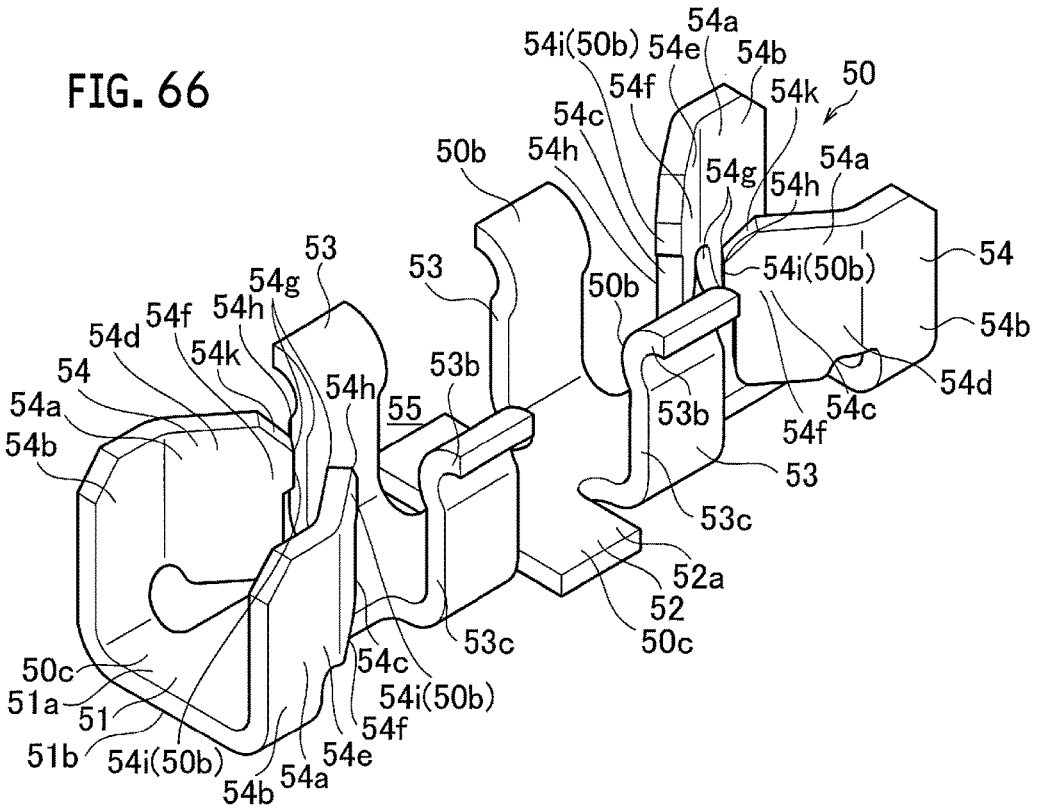
FIG. 66 is a perspective view showing a 35th modified example of the contact.

The contact 50 shown in FIG. 66 has a configuration in which the contact portions 53 and the lock portions 54 are replaced with those in the contact 50 shown in FIG. 63 in a manner such that the contact portions 53 are located on the inner side in the X direction, and the lock portions 54 are located on the outer side in the X direction.

The contact 50 having the configuration described above can achieve substantially the same operations and effects as those in the first and second embodiments. The contact 50 can also achieve substantially the same operations and effects as the contacts 50 shown in FIG. 47 and FIG. 50 and the contact 50 shown in FIG. 63.

Although the present invention has been described above by reference to the preferred embodiments, the present invention is not limited to the descriptions thereof, and it will be apparent to those skilled in the art that various modifications and improvements can be made.

For example, although the first embodiment exemplified the case where the tip of the wire is flattened after the wire is inserted into the locking portion of the housing, the wire may be inserted into the locking portion of the housing after the tip of the wire is flattened.

When the board-to-board type connector is used, the wire may be attached with the housing only on one side and attached with the contact directly on the other side.

Although the respective embodiments illustrated the contact portions provided with the opening on the side from which the wire is inserted, the contact portions not provided with the opening on the side from which the wire is inserted may be used.

For example, the contact portions may be formed of an elastically deformable member on the side from which the wire is inserted, and the wire may be inserted into the contact while elastically deforming the corresponding member. The elastically deformable member is preferably a leaf spring or the like so that the wire is held by the contact portions when the wire is inserted to a predetermined level or deeper.

In addition, a flat cable or FFC may be used as the wire.

In addition, the contact and the member to be connected may be connected after the wire is brought into contact with the contact.

The respective embodiments exemplified the case where the contact portions are electrically connected to the core of the wire, and the movement restriction member is engaged with the core of the wire so as to restrict a movement of the wire. However, the movement restriction member may be engaged with the covering member so as to restrict the movement of the wire.

In the first and second embodiments and the modified examples thereof, the edges of the contact pieces of the contact portions 53 (the edges in the Z direction or the X direction) may be bent inward in the Y direction so as to lock the wire 30 with the bent portions thus obtained.

In the first and second embodiments and the modified examples thereof, the contact 50 provided with the projections 54*i* is not necessarily provided with the projections 54*i*, and the contact 50 not including the projections 54*i* may be provided with the projections 54*i*.

In the first and second embodiments and the modified examples thereof, the contact pieces 53*b* do not necessarily serve as the drop-off prevention portions 50*b*.

The number, shape, method of positioning or the like of the contact portions, the movement restriction member or the movement regulation member may be determined as appropriate.

The flattened portion, the contact, the housing, and other particular specs (such as a shape, size and layout) can also be modified as necessary.

Particularly, the contact may employ the respective configurations described in each modified example independently or may combine the respective configurations as appropriate.

INDUSTRIAL APPLICABILITY

The present invention can provide a connector capable of facilitating attachment of a wire to a contact, a contact used in the connector, a housing, a wired housing, and a method for manufacturing a wired housing.

REFERENCE SIGNS LIST

10, 10A Connector
20 Plug housing (housing)
20*a* Insertion hole
20*b* Locking portion (holding portion: flattened-portion locking portion)
20*c* Insertion recess (wire introduction hole)
21*c* Notch (holding portion: flattened-portion locking portion)
21*d* Deep surface (holding portion: flattened-portion locking portion)
21*e* Side surface (holding portion: flattened-portion locking portion)
21*f* Projection (temporarily holding portion)
23*d* Through-hole (wire introduction hole)
26 Mount portion
26*a* Mount surface
30 Wire
31 Covering member
32 Core
32*a* Tip portion
32*b* Flattened portion
32*g* Wall surface
32B Core
32C Core
32D Coaxial cable
33 Internal conductor
34 Insulator
35 External conductor
40 Wired housing
50 Contact
50*a* Opening
51 Bottom wall (movement regulation member: installation member)
51*a* One surface
51*b* Other surface (installation surface)
51*c* Recess
52 Connecting portion (movement regulation member: installation member)
52*a* One surface (adhesion surface)
52*b* Other surface (installation surface)
53 Contact portion
53*a* Outer piece (first side wall portion)
53*b* Inner piece (contact piece)
53*c* Holding piece (second side wall portion: contact piece)
54 Lock portion (movement restriction member)
54*a* Lock piece (locking piece)
54*d* First lock piece (first locking piece)
54*e* Second lock piece (second locking piece)
60 Board (member to be connected)
81 Upper mold
82 Lower mold
90 Jig
91 Pressing portion
X Longitudinal direction of housing (wire extending direction)
Y Lateral direction of housing (width direction)
Z Thickness direction of housing (perpendicular direction: open direction of contact)

The invention claimed is:

1. A connector comprising a contact connected to a member to be connected and brought into contact with a wire so as to electrically connect the member to be connected and the wire, the contact including:

a contact portion coming into contact with the wire when the wire moves toward one side in a perpendicular direction perpendicular to a wire extending direction in which the wire extends;

a movement restriction member for restricting a movement of the wire on the contact in a state where the wire is in contact with the contact portion; and a movement regulation member for regulating a movement of the wire in the perpendicular direction in the state where the wire is in contact with the contact portion, wherein the contact includes an installation member installed and electrically connected to the member to be connected, the installation member includes the movement regulation member on one side and an installation surface for electrically connecting the member to be connected on another side, and a drop-off prevention portion for covering at least part of the wire on the other side in the perpendicular direction in the state where the wire is in contact with the contact portion is formed in the contact portion.

2. The connector according to claim 1, wherein the movement restriction member restricts the movement of the wire in the wire extending direction.

3. The connector according to claim 1, wherein:

the contact portion includes first side wall portions located on both sides in a width direction when viewed in the wire extending direction and at least one second side wall portion provided between the first side wall portions;

the second side wall portion includes a second side wall portion elastically deformable in the width direction; and the wire is held, at least on one side in the width direction, by the second side wall portion elastically deformable in the width direction.

4. The connector according to claim 1, wherein:

the movement regulation member includes the installation member.

5. The connector according to claim 1, wherein the installation member is provided with a recess at an edge thereof.

6. The connector according to claim 1, wherein the movement regulation member is provided with an adhesion surface on one side.

7. The connector according to claim 6, wherein the adhesion surface also serves as the movement regulation member.

8. The connector according to claim 1, wherein:

more than one movement restriction member is provided, each movement restriction member corresponding to the movement restriction member; and the more than one movement restriction member is arranged symmetrically when viewed in the perpendicular direction.

9. The connector according to claim 1, wherein the movement restriction member includes a locking piece for locking the wire in the state where the wire is in contact with the contact portion.

10. The connector according to claim 9, wherein the locking piece includes a lock piece for holding the wire in the state where the wire is in contact with the contact portion.

11. The connector according to claim 10, wherein the lock piece holds the wire in a state where a tip of the lock piece bites a wall surface of the wire.

12. The connector according to claim 11, wherein the tip of the lock piece bites the wall surface of the wire along a circumference thereof.

13. The connector according to claim 9, wherein:

the locking piece includes a first locking piece and a second locking piece facing each other with the wire interposed therebetween; and the movement regulation member is located between a locking portion of the first locking piece and a locking portion of the second locking piece when viewed in the perpendicular direction.

14. The connector according to claim 9, wherein the contact is formed in a manner such that a metal plate is processed, and the locking piece is formed in a manner such that the metal plate is cut and bent.

15. The connector according to claim 9, wherein the locking piece is connected to the movement regulation member on one side and extends toward the wire in contact with the contact portion on another side.

16. The connector according to claim 15, wherein the locking piece extends to make an acute angle to the wire extending direction of the wire in contact with the contact portion when viewed in the perpendicular direction.

17. The connector according to claim 16, wherein:

more than one movement restriction member is provided, each movement restriction member corresponding to the movement restriction member; and the more than one movement restriction member includes at least one movement restriction member including a locking piece having a first end and a second end, the second end being located on one side in the wire extending direction, and at least one movement restriction member including a locking piece having a first end and a second end, the second end being located on another side in the wire extending direction opposite to the one side.

18. The connector according to claim 15, wherein:

the contact is formed by being subjected to metal press processing; and a sharper edge of edges at the second end of each locking piece formed by the metal press processing in a punching direction is located toward the wire.

19. The connector according to claim 1, wherein the wire is held by the contact portion.

20. The connector according to claim 19, wherein the wire is inserted into and held by the contact portion when the wire is moved in the perpendicular direction.

21. The connector according to claim 1, wherein the contact is provided with an opening on a side from which the wire is inserted and provided with the movement regulation member on a side opposite to the side from which the wire is inserted.

22. The connector according to claim 21, wherein the contact is entirely open on the side from which the wire is inserted.

23. The connector according to claim 1, wherein the contact is open in a vertical direction with respect to one surface of the movement regulation member.

24. The connector according to claim 1, wherein the contact portion also serves as the movement restriction member.

25. The connector according to claim 1, wherein the contact portion includes a contact piece.

26. The connector according to claim 25, wherein the contact piece is formed separately from the locking piece formed in the movement restriction member.

27. The connector according to claim 26, wherein the contact piece and the locking piece are aligned in the wire extending direction.

28. The connector according to claim 1, wherein:

the wire comes into contact with the contact portion in a manner such that the wire not in contact with the contact portion is moved to one side in the perpendicular direction; and the contact includes a drop-off prevention portion for covering at least part of the wire in contact with the contact portion on another side in the perpendicular direction.

29. The connector according to claim 28, wherein the drop-off prevention portion is formed in at least one of the movement restriction member and the contact portion.

30. The connector according to claim 29, wherein the drop-off prevention portion is formed in at least one of the locking piece of the movement restriction member and the contact piece of the contact portion.

31. The connector according to claim 28, wherein the drop-off prevention portion includes a projection.

32. The connector according to claim 1, wherein the wire is a single-core wire.

33. The connector according to claim 1, wherein the wire is a stranded wire.

34. The connector according to claim 1, wherein the wire is a coaxial wire.

35. The connector according to claim 32, wherein:

the wire includes a core as a conductive member and a covering portion covering the core;

the contact portion is electrically connected to the core of the wire; and the movement restriction member is engaged with the core of the wire so as to restrict the movement of the wire.

36. The connector according to claim 32, wherein:

the wire include a core as a conductive member and a covering portion covering the core;

the contact portion is electrically connected to the core of the wire; and the movement restriction member is engaged with the covering portion of the wire so as to restrict the movement of the wire.

37. The connector according to claim 1, comprising a housing for housing and holding the wire without using the contact, wherein the housing is provided with an opening at least on one surface and holds the wire in a manner such that the housed and held wire is exposed on the opening when viewed in an open direction of the opening.

38. The connector according to claim 37, wherein:

the wire includes a flattened portion obtained in a manner such that a tip portion is flattened; and the housing includes a holding portion for holding the flattened portion of the wire.

39. A contact used in a connector, the connector comprising the contact connected to a member to be connected and brought into contact with a wire so as to electrically connect the member to be connected and the wire, the contact including:

a contact portion coming into contact with the wire when the wire moves toward one side in a perpendicular direction perpendicular to a wire extending direction in which the wire extends;

a movement restriction member for restricting a movement of the wire on the contact in a state where the wire is in contact with the contact portion; and a movement regulation member for regulating a movement of the wire in the perpendicular direction in the state where the wire is in contact with the contact portion, wherein the contact includes an installation member installed and electrically connected to the member to be connected, the installation member includes the movement regulation member on one side and an installation surface for electrically connecting the member to be connected on another side, and a drop-off prevention portion for covering at least part of the wire on the other side in the perpendicular direction in the state where the wire is in contact with the contact portion is formed in the contact portion.

40. A wired housing to which a wire is attached, the wired housing is used in a connector, the connector comprising a contact connected to a member to be connected and brought into contact with the wire so as to electrically connect the member to be connected and the wire, the contact including:

a contact portion coming into contact with the wire when the wire moves toward one side in a perpendicular direction perpendicular to a wire extending direction in which the wire extends;

a movement restriction member for restricting a movement of the wire on the contact in a state where the wire is in contact with the contact portion; and a movement regulation member for regulating a movement of the wire in the perpendicular direction in the state where the wire is in contact with the contact portion, wherein the contact includes an installation member installed and electrically connected to the member to be connected, the installation member includes the movement regulation member on one side and an installation surface for electrically connecting the member to be connected on another side, and a drop-off prevention portion for covering at least part of the wire on the other side in the perpendicular direction in the state where the wire is in contact with the contact portion is formed in the contact portion.

41. A housing used in a connector, the connector comprising:

a contact connected to a member to be connected and brought into contact with a wire so as to electrically connect the member to be connected and the wire, the housing holding the wire without using the contact;

the contact including:

a contact portion coming into contact with the wire when the wire moves toward one side in a perpendicular direction perpendicular to a wire extending direction in which the wire extends;

a movement restriction member for restricting a movement of the wire on the contact in a state where the wire is in contact with the contact portion; and a movement regulation member for regulating a movement of the wire in the perpendicular direction in the state where the wire is in contact with the contact portion, wherein the contact includes an installation member installed and electrically connected to the member to be connected, the installation member includes the movement regulation member on one side and an installation surface for electrically connecting the member to be connected on another side, and a drop-off prevention portion for covering at least part of the wire on the other side in the perpendicular direction in the state where the wire is in contact with the contact portion is formed in the contact portion, wherein the housing is provided with an opening at least on one surface and holds the wire in a manner such that the held wire is exposed on the opening when viewed in an open direction of the opening.

42. A housing for housing and holding a wire without using a contact, the housing comprising:

a housing portion for housing the wire where the wire moves in a wire extending direction which is parallel to a longitudinal axis of the housing portion;

an opening communicating with the housing portion in such a manner as to be open in a perpendicular direction perpendicular to the wire extending direction and exposing the wire housed in the housing portion when viewed in the perpendicular direction; and a holding portion for holding the wire housed in the housing portion, wherein the housing portion can receive, via the opening, the contact connected to a member to be connected, and the contact comes into contact with the wire in a state where the wire is housed in the housing portion, and the housing further comprises:

a mount portion on which the wire housed in the housing portion is mounted, and a temporary holding portion for temporarily holding the wire housed in the housing portion, wherein the temporary holding portion projects from a mount surface of the mount portion so as to raise the wire relative to the mount surface.

43. The housing according to claim 42, wherein:

the wire includes a flattened portion formed in a manner such that a tip portion is flattened; and the holding portion holds the flattened portion of the wire.

44. The housing according to claim 43, wherein the holding portion includes a flattened-portion locking portion for locking the flattened portion.

45. The housing according to claim 42, wherein the mount surface of the mount portion on which the wire is mounted is formed to conform to a surface of the wire.

46. The housing according to claim 42, wherein the housing is formed only by use of upper and lower metal molds.

47. The housing according to claim 44, wherein:

the flattened-portion locking portion is a space defined by wall surfaces; and the wall surfaces surrounding the flattened-portion locking portion are provided with an open hole through which the wire is exposed.

48. The housing according to claim 47, wherein the open hole is provided on the respective wall surfaces facing each other and surrounding the flattened-portion locking portion.

49. The housing according to claim 42, comprising a wire introduction hole by which the housing portion communicates with an outside and through which the wire is inserted so as to be housed in the housing portion.

* * * * *